US012250995B2

(12) United States Patent
Roser

(10) Patent No.: US 12,250,995 B2
(45) Date of Patent: Mar. 18, 2025

(54) HUMAN LOCOMOTION SHOE AND CLOTHING

(71) Applicant: Mark Costin Roser, Hebron, CT (US)

(72) Inventor: Mark Costin Roser, Hebron, CT (US)

( * ) Notice: Subject to any disclaimer, the term of this patent is extended or adjusted under 35 U.S.C. 154(b) by 0 days.

(21) Appl. No.: 15/224,532

(22) Filed: Jul. 30, 2016

(65) Prior Publication Data

US 2017/0027278 A1 Feb. 2, 2017

Related U.S. Application Data

(63) Continuation of application No. 13/679,611, filed on Nov. 16, 2012, now Pat. No. 9,572,395, which is a (Continued)

(51) Int. Cl.
*A43B 7/18* (2006.01)
*A41D 1/06* (2006.01)
(Continued)

(52) U.S. Cl.
CPC ..... *A43B 7/18* (2013.01); *A41D 1/06* (2013.01); *A41D 13/02* (2013.01);
(Continued)

(58) Field of Classification Search
CPC .. A43B 7/18; A43B 5/002; A43B 5/06; A43B 5/10; A43B 7/147; A43B 7/20;
(Continued)

(56) References Cited

U.S. PATENT DOCUMENTS 1,236,714 A 8/1917 Hoppe
1,549,382 A 8/1925 Riddell
(Continued)

FOREIGN PATENT DOCUMENTS

GB 2 162 043 A 1/1986
JP S61-92602 A 5/1986
(Continued)

OTHER PUBLICATIONS

International Search Report and Written Opinion mailed Feb. 25, 2011 in connection with International Application No. PCT/US2010/039598.

*Primary Examiner* — Colin W Stuart
(74) *Attorney, Agent, or Firm* — Wolf, Greenfield & Sacks, P.C.

(57) ABSTRACT

Bodywear apparatus configured to be worn by a human user and attachable to footwear of the human user in order to augment the abilities of the lower limbs of the user is disclosed. In another aspect, footwear apparatus configured to be worn by a human user in order to augment the abilities of the lower limbs of the user is disclosed. Such bodywear apparatus and footwear apparatus are configured to reduce the effort a user must exert and improve the user's performance during walking, running, hiking, marching, and various other gaits as well as jumping, hopping, and other activities. In an aspect, bodywear apparatus further includes a supplemental power device configured to further augment the user's abilities by activating during portions of the user's gait cycle.

20 Claims, 25 Drawing Sheets

Related U.S. Application Data continuation-in-part of application No. 12/720,408, filed on Mar. 9, 2010, now Pat. No. 8,438,757.

(60) Provisional application No. 61/560,289, filed on Nov. 16, 2011.

(51) Int. Cl.

| | |
|---|---|
| ***A41D 13/02*** | (2006.01) |
| ***A41D 13/05*** | (2006.01) |
| ***A41D 13/06*** | (2006.01) |
| ***A43B 5/00*** | (2022.01) |
| ***A43B 5/06*** | (2022.01) |
| ***A43B 5/10*** | (2006.01) |
| ***A43B 7/1455*** | (2022.01) |
| ***A43B 7/20*** | (2006.01) |
| ***A43B 23/02*** | (2006.01) |
| ***A43B 23/08*** | (2006.01) |
| ***A43C 1/00*** | (2006.01) |

(52) U.S. Cl.

CPC ..... *A41D 13/0543* (2013.01); *A41D 13/065* (2013.01); *A43B 5/002* (2013.01); *A43B 5/06* (2013.01); *A43B 5/10* (2013.01); *A43B 7/147* (2013.01); *A43B 7/20* (2013.01); *A43B 23/0205* (2013.01); *A43B 23/0245* (2013.01); *A43B 23/028* (2013.01); *A43B 23/086* (2013.01); *A43B 23/087* (2013.01); *A43C 1/00* (2013.01)

(58) Field of Classification Search

CPC ..... A43B 23/0205; A43B 23/0245; A43B 23/028; A43B 23/086; A43B 23/087; A41D 1/06; A41D 13/02; A41D 13/0543; A41D 13/065; A43C 1/00; A61H 1/00; A61H 1/02; A61H 1/0237; A61H 1/0266; A61H 2205/12; A61H 2201/1253; A61H 2201/1261; A61H 2201/1269; A61H 2201/164; A61H 2201/1642; A61H 2201/1673

See application file for complete search history.

(56) References Cited

U.S. PATENT DOCUMENTS

| | | | | |
|---|---|---|---|---|
| 3,405,463 | A | 10/1968 | Werner | |
| 3,535,800 | A | 10/1970 | Stohr | |
| 3,686,778 | A | 8/1972 | Hornung | |
| 3,696,534 | A | 10/1972 | Hornung | |
| 3,728,804 | A | 4/1973 | Mochizuki | |
| 3,786,581 | A | 1/1974 | Mochizuki | |
| 4,006,543 | A * | 2/1977 | Post | A43B 5/0454 280/11.36 |
| 4,461,288 | A | 7/1984 | Curtis | |
| 5,090,138 | A | 2/1992 | Borden | |
| 5,125,171 | A | 6/1992 | Stewart | |
| 5,175,947 | A | 1/1993 | Parracho | |
| 5,177,884 | A | 1/1993 | Rullier | |
| 5,352,185 | A * | 10/1994 | Blauth | A61H 1/0266 482/79 |
| 5,431,624 | A | 7/1995 | Saxton et al. | |
| 5,446,976 | A | 9/1995 | Donnadieu et al. | |
| 5,475,935 | A | 12/1995 | Frost | |
| 5,621,985 | A | 4/1997 | Frost | |
| 5,647,150 | A | 7/1997 | Romanato et al. | |
| 5,678,330 | A | 10/1997 | Van | |
| 5,778,563 | A | 7/1998 | Ahlbaumer | |
| 5,909,885 | A | 6/1999 | Borel | |
| 5,924,706 | A | 7/1999 | Seltzer et al. | |
| 6,018,892 | A | 2/2000 | Acheson et al. | |
| 6,035,558 | A | 3/2000 | Okajima | |
| 6,082,026 | A | 7/2000 | Sand et al. | |
| 6,102,881 | A | 8/2000 | Quackenbush et al. | |
| 6,168,172 | B1 | 1/2001 | Meibock et al. | |
| 6,397,496 | B1 | 6/2002 | Seymour | |
| 6,792,700 | B2 | 9/2004 | Gallegos | |
| 7,013,586 | B1 | 3/2006 | Hatfield et al. | |
| 7,293,372 | B2 | 11/2007 | Nakano | |
| 7,509,756 | B2 | 3/2009 | Lebo | |
| 7,513,068 | B2 | 4/2009 | Fauver | |
| 7,913,426 | B2 | 3/2011 | Valat et al. | |
| 8,215,033 | B2 | 7/2012 | Carboy et al. | |
| 8,235,869 | B2 | 8/2012 | Rastegar et al. | |
| 8,438,757 | B2 | 5/2013 | Roser | |
| 8,869,435 | B2 | 10/2014 | Hatfield et al. | |
| 9,282,783 | B2 | 3/2016 | Roser | |
| 9,572,395 | B2 | 2/2017 | Roser | |
| 2003/0115775 | A1 | 6/2003 | Mazzarolo | |
| 2003/0204971 | A1 | 11/2003 | Fauver | |
| 2005/0108900 | A1 | 5/2005 | Knowles | |
| 2005/0217151 | A1 | 10/2005 | Valat et al. | |
| 2005/0229436 | A1 | 10/2005 | Bock | |
| 2006/0005430 | A1 | 1/2006 | Valat et al. | |
| 2006/0075663 | A1 | 4/2006 | Nakano | |
| 2006/0283048 | A1 | 12/2006 | Lebo | |
| 2007/0056189 | A1 | 3/2007 | Mathison | |
| 2007/0175069 | A1 | 8/2007 | Zanatta | |
| 2007/0271821 | A1 | 11/2007 | Meschter | |
| 2008/0156363 | A1 * | 7/2008 | Ikeuchi | A61H 3/008 135/65 |
| 2009/0000150 | A1 | 1/2009 | Wong | |
| 2009/0216167 | A1 | 8/2009 | Harris | |
| 2009/0272007 | A1 * | 11/2009 | Beers | A43C 11/00 36/50.1 |
| 2010/0192412 | A1 | 8/2010 | Stewart | |
| 2010/0263236 | A1 | 10/2010 | Carboy et al. | |
| 2010/0319215 | A1 | 12/2010 | Roser | |
| 2013/0263349 | A1 | 10/2013 | Roser | |

FOREIGN PATENT DOCUMENTS

| | | | |
|---|---|---|---|
| JP | H09-299104 | A | 11/1997 |
| JP | 2006-197977 | A | 8/2006 |
| WO | WO 2011/005559 | A3 | 1/2011 |

* cited by examiner

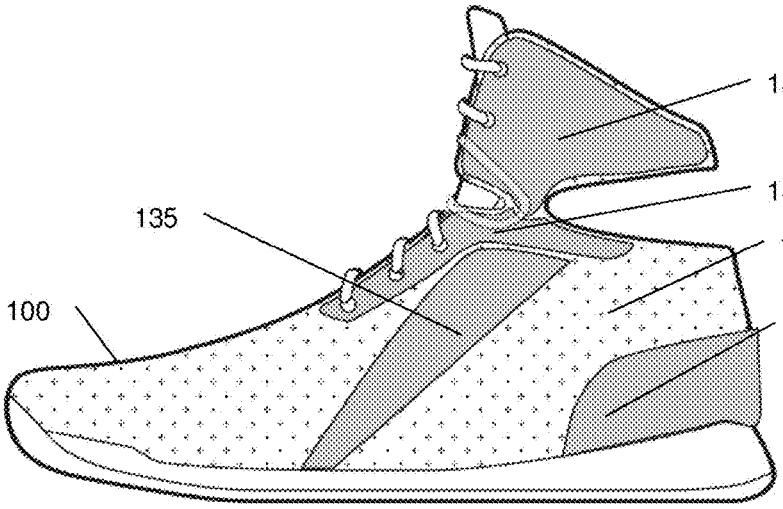
Fig. 6A
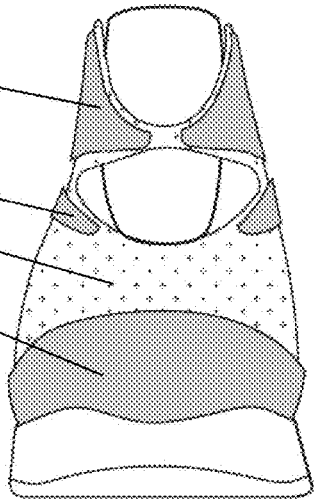
Fig. 6B
Fig. 6C
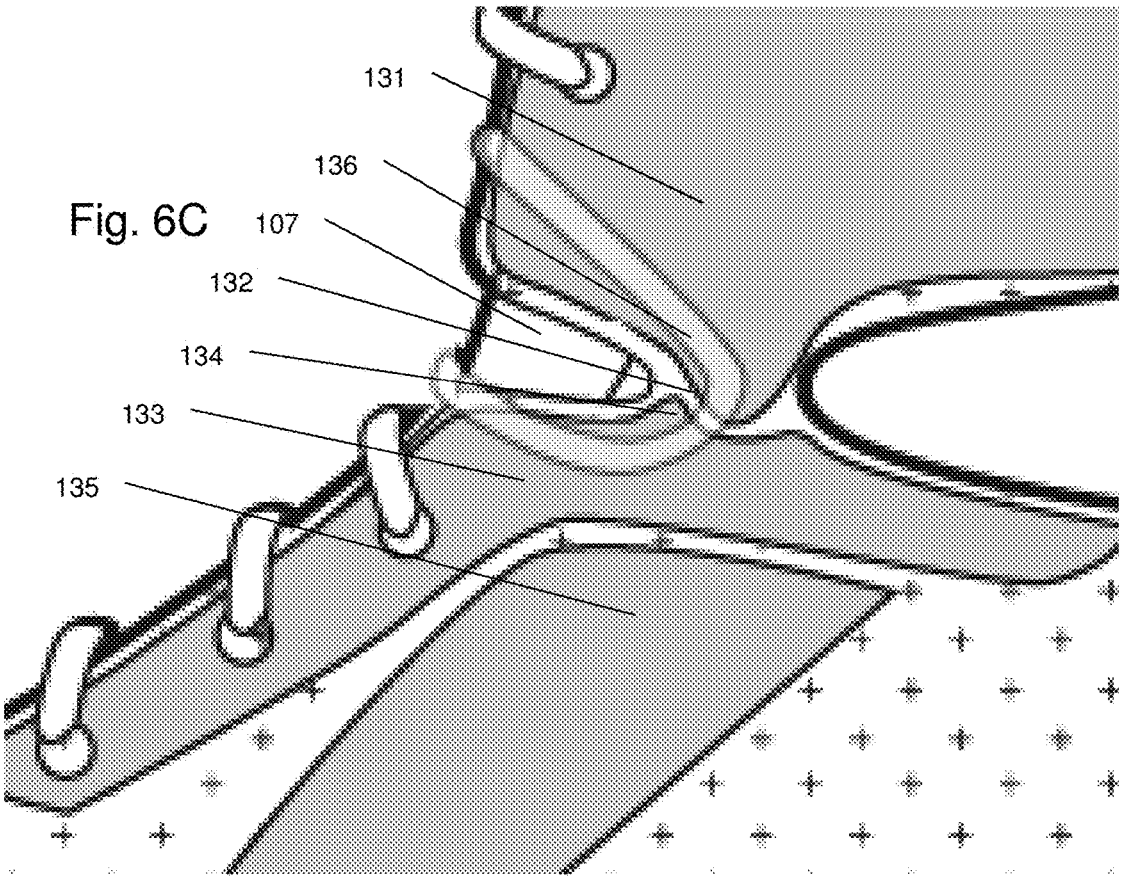

~250N Force exerted on pivot point at a forward dorsi-flexed state

Treadmill Testing
VO2 vs Time Data from Test B
*Dotted*= Novel Boot ; *Black=Std Boot*
X axis=VO2, Y axis=time
Note how Novel Boot VO2 decreases over time once springs are engaged.

HUMAN LOCOMOTION SHOE AND CLOTHING

CROSS-REFERENCE TO RELATED APPLICATIONS

This application is a Continuation of U.S. Non-provisional patent application Ser. No. 13/679,611, filed Nov. 16, 2012, which is a Continuation in Part of U.S. Non-provisional patent application Ser. No. 12/720,408, filed Mar. 9, 2010, and U.S. Non-provisional patent application Ser. No. 13/679,611 also claims the benefit of U.S. Provisional Patent Application No. 61/560,289, filed Nov. 16, 2011, the entire contents of each of which are incorporated herein by reference.

FIELD OF THE DISCLOSURE

The technical field relates to structural elements of several aspects of footwear and lower body performance wear, for example, a shoe, a sandal, a boot, a wearable body suit, a pair of trousers, an extended sock system, or a system of protective body gear and, in particular, to elements which may capture potential energy as an individual moves and may release the energy such that an individual's health, stamina and performance are improved and the safety of their joints is improved.

BACKGROUND

Human motion requires exertion of energy. Peoples' ability to conduct their activities can be limited by their available energy, more specifically metabolic energy. For example, hikers have a limit to the distance they can hike based upon their physiological constitution and condition. Runners have a limit to the speed they can run. Military troops have a limit to the distance they can march, for example, with a heavy pack load. Athletes have a limit of how long they can remain within a physiological envelope of control that allows them to maintain adequate resilience to injury. People often seek ways to extend their capabilities—to run faster, hike farther, jump higher, stay more resilient, etc. It would be desirable to extend people's capabilities and overcome some of their limitations.

It is known generally that a device can receive a force and store potential energy. Later, the device may be actuated to release the potential energy as kinetic energy. During dorsiflexion motion of the ankle system, a stored potential energy may be returned as force during plantar flexion motion. It is broadly known that the Achilles tendon acts in this way. With the assistance of such force and energy, a person is less dependent upon internal muscles, flexor tendons and tendons for locomotion and stability. The person can perform better, require less consumption of metabolic energy, produce less blood-born byproducts of muscular exertion, experience less fatigue and be able to maintain an envelope of control which provides sustained resilience to injury, recuperate from lower limb issues faster and receive other health and performance benefits.

Gait Cycle

Human locomotion is driven by three major energy sources—the foot system, the knee system and the hip system. Each of these systems is moved by a combination of muscle force as well as tendon force. In a typical walking gait, roughly 40 to 45% of energy is provided by the foot system, which surpasses the individual contributions of both the knee and hip systems. As stride length or gait speed increases the relative contribution of the foot system decreases in relation to the knee and hip system.

During a gait cycle, as the term is used herein, the Achilles tendon stretches during dorsiflexion motion and releases during plantar flexion motion. The efficiency of the Achilles tendon is quite high, with laboratory measures showing a potential for a greater than 90% energy return. The Achilles is defined herein as an elastomeric element that is capable of stretching up to 8% of total length under load before plastic deformation.

The use of powered exo-skeletons has been demonstrated in the laboratory; (reference may be made to articles cited in the attached bibliography, incorporated by reference herein as to any material deemed essential to an understanding of the principles of energy management, injury reduction or injury rehabilitation disclosed herein). The use of powered exoskeletons for the ankles has been tested on a treadmill and shown to potentially enable improved performance. These studies also show that managing the timing of the release of energy from these powered systems requires learning on the part of the wearer. Proper control of muscular exertion by the wearer to achieve harmonization of the device with the gait cycle is a necessity for a person to gain significant benefit.

Because of these tests, supplementing the foot system with support and added energy capability through an external system can be hypothesized as meaningful and significant. A supplemental system can help athletes perform better. Such a system can help boost walking endurance; it can help people with ankle and Achilles tendon injuries recuperate faster and help avoid future problems. Also, it can help people walk more easily and with less fatigue, which may be of significant value in places where people walk long distances to work, to gather food or water, etc. Such a system should also be timed correctly to harmonize with the proper need for energy.

Plane of Reference

Performance benefits that may be achievable using a system as described herein include improved speed, improved endurance, increased jump height, increased backpack loading, decrease in oxygen consumption, etc. A focus of such a system may be on the rotation of the ankle joint in the sagittal plane as a main source of force and energy.

Benefits may also be achieved by using a system as described herein in the frontal plane. In shoe structural design, the frontal plane may be utilized to maintain or extend a shoe's protective capabilities in the ankle and limit range of untoward motion in the ankle that may otherwise lead to soft tissue injury, joint injury or other injuries. The system as described herein has shown unexpected benefits during clinical testing in managing foot-fall, reducing shuffling of feet and improved directional consistency in how toes are pointed, which may all be considered novel benefits measured during frontal plane analysis. The system as described also constrains the degrees of freedom for ankle motion, which further provides protective qualities toward injury reduction or rehabilitation.

Systems and preferred aspects disclosed herein integrate with items that are commonly worn on the body. This comprises footwear, which may refer to any variety of shoes, boots, sneakers, sandals or other article of wear that is worn upon the foot, and body wear, which may refer to any variety of pants, sporting uniforms, military uniforms, sock, hosiery, ankle guard, shin guards, combat protective leg wear, orthosis or other item which is donned upon at least upon the lower limbs.

Typical Biomechanics of the Human Ankle

A typical human ankle range of motion is commonly discussed in biomechanics literature with variations according to each authors' clinical experience; the following overview of the normal gait cycle is a simplified recounting of common literature.

The gait cycle may begin with the first touch of the foot to the ground. This first touch begins the cycle at 0% and the moment immediately prior to the following touch to the ground of the same limb may represent 100% of a cycle. In the normal walking gait, the ankle may experience a small amount of extension after initial contact leading to plantar flexion during the first 10-15 or so percent of the cycle, commonly referred to as a loading response. This is then followed by increasing amounts of dorsiflexion motion, which further increases after mid-stance. Maximum dorsiflexion is typically achieved after heel lift and prior to the initial contact of the opposite foot. This is followed by rapid plantar flexion motion associated with push off, which occurs after the opposite foot makes its initial contact. In the push-off phase, the ankle rapidly plantar flexes through toe off. This is followed by a swing phase with the foot traveling in the air. During the swing phase, the foot dorsiflexes to a neutral position preparing it for the next cycle.

For simplicity in writing of this disclosure, we will refer to ankle system motion during the periods of increasing flexion after initial contract and loading response, through mid-stance, through heel lift, to peak dorsiflexion as "dorsiflexion"; and we will refer to ankle system motion during the periods of increasing extension found during opposite foot contact through toe off as "plantar flexion".

The total range of motion in the ankle during a walking gait is the result of a combination of dorsiflexion angle and plantar flexion angle. After midstance, there is increasing dorsiflexion to a peak of 5 to 15 degrees as measured according to well known technical arts. During push off, the ankle rapidly plantar flexes to a peak of −5 to −20 degrees. Typical total range of motion during the normal walking gait is often shown as 20 to 40 degrees in common literature and internet resources.

Analyzing the running gait where a walking gait has been discussed above, we see similar elements of the cycle; however, efficient runners may not land on their heels in order to prevent unnecessary losses in energy. Rather, initial contact may be on the front part of the foot while the ankle is in slight dorsiflexion. The amount of dorsiflexion increases after midstance to a peak of 20 to 50 degrees. This is followed by rapid and powerful push off during which the ankle plantar flexes to a peak of −10 to 30 degrees. This results in a total range of motion of 40 to 70 degrees. Jogging gaits may range between the walk and run depending upon the person jogging, their abilities, the conditions, their level of exertion, etc. Sprinting gaits often show a decrease in range of motion when the athlete is near the top of their speed range.

Benefits of External Assistance During Dorsiflexion

When an ankle is in dorsiflexion phase, with a joint angle greater than zero, some amount of force needs to be applied to keep the ankle joint angle from rapidly increasing which would lead to the joint collapsing under the weight of the body. This is sometimes referred to as negative work. The removal or full rupture of the Achilles tendon and removal of other supportive ankle muscles & tendons, for example, during this phase would result in joint instability and the inability for a person to bear their body weight upon that foot. Any amount of dorsiflexion results in a necessary force being exerted in the ankle region to prevent joint collapse. A reduction in the force necessary to support the body during dorsiflexion phase, therefore, can be perceived as a potential opportunity to save energy or boost performance. Negative work consumes metabolic energy, and the reduction of negative work can reduce metabolic energy consumption. The reduction in metabolic consumption based upon the externalization of forces is asserted to increase as the vertical travel of the body's center of mass increases and speed of gait increase.

Prior Art

Several individuals have attempted to use differential forces above and below the ankle joint in the past to produce devices that would be helpful to people. For example, Borden, U.S. Pat. No. 5,090,138, discloses a spring shoe device with a heel socket, shin brace, ankle hinge and spring strap. Stewart, U.S. Pat. No. 5,125,171, discloses a shoe with a spring biased upper. Frost, U.S. Pat. No. 5,621,985, discloses a jumping assist system with multiple components. A rather elaborate design is disclosed by Seymour, U.S. Pat. No. 6,397,496, for an article of footwear which employed multiple springs to assist motion of a boot in the upward direction.

A distinct limitation of the current art is that the elements do not appear to be successfully integrated into the upper or collar of a shoe such that human locomotion is improved, for example, with both an improvement in a rotation zone and an elastic zone. Furthermore, cuffs designed for going over the lower leg to the extent present in the art are not integrated into the aesthetics of common footwear.

The known technical art fails to simplify structural elements of a device above the ankle to receive force and transmit the force to a spring. Exemplary art may show a device which depends upon non-trivial collars that wrap the leg above the ankle, the bulk of which contributes to their inability to be effectively integrated into traditional footwear. Similarly, anchors below the ankle, to the extent depicted in the known technical art, are often shown as appendages and extraneous devices which may interfere with preferred shoe design techniques. Such devices may be especially obtrusive to military forces who may be encumbered by such systems that are not fully integrated into their uniform or personal gear.

The use of ankle and knee braces is well known in the art. By including hinged joints in service of kinetic energy management, one can also help provide joint stability similar to a hinged brace. As such, a system that provided hinged joints for the ankle joint and knee joint may be designed to both improve performance as well as reduce injuries. Such injury-protective devices are not amenable to wearing on a daily basis because of potential for discomfort, perspiration issues, poor aesthetics, lack of ability to regulate the amount of joint stabilization, and other reasons.

In view of the prior art, there is a need to minimize the complexity, cost, weight, and materials used to enable an article of footwear and body wear to harvest energy from the lower leg and improve injury protective qualities.

SUMMARY

The aspects of footwear and body wear described herein improve upon the known art of footwear and body wear design in many respects; in light of footwear, this includes management of forces from the lower leg into a shoe using familiar shoe design approaches, tooling, materials and manufacturing approaches, and in light of body wear, this includes management of forces from the ankle foot complex into items of body wear worn by users. An intention of several aspects and structural elements thereof disclosed herein is to create footwear with performance improvements integrated into the design, aesthetics, material selection and construction so that they can be successfully commercialized. Yet another intention of several aspects and structural elements thereof disclosed herein is to create body wear comprising integrated structural elements that share the management of forces with novel footwear described herein. Examples of prior art have relied upon appendages, additions and changes to footwear construction and material selection that have not reached commercial viability.

Several aspects of the present disclosure integrate their novel improvements in a way that enables footwear to avoid being perceived as a contraption. Such aspects provide aesthetic shoe designers with a design palate that enables them to offer a wide range of ornamentally inspiring designs.

Several aspects integrate into uniforms, pants, shin guards, ankle guards and other personal protective gear in such a way as to minimize disruption to the wearer while facilitating desired performance goals. In one aspect, a scalable solution starts with a foundation supportive performance article of footwear such as a boot, then extends up the shin, then extends up past the knee and then up to the hip.

In some aspects, force above the ankle is exerted predominantly by the pressure of the front surface of the lower leg upon a receiving device such as a tongue of a high top collar of a shoe or boot, a shin guard, a rigid device in a pair of undergarments, a semi-rigid yoke within a pair of pants, or other force receiving and force transferring mechanism. To achieve an upward stretch of a tension spring in proximity to the Achilles, one may use some type of mechanism to change direction of the force from near-horizontal to near-vertical. Prior art examples typically relied upon cuffing of the lower leg, which can lead to discomfort, unnecessary size, unnecessary weight, and unnecessary banding forces around the perimeter which may unduly constrict motion of tendons, ligaments, blood flow, and the Achilles tendon itself. Collar mechanisms frequently put unnecessary force upon the rear of the leg, which has no capability of delivering primary forces described herein. The aspects herein demonstrate a variety of ways in which forces may be managed without undue cuffing forces, such as those impacting the rear of the lower leg.

Bilateral Components in Depicted Footwear

It is assumed in the descriptions of aspects and by the depictions thereof in the drawings showing but one side view herein that the user of skill in the art will be aware that many of the components mentioned are bilateral in nature, with both medial and lateral instances. As an example, there are typically two eyestays in each shoe, a medial eyestay and lateral eyestay. By assuming this knowledge, plural terms are not used herein and so eliminate the need for specifying medial and lateral instances of bilateral components.

To be clear, it is known in the art that bilateral components may not be mirror images or exact copies of each other. For example, the ankle joint is not horizontal to the ground, and the medial side is higher than the lateral side. Those skilled in the art will be able to still gain clear understanding of these teachings by limiting descriptive language to the singular.

Using Stretch of a Passive Energy Storage Device to Manage Energy

In powered external foot/ankle exoskeletons, motive force may be provided by pneumatic cylinders. In shoe aspects described herein, a passive energy storage device is used to manage forces and energy external to the body. A passive device structural element of the several aspects of a shoe as described herein may include a spring, elastic member, elastomeric component or other such device known in the art, particularly located according to the figures.

Thus, the several aspects involve the storage and management of energy under tension. Tensile energy may be stored and released in any variety of commonly used formats, such as an elastic cord or multiple cords, coil spring, an elastic band, a bungee cord, a an elastomeric material, a woven cord, etc. Energy may also be stored in a planar or sheet surface. Sheet materials such as latex sheets, flat latex bands, rubber sheets, rubber tubes, woven fabrics, non-woven fabrics, etc can all apply force, store energy and release energy when tension is applied to them. Tensile energy may also be stored and released in custom-shaped or molded elastomeric objects such as a set of cords overmolded into a common element, or molded elastic elements that contour to the outside of a shoe or the rear of a foot, ankle and leg. Molding of rubber, thermoplastic rubber or urethane, silicones, and other elastomerics are common in footwear and can be applied herein.

A wide variety of shapes, a small number of examples which are described above, will henceforth be noted as tension springs. Reference to tension springs therefore will broadly address a variety of materials and shapes that can act in tension. Knowing that almost all elastic elements lose part of their energy to friction, to be conservative, the term elastomeric is used in this application in recognition that materials such as rubber bands, latex cords, coil springs, and various other "elastic" elements do not return 100% of the energy imparted into them and because of unavoidable friction and parasitic losses therefore are labeled under an umbrella term of elastomeric in this document.

Benefits of Tension Spring Energy Management During Dorsiflexion and Plantar Flexion During the walking gait cycle, the peak demand for ankle energy occurs after midstance as the ankle is in the process of increasing dorsiflexion and then rapidly plantar flexing. The transition of decelerating dorsiflexion motion to accelerating plantar flexion motion requires the contribution of the Achilles tendon and the soleus and gastrocnemius muscles as well as a variety of other muscles and connective tissues including tendons. The Achilles tendon can stretch up to 8% before plastic deformation.

While the Achilles tendon is a very efficient member, capable of returning more than 90% of energy stored within, associated muscle is not as efficient. Use of the muscle in the gait cycle is consumptive of energy. Literature shows that during the period of dorsiflexion, the ankle system consumes approximately 0.2 to 0.5 W/kg of power, while during the time of transition from dorsiflexion to plantar flexion the ankle system consumes roughly 2 to 4 W/kg of power.

By anchoring a tension spring external to the body to capture range of vertical motion or diagonal motion, as described below, one can impose a force during dorsiflexion which harvests energy for each degree of ankle rotation in the dorsiflexion direction. This externalizes force outside of the body and stores energy as potential energy.

By externalizing force and energy during dorsiflexion, several things are accomplished: reducing the amount of muscle force and energy required to manage dorsiflexion (and prevent the collapse of the joint often referred to as negative work) thereby reducing the power requirement, typically shown as 0.2 to 0.5 W/kg; reducing the total energy needed to be managed and stored by the tendons; and either reducing metabolic oxygen consumption assuming a steady gait or providing an opportunity for a more aggressive gait without additional metabolic oxygen demand. Similarly, the energy stored in the tension spring may be returned to assist in plantar flexion motion by applying force across a distance.

By converting the externalized potential energy into force that is internalized into the foot or delivered into the sole area of footwear, several things are accomplished: reducing the amount of muscle force and energy required to manage plantar flexion (and provide forward gait propulsion) thereby reducing the power requirement, typically shown as 2 to 4 W/kg; reducing the total energy needed to be managed and stored by the tendons; either reducing oxygen consumption assuming a steady gait or providing an opportunity for a more aggressive gait without additional oxygen demand; and assisting in a variety of other ankle mediated tasks, such as jumping, hopping, leaping, etc.

By routing significant force outside of the body, from the shin face and heel lift pressure points on the body, much force can be driven through the body of the shoe inclusive of endoskeletal structures and directly into the sole and therefore the ground. This externalization of force alleviates significant force from traveling through the long arches of the foot and thereby reducing stress and strain associated with plantar fasciitis, and Achilles tendonitis, and other stress related foot conditions. Integration of the present system within footwear can also confer the prophylactic and recuperative benefits of a hinged ankle brace, while avoiding many limitations of hinged ankle braces, which include discomfort from pressure, heat, moisture, friction, impingement as well as crowding of the feet within the shoe. Integration of endoskeletal features within footwear enables the structure to be placed behind the sock liner and padding, to improve comfort, heat management, moisture management, and friction management, while staying true to the user's shoe size.

Simplified View of a Shoe System Involving Structural Elements of the Several Shoe Aspects The structural elements of the several preferred aspects disclosed herein exploit differentials between the foot system below the ankle and the leg system above the ankle. In order to perform mechanical work, a force is applied over a distance. Therefore, in order for the systems to work, we identify means for anchoring force-carrying devices so that force can be applied, and we identify means to harvest this force over a range of motion distance.

Simplified View Regarding Leg Force Below the Ankle

Forces are managed in the several depicted aspects by establishing anchors integrally within footwear or integrally within bodywear, for example, below the ankle and above the ankle of the wearer of depicted footwear.

Anchoring forces below the ankle may be accomplished with the aid of an article of footwear. Because the foot is wrapped on many surfaces by an article of footwear, force can be transferred effectively and distributed broadly to ensure comfort.

Force carrying members, anchors and supplemental means of support of the several aspects may be integrated such that a shoe manufacturer or maker may maintain geometrical stability in the footwear and anchor, comfort to the user, adequate aesthetic appeal to the buyer, cost that is appropriate for the application, longevity commensurate with the application, lightness of weight, safety, among various other concerns necessary for a commercially viable product.

Simplified View Regarding Leg Force Below the Ankle

In one aspect, forces are anchored in and out of the lower leg above the ankle. In another aspect the fore and aft forces are applied to the front face of the lower leg which may create a force to assist plantar flexion motion of the foot and conserve energy during dorsiflexion motion of the foot.

In addition to the fore and aft force applied to the lower leg, there are also other forces that act upon a lower leg device. In the several aspects, a rotational force may be directed into lifting the heel of the user and driving plantar flexion. As such, there is an equal and opposite downward force on the lower leg which is managed.

As this is a dynamic system which is also influenced by the accelerations based upon the knee and hip systems as well as environmental factors and the influence of human activity, various other forces will exhibit themselves throughout any given activity.

To integrate an adequate lower leg anchoring system within an article of footwear, the several aspects and aspects thereof disclosed herein may use two approaches, both independently and in combination, within articles of footwear. Several terms need to be defined for clarification of the several aspects.

Yoke—a yoke is defined for this application as a device which relies upon managing forces on three active sides through a "U" shaped configuration. Herein, the base of the "U" is positioned against the front face of the lower leg and is able to receive fore and aft forces. The lateral and medial sides of the "U" are positioned near horizontally above the malleolus ankle bulge and able to manage up and down forces through skin friction as well as interference with bony malleolus ankle bulge, as well as through integration with a pivot system in proximity to rotation axis of the ankle. There may be a 4th side of a yoke device that connects the open legs of the "U", however, this side is often not responsible for carrying primary forces.

Collar—a collar is a band that constricts the outer diameter of an object it encircles. It can apply a vertical force on the leg through a combination of skin friction resistance as well as a mechanical force when the inner diameter of the collar is smaller than the outer diameter of the bony protuberances of the ankle it encircles.

Collar yoke—a combination of the U-shaped yoke together with a circumferential band or collar, the design of which can distribute primary forces, secondary forces and disparate other forces to specific areas of the device, as well as manage rotational and pivot forces. Such a configuration may provide an anchor point that allows for attachment of a spring element, and can transfer force into the lower leg—either in purely orthogonal force into the shin with no downward pressure on the ankle, or some combination of orthogonal shin face force together with some degree of ankle force.

Simplified View Regarding Range of Motion

To manage force and energy, novel concepts herein integrate elements into footwear and body wear to establish anchor points and mechanisms which stretch a tension element during a transition from plantar flexion to dorsiflexion as well as manage rotational and pivot forces.

There are two areas of expansion that the several aspects may exploit (independently and in combination): 1) a range of motion vertically, roughly parallel to the Achilles, which is managed through employing a rotatable collar yoke that has a hinge point in proximity of the ankle joint and translates near-horizontal pressure force from lower front of the leg over a fulcrum and into a near-vertical force on a tension spring at the lower rear of the leg; and 2) a range of motion diagonally from shin to heel, which is carried by a collar lobe, yoke or collar yoke that can rotate and or move linearly forward and backward thereby transferring near-horizontal pressure force from the lower front of the leg to a near-diagonal force on a tension spring which is attached on its opposite side to an area that is above the top rear of a heel counter of a shoe.

Simplified View of Exploiting Range of Motion Vertically

To measure vertical expansion and contraction, one can place ink marks on the lower limb along the Achilles tendon. During the range of motion found in dorsiflexion and plantar flexion in a gait cycle, the distance between these reference points will vary by several centimeters. This change in distance is mediated by the combination of changes in length of several bodily members, including the Achilles tendon, the calf muscles including the soleus and gastrocnemius muscles.

This change in length of these major members is distributed over their combined working length, which in an adult can be over 35 cm in total length. External to the body, however, this change in distance between our two illustrative ink marker points on skin is not evenly distributed across this combined length. Inspection of the skin in the region of the Achilles tendon shows that the majority of stretching and compression of the skin surface is associated with a small region.

The region of the posterior face of skin over the Achilles tendon that is posterior to the ankle shows a high degree of skin stretch and compression. This region can be approximated in an adult as starting at 5 cm in height above the floor at an upright standing position and continuing up to 10 cm in height above the floor. The skin in this region is often wrinkled, showing the history of significant stretching and compression over years of use. We will henceforth refer to this area as the "creased skin region".

The creased skin region can be roughly described as a triangular or wedge shape. The axis of ankle rotation defines the anterior point of the wedge. Two imaginary lines emanate from the axis of ankle rotation to the anterior upper and lower limits of significant skin stretch and compression. By way of example, the upper line may be roughly 5 cm in length and the lower line may be 6 cm in length. The imaginary near vertical 5 cm line between these two points define the hypotenuse of the triangle. Skin will stretch and compress outside of this region, but the majority of skin stretch and compression is observed in this region.

To illustrate the potential for range of motion across the creased skin region, one can imagine that this region may be measured at 5 cm in length as measured along a vertical axis when standing upright and still. During dorsiflexion, this length may stretch to 7 cm or more in length. During plantar flexion, this length may compress to 3 cm in length or less. This results in a range of linear expansion/contraction total of 4 cm or more.

Enabling Vertical Range of Motion

Unfortunately, there is no convenient physical bodily feature upon which to directly anchor a force carrying object to the rear face of the lower leg above the creased skin region. A feature of the aspects herein is to enable such functionality in footwear.

One approach is to cuff the lower leg, such that the cuff stays stable on the lower leg and provides a means for anchoring a mechanical attachment at the back of the cuff.

Various collar mechanisms were experimentally fitted around the lower leg to determine the ability for using cuffs that impinged upon the protrusions of the ankle (lateral & medial malleolus) as a way to keep the cuff stable and manage downward force. Examples of this type of cuff are seen in gymnastics grips which use the bulge of the wrist bones as a means for anchoring hand grips. Gymnastic grips can manage over a thousand Newton, leading to a hypothesis that a similar collar around the lower leg could manage similar forces.

It has been experimentally determined that a tight collar around the ankle could easily support a large amount of force, but that the application would also be influenced by the duration of use and the amount of discomfort accepted by the user. The higher the force, the higher the discomfort. Cuffs that are unusually large may distribute forces more broadly, but may not enable required footwear performance or be aesthetically acceptable. There is also an issue of interference with the rear tendons of the lower leg. The nature of a collar is to constrict an object within its diameter. If an object that is being encircled by a collar has a protuberance, it will receive a greater amount of the collaring force. As such, collars placed immediately above the malleolus tend to place a significant amount of force on the Achilles region, leading to discomfort, abrasion and pressure points. This is worsened by the ongoing cycle of stretching and relaxation of the Achilles which can allow the collar to seat itself each time the tendon is relaxed and then constrict when the tendon is in tension.

Gymnastic routines upon rings or bars last only a matter of one or two minutes, enabling the athlete to tolerate discomfort in exchange for the benefit offered from improved performance. Similarly, specialty footwear applications in which users can accept discomfort for a brief time may allow the disclosed aspects to apply significant collaring forces above the malleolus. However, for the majority of applications, users will desire a solution which is comfortable over the duration of the time the footwear is worn using a sufficiently small collar arrangement to properly integrate with their footwear. As such, the amount of downward force that can practically be managed by collaring above the malleolus should be limited.

Since there is a practical limit of the amount of force that can be managed through collaring forces above the malleolus ankle bulge, there is an unmet need to supplement or replace collar based force management. Other mechanisms have been considered in the past that employ garters around the upper calf, knee area and even the hip area. As these have never been successfully commercialized, these are considered impractical. Other mechanisms have been considered which employ a very large cuff around the ankle as common with orthopedic braces. These too have never been adopted into the footwear market and are considered impractical.

An approach to exploit vertical range of motion taught herein is to integrate into footwear an articulating member which enables forward motion of the lower leg into a yoke-based device that is then transferred over a fulcrum to enable a vertical force and motion upon a spring.

A yoke or collar yoke arrangement is described in several aspects which enables management of primary forward leg force from contact with the lower leg, pivot force from contact with a fulcrum point in proximity to the ankle joint, and downward force from contact with a spring element. Additionally, features are discussed which enable the system to have sufficient stability against secondary forces to maintain viability within the application and within aesthetic and other design limitations.

In particular, an open yoke sandal aspect demonstrates that force carrying efficacy within footwear can be accomplished without unnecessary cuffing or collar forces. This enables function of the system without unnecessary pressure on the skin in the Achilles region. The integration of a yoke into a collar to produce a collar yoke is another novel concept. In this manner, primary forces from the lower leg can be managed through the yoke functionality within a collar. This enables management of significant primary force and ensuing torsional forces over the pivot without at a high degree of banding force of the collar. As such, significant force can be managed at the front of the lower leg without unnecessary pressure upon the Achilles tendon area at the rear surface of the lower leg. The benefits of a banded high collar for aesthetics, management of untoward varus and valgus motion in the ankle, management of environmental forces and other protective benefits may be maintained. The length of the side walls of the yoke members may also be slightly elongated to the rear, thereby creating an eccentric (i.e.: oval) shape to the collar, which can reduce the banding upon the rear of the lower leg.

Simplified View of Exploiting Range of Motion Diagonally

As described below, a region superior to the ankle joint that extends diagonally from the front face of the lower left to the top of the heel can experience a change in diagonal length of 2.5 cm or more during a gait cycle. By applying an external tension spring in this region, we can store and return significant energy.

To measure diagonal expansion and contraction, one can place ink marks on the lower limb along the base of the shin as well as the bottom of the creased skin region along the Achilles tendon. During the range of motion found in dorsiflexion and plantar flexion in a gait cycle, the distance between these reference points will vary by several centimeters.

This change in distance is relative to the elevation of the front anchor point. If the superior anchor point is placed at the base of the shin all the way down to an elevation level with the horizontal plane of the ankle joint, there is only minimal change in distance between it and the inferior anchor near the heel.

As the superior anchor point is elevated along the base of the shin, the change in distance between dorsiflexion and plantar flexion can reach over 2 cm. Common high top basketball shoes reach up 16 to 18 cm off the floor. Assuming that the horizontal plane of the midpoint of the ankle joint (which is not level to the ground) is roughly 11 cm off the ground, one can visualize that the top of the front of a common high top collar or tongue reaches 5 to 7 cm above the ankle joint elevation.

Thus, by establishing a superior anchor point near the top of the front of a high top collar and the inferior anchor point above the heel counter of a shoe, that there is an opportunity to observe a 2 cm or more change in distance across dorsiflexion and plantar flexion.

Spring Design and Geometry

As mentioned above, springs of a variety of materials and shapes may be utilized in the several aspects. Springs may also be designed in parallel with other materials, such as straps or stiffer springs, which can limit range of motion. In doing so the spring may stretch out to a certain extent and then be limited by the other material. This may help prevent untoward motion.

The geometry of the device within a shoe will also determine the starting point at which the force may be exerted. This geometry will establish the range of motion in which the spring is not yet active and the range of motion in which the spring or springs are active. For example a geometry can be constructed to be helpful to people who do not wish their shoes to induce plantar flexion angle beyond neutral—for example people with limited ankle strength. Spring force would increase linearly in dorsiflexion from 0 to 30°, but there would be no spring force in plantar flexion at less than 0°. For example, a walking shoe may benefit from having spring force linearly increase starting at −5° and ranging to 25 or 30°.

Or, for example, a person engaging in an athletic sport may wish to have spring force start at minus 20° and increased linearly through positive 40°. This would tend to position the foot in a plantar flexion position during the swing phase and help the athlete maximize the amount of energy storage at each step. The spring force could also be designed non-linearly so that there is a light spring force from minus 20° to 0°, and then an increased spring force from 0 to 40°.

Varying Spring Force with Activity

In many applications, footwear is worn for a specific occasion, such as an athletic activity, then removed when the specific activity is completed. This allows for the spring rate of the footwear to be designed to be appropriate for the desired activity. For example, a football or soccer player may wish to have a relatively high spring rate to assist during the game, and remove the shoes at the end of the game. Many disciplines, however, require that a person wear their footwear for an extended period of time. In this event, spring rate should be controllable so that in times of low activity, the spring rate may be reduced and in times of elevated activity the spring rate may be increased. User controllable manual increases in spring rate are addressed elsewhere in this document. However, there is also a need for autonomous control of spring rate that does not require user input.

As only one example, in military disciplines, many troops such as infantry and Special Forces may benefit from a system that can determine the level of activity and automatically adjust the spring rate and pre-tensioning of the elastic member of their boot.

In such a system, a feedback mechanism would enable a prediction of the user's activity level. Such feedback mechanisms could be implemented in a variety of ways, for example, bio-feedback that measures heart rate, perspiration, ankle rotation, strain forces within tension elements of the systems discussed herein, rotation of any articulated components of footwear, etc. They may also be measured by a variety of other means, including accelerometer, strain gage, GPS position sensors, accumulated pressure in a bladder, accumulated strain in a ratchet, etc. This feedback would then either be a prime mover or a signal that would enable the appropriate control of spring rate.

For example, a strain gage connected to appropriate microprocessor would be able to detect increased amplitude or frequency of gait dynamics and/or kinematics that could be considered a surrogate measure for an increase in physical activity. A servo controller such as a step motor could then be engaged to wind a winch that adjusts the pre-load tension of an elastic member. In one aspect, such a system would increase the pre-load tension of a spring member such that at rest there was nominally 0 to 10 newtons per cm while at full sprint there was nominally 50 to 150 newtons per cm spring rate in the elastic member.

Varying Spring Force with Shoe Size

The several aspects disclosed herein may be of benefit to people of all shoe sizes. While there is no direct correlation between shoe size and body weight of any given individual, one can make a generalization across the population that body weight increases with shoe size. Therefore, the larger the shoe, the higher the spring rate designed into the system.

Increase in body weight will benefit from an increase in spring rate. A linear progression will enable this adjustment, for example Spring Rate=Design Factor×Shoe Length. For example, a Design factor of 1.2 N/cm2 for a 16 cm Foot Length will yield a 19.2 N/cm Spring Rate for a shoe size that is roughly 8.5 in US sizing; while the same Design Factor of 1.2 N/cm2 for a 20 cm Foot Length will yield a 24 N/cm Spring Rate for a shoe size that is roughly 13 in US sizing. Design factors will be different for adult ranges of sizes versus youth ranges of sizes.

Comfort is limited by undue pressure. Correlating spring rate linearly to foot size can help ensure that pressure is also managed properly. Pressure upon the front face of the lower leg is calculated as a function of the surface area of the yoke face upon the lower leg, which nominally equals lower leg width times yoke breadth. Assuming that lower leg width is nominally associated as a linear function of foot size across a population, and that the breadth of the yoke will increase linearly with foot size, then the available surface area will increase geometrically with foot size. This increase in yoke surface area will accommodate a linear correlation of spring rate to foot size, assuming that the Design Factor is maintained nominally between 1 and 2.

Timing

Studies using powered ankle exoskeletons showed that the timing by which power was delivered from the exoskeleton into the ankle system was a significant variable in determining the performance of the wearer. Improper timing led to poor performance and proper timing required conscious effort by the user.

Similarly, in many heel based energy management systems, energy can be absorbed upon initial contact of the heel to the ground, but the timing of the return of energy can impact resulting performance. The return of energy out of a heel-based spring/cushion system is often delivered too quickly to be of significant performance benefit to the user.

A feature of the aspects disclosed herein is in their ability to harmonize energy capture and energy return with the wearer's gait cycle. Proof of principle experiments with rough prototypes showed an improvement in performance which exceeded initial estimates. One hypothesis for this unanticipated benefit is that the systems herein have functionality which is similar in behavior to internal tendons, and so can complement their activity synchronously throughout all of dorsiflexion and plantar flexion.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

FIGS. 6A-C are views of footwear depicting additional elements footwear may be comprised of, according to an aspect of the present disclosure.

DETAILED DESCRIPTION

First Aspect

Rotatable Yoke with Vertical Tension Spring

Figure 1A:
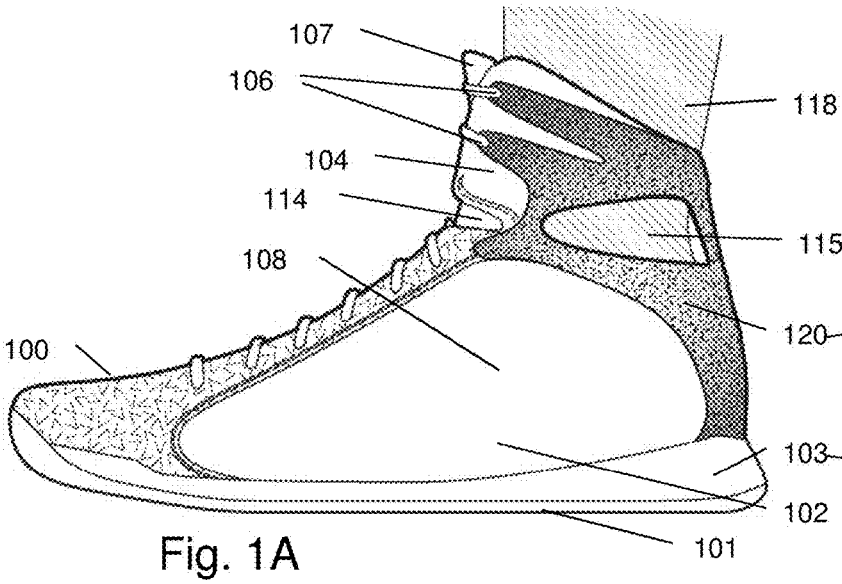
FIGS. 1A and 1B are views of footwear of a first aspect showing structural elements including a rotatable collar yoke and an anterior and posterior gusset forming a channel and an elastomeric overlay for storing and providing energy during locomotion use, in accordance with an aspect of the present disclosure.
Figure 1B:
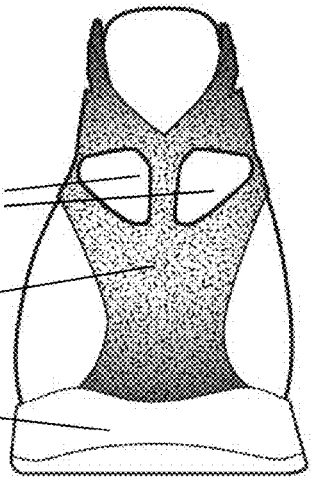

Table of Reference Numerals:

First aspect of the shoe 100
Outsole 101
Midsole 102
Heel cushion area of the midsole 103
Rotatable collar yoke 104
Laces 105
Yoke eyelets 106
Tongue 107
Upper 108
Eyestay 109
Counter panel 110
Eyestay stitching 111
Counter panel stitching 112
"X" shaped stitching overlap 113
Anterior gusset 114
Posterior gusset 115
Narrow channel of upper 116
Interface between midsole and upper 117
Leg 118
Stitching in the rotatable collar yoke 119
Elastomeric overlay 120
Elastic zone 121
Rotation zone 122
Collar yoke adhesion zone 123
Superior rotation anchor zone 124
Inferior rotation anchor zone 125
Superior elastic anchor zone 126
Inferior elastic anchor zone 127
Zones of reduced bonding agents 128
Heel counter 130
Collar yoke stiffener 131
Collar yoke stiffener rotation interface 132
Eyestay and collar stiffener 133
Eyestay and collar stiffener rotation interface 134
Upper stiffener 135
Lace routing 136
Sock liner and padding system 137
Tension bearing stitching 138
Collar yoke cantilever stiffener 139
Variation of eyestay and collar stiffener 140
Full sidewall heel counter support 141
Yoke support with cantilevers 142
Overlapping U stitching 143

Figure 2A:
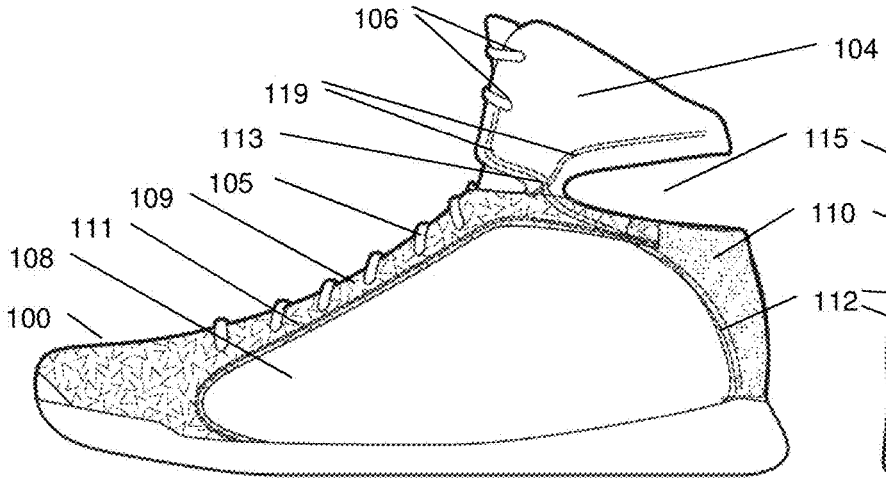
FIGS. 2A and 2B are views of footwear depicting the structural elements of footwear wherein the elastomeric overlay has been omitted for clarity, according to an aspect of the present disclosure.
Figure 2B:
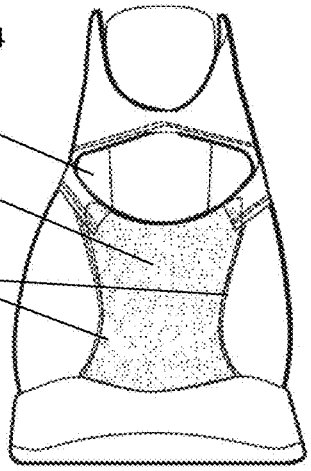
Figure 3A:
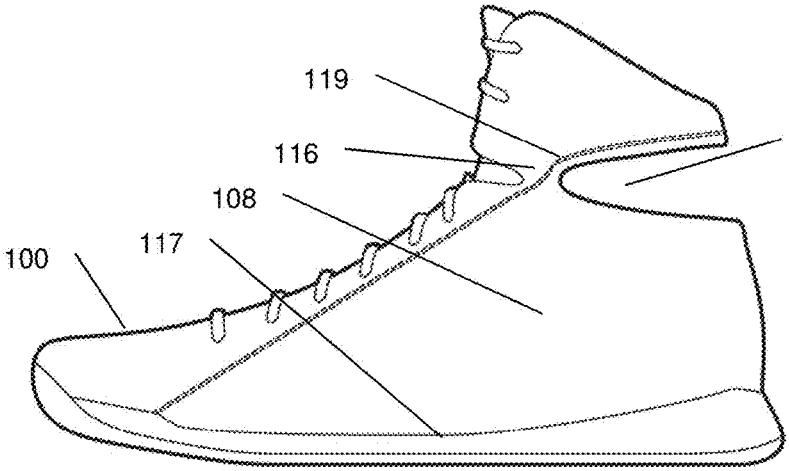
FIGS. 3A and 3B are views of footwear depicting the structural elements of footwear wherein the elastomeric overlay, the eyestay, and heel counter panel have been omitted for clarity, according to an aspect of the present disclosure.
Figure 3B:
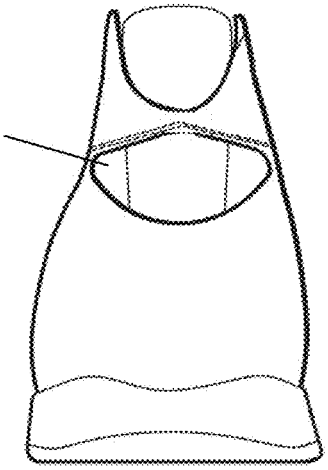
Figure 4A:
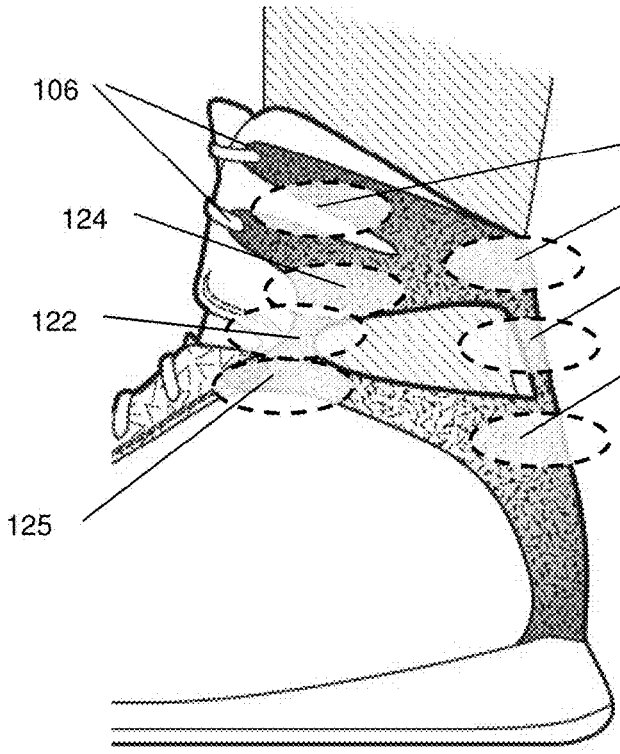
FIGS. 4A and 4B are detail views of the ankle housing portion of footwear, according to an aspect of the present disclosure.
Figure 4B:
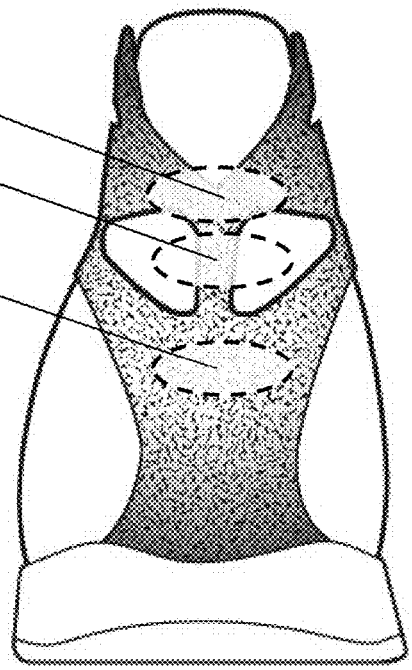
Figure 5A:
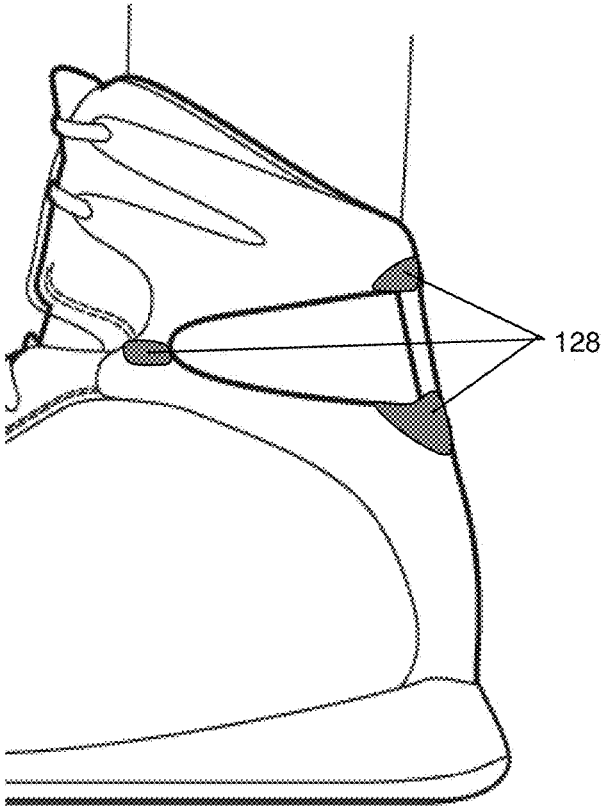
FIGS. 5A and 5B are detail views of the ankle housing portion of footwear wherein areas which may be kept free of adhesives are highlighted, according to as aspect of the present disclosure.
Figure 5B:
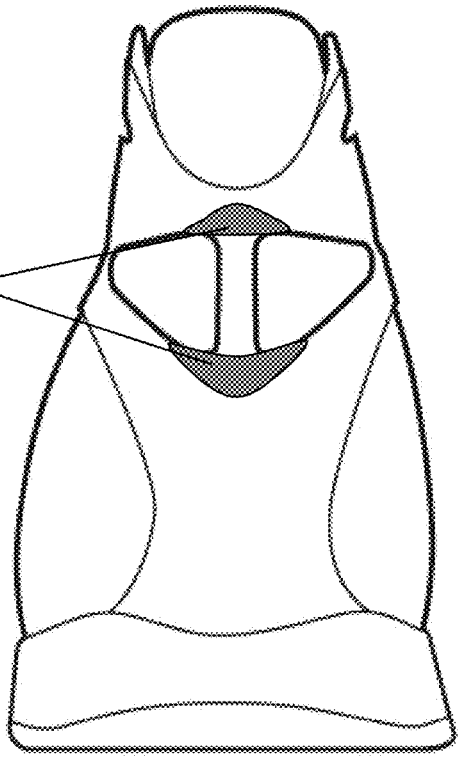
Figure 7A:
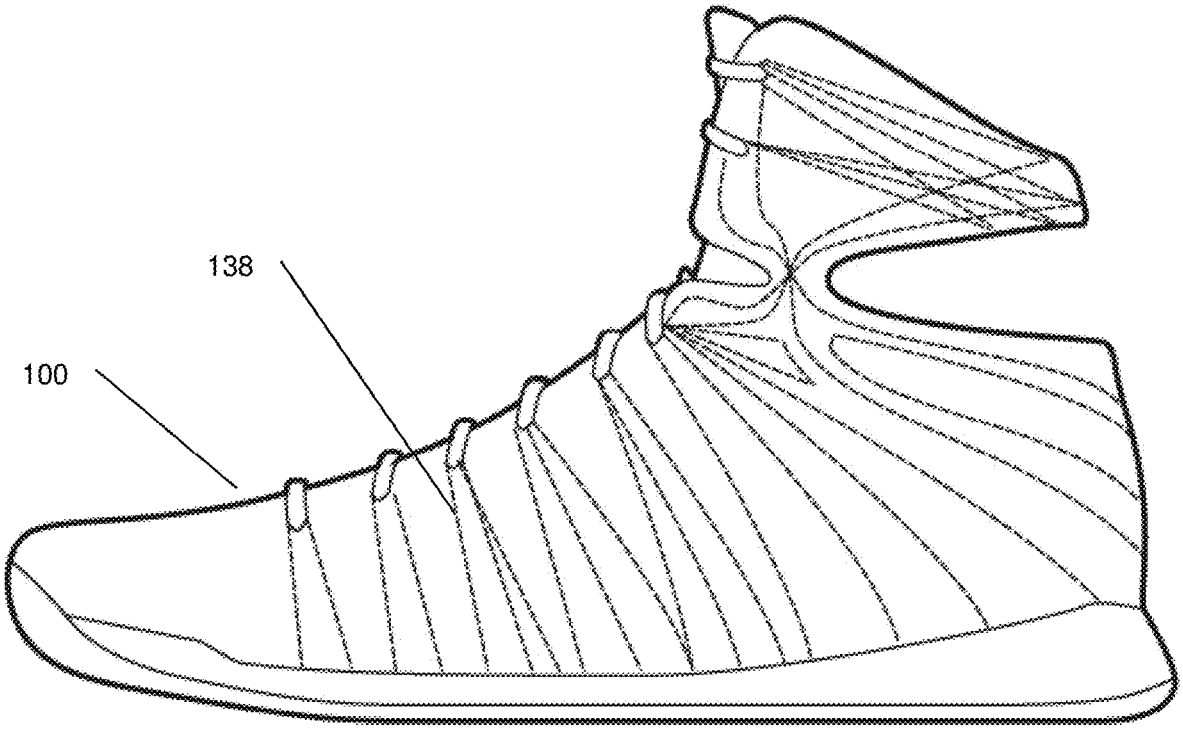
FIGS. 7A-D are views of footwear depicting tension bearing stitching paths and other supporting elements of footwear, according to various aspects of the present disclosure.
Figure 7B:
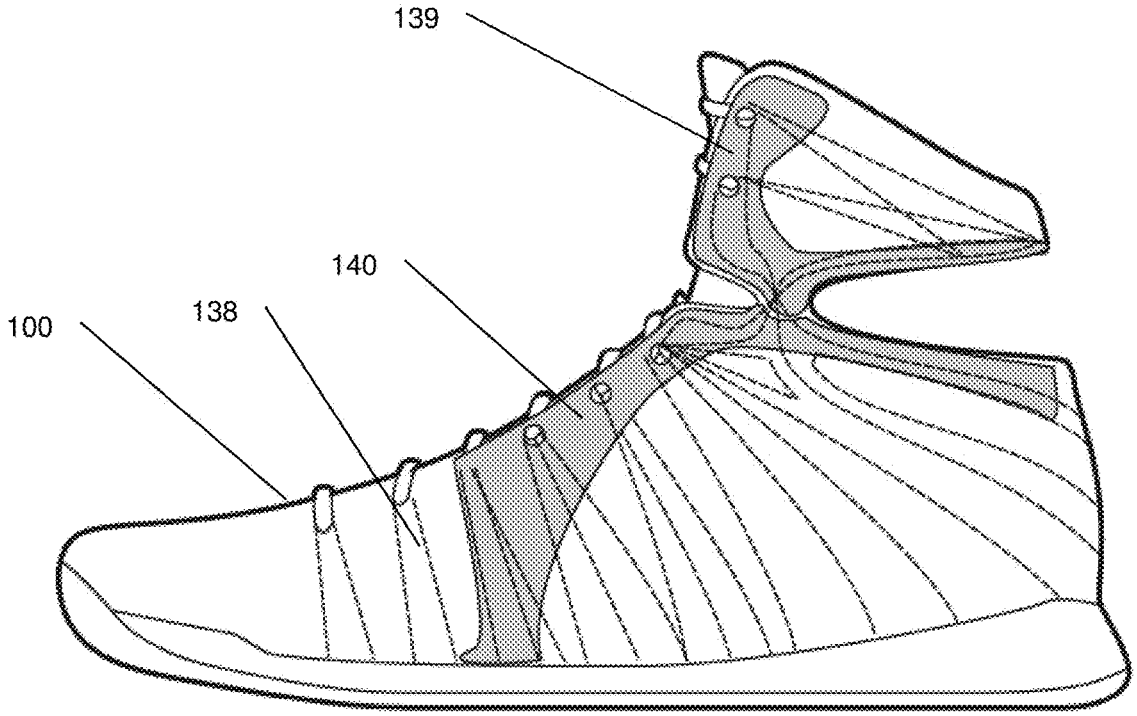
Figure 7C:
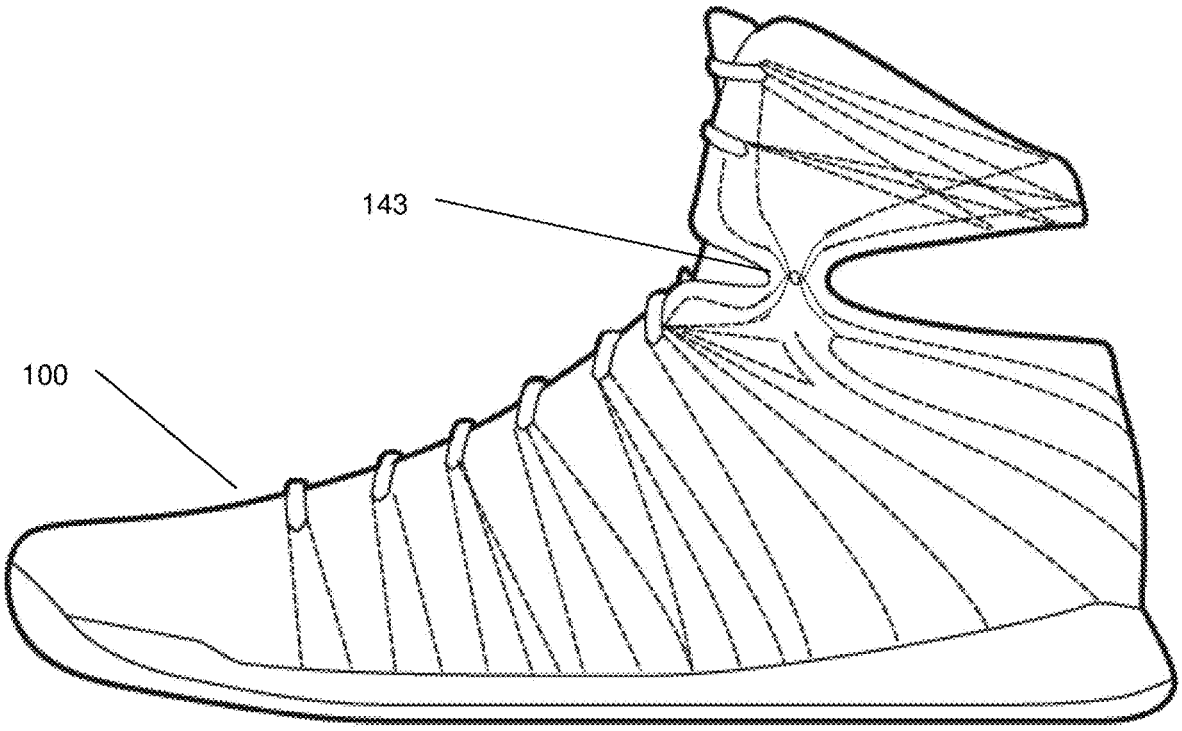
Figure 7D:
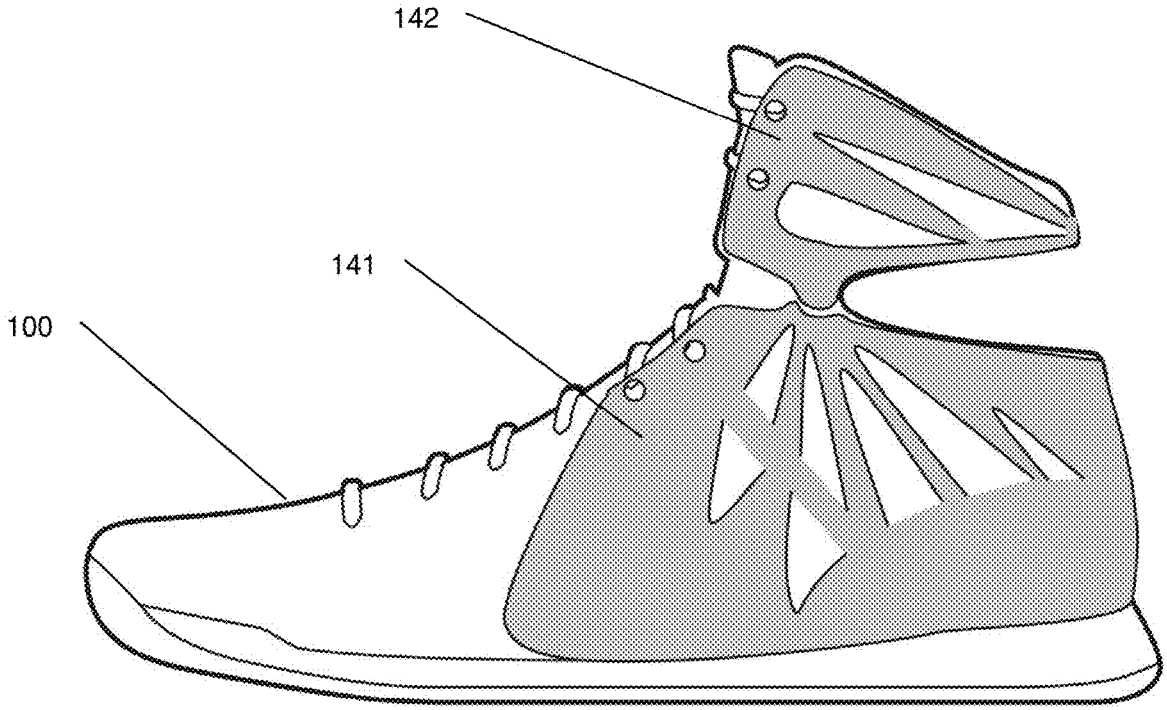
Figure 8:
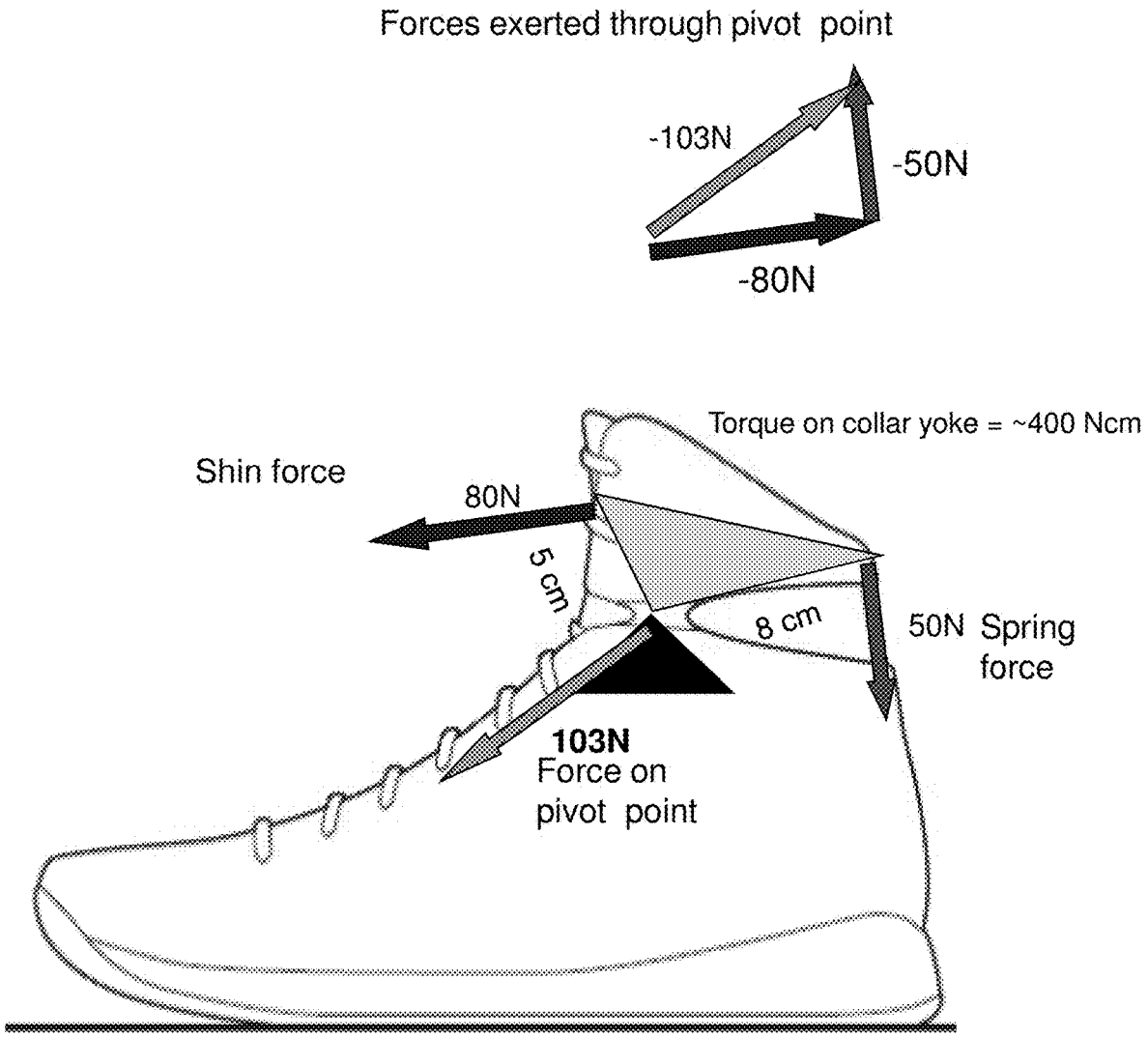
FIG. 8 shows a hypothetical diagram of forces applied to one side of the first aspect, in accordance with an aspect of the present disclosure.

Referring to FIGS. 1 through 7, various side (A) and rear (B) views of a first aspect of footwear, for example, a shoe are shown from one perspective, for example, a left shoe 100 where a side of the shoe 100 not seen is assumed to be similar to the depicted side. FIG. 1A shows an external side view and FIG. 1B a rear view of the first footwear aspect. FIG. 4 shows a close-up of an ankle housing portion of shoe 100. FIGS. 2, 3, and 6 show side (A) and rear (B) views of the first aspect with varying layers of materials removed to reveal internal components. FIG. 5 shows details concerning the placement and removal of bonding agents, and FIGS. 7A and 7B show details of tension-bearing stitching or caging. FIG. 8 will be referred to for a discussion of vectors for spring force, force exerted on a pivot point and shin force in the vicinity of a narrow channel 116 for the first footwear aspect.

FIGS. 1 through 7 are drawings, for example, of a modified high top athletic shoe 100, with a rotatable collar yoke 104 and elastomeric overlay 120. Shoe 100 may have an articulating joint at narrow channel 116 and an overlay rotation zone 122 as well as a tension spring device which is managed within an elastic zone 121 (FIG. 4).

The posterior gusset 115 may remain exposed to highlight the dynamic quality of the shoe, or it may be covered by a stretch fabric to provide an aesthetic shoe designer with styling options and to prevent entry of sand and debris. Shoe 100 does not suffer from negative aesthetic impact of appendages or ancillary equipment. It can thereby maintain appearance qualities similar to other high top athletic shoes and offer an opportunity for delivering appealing ornamental designs that engage and interest buyers.

Basic Construction and Functionality

FIG. 2 shows shoe 100 with the elastomeric overlay 120 removed in side view FIG. 2A and rear view FIG. 2B. These views demonstrate that a common high top athletic shoe may be modified to incorporate a point 113 of a narrow channel 116 (FIG. 3) as will be described further herein. Shoe 100 has an anterior gusset 114 as well as a posterior gusset 115. The addition of a posterior gusset 115 creates a narrow channel 116 of upper 108 between the anterior and posterior gussets 114, 115. Channel 116 defines a section above channel 116 which is formed as a rotatable collar yoke 104. The narrow channel 116 and point 113 thus may be a pivot point for forces as discussed herein.

Collar yoke 104 may have a set of yoke eyelets 106 through which pass a set of laces 105. Force from a lower leg 118 of a user can pass into a tongue 107 and then into the laces 105 and then into the eyelets 106 during use. A person wearing such a pair of shoes may notice the ability for the rotatable collar yoke 104 to follow the motion of their lower leg 118 above the ankle joint and the ability for the main body of the shoe 100 below the narrow channel 116 to follow the motion of their foot.

Force from the lower leg 118 may create rotation in the collar yoke 104. Rotation of the collar yoke 104 may create a vertical range of motion at its rear. The vertical range of motion is visible at the rear opening of the posterior gusset 115. This vertical range of motion creates an opportunity to insert a tension spring of various forms as further described below and mimic and supplement the behavior of the Achilles tendon.

The geometry of collar yoke 104 may be designed to allow the user to adjust firmness of laces 105 to determine the comfort on the collar aspect of the collar yoke 104. The side walls of the collar yoke 104 may have stiffness which creates an additional length and oval shape to the collar yoke 104 than found in traditional collars. This results in less pressure being exerted upon the front and rear face of the lower leg 118 when the collar yoke 104 is tightened.

Shoe 100, as will be discussed herein is capable of managing forces, storing and returning potential energy, capable of transmitting these forces into its anchor points, be durable, be comfortable, utilize commercially viable materials and manufacturing processes, have aesthetic qualities which positively differentiate it compared to similar shoe offerings, and provide other advantages as well. A footwear system represented by shoe 100 may endure secondary forces associated with the environment and activity the footwear is employed for and withstand thousands of gait cycles across a 10 to 50 degree or more range of ankle motion. An elastomeric overlay 120, as described below, is one structural aspect of shoe 100 that is fully capable of fulfilling these requirements.

Overlay 120 Details

As shown in FIGS. 1 and 4, shoe 100 may be constructed with use of an elastomeric overlay 120. Overlay 120 may be, for example, a molded elastic element that contours to the shoe 100 and, referring to FIGS. 4A and 4B, shoe 100 has seven major functioning zones: an elastic zone 121, an overlay rotation zone 122, an inferior elastic anchor zone 127, a superior elastic anchor zone 126, an inferior rotation anchor zone 125, a superior rotation anchor zone 124, and a collar yoke adhesion zone 123.

Overlay 120 may separate the several functioning zones into several discrete components differentiating shoe 100. For example, elastomeric overlay 120 may comprise three separate overlays (not shown), with a bilateral set of rotation components 122, 124, 125, a bilateral set of collar yoke adhesion zones 123, and a set of elastic components 121, 126, 127.

Elastic Force Management

Referring to FIG. 4, elastic zone 121 is responsible for managing forces and storing a significant portion of the potential energy. Zone 121 runs near parallel to the Achilles tendon of a user of shoe 100. Like the Achilles, zone 121 is stretched in dorsiflexion and collapses in plantar flexion. The length, thickness, material selection, manufacturing process and attachment qualities of the elastic zone 121 determine its spring rate and damping qualities. These qualities can be adjusted by a manufacturer to meet the anticipated needs of a given footwear application. Elastic zone may comprise a single elastic member or multiple elastic members.

The initial spring length provided by elastomeric overlay 120 is also influenced and controllable to a limited extent by the user and how tightly the user ties laces 105. If the user does not tie laces 105, as is frequently done by many people, elastic zone 121 may be rendered inoperative.

Elastic zone 121 is anchored below by an inferior elastic anchor zone 127. The inferior elastic anchor zone 127 provides a lower attachment point for the elastic zone 121 as well as a surface area for adhesion to the rear of shoe 100. Anchoring of elastic zone 121 may be accomplished by attachment to several components, including the external surface of the heel counter panel 110, sandwiched between the heel counter panel 110 (FIG. 2) and the rear of the shoe 100, the heel counter 130 (FIG. 6), the rear of the outsole 101 which may be connected via a contiguous molding, or alternate locations selected by the manufacturer. Fastening the inferior elastic anchor zone 127 to the rear of shoe 100 allows force from elastic zone 121 to be transmitted into the heel counter region which provides a mechanically advantageous means of inducing extension of the foot towards plantar flexion.

Referring again to FIG. 4, elastic zone 121 may be anchored above by a superior elastic anchor zone 126. The superior elastic anchor zone 126 may provide an upper attachment point for the elastic zone 121 as well as a surface area for adhesion to collar yoke 104 of shoe 100. Adhesion of the superior elastic anchor zone 126 to collar yoke 104 allows force to be transmitted from the leg 118, into shoe tongue 107, into laces 105, into yoke eyelets 106, into collar yoke 104, into superior elastic anchor zone 126, and then into elastic zone 121.

Rotation Force Management

Continuing to refer to FIG. 4, zone 122 of the overlay 120 enables proper rotation of the collar yoke 104, offers fulcrum qualities similar to a ball joint and is referred to herein as an overlay rotation zone 122. This rotation zone 122 sits on top of narrow channel 116 of upper 108 that connects the main body of shoe 100 and collar yoke 104. Flexibility in channel 116 enables collar yoke 104 to rotate in the sagittal plane. The overlay rotation zone 122 supplements channel 116, providing improved management of forces, reduction in buckling, reduction in slumping, higher force management capability and higher longevity. Overlay rotation zone 122 provides an additional layer of material on top of the shoe's typical construction material (i.e.: vinyl, leather, fabric, etc) to withstand the forces of torque, compression, shear and tension associated with repeated rotation of collar yoke 104. The overlay material of rotation zone 122 can function similarly to a human joint capsule by maintaining opposing joint surfaces in proper geometric position, enabling rotation, enabling a small amount of fore/aft joint laxity as in the ankle, and preventing untoward motion.

Overlay rotation zone 122 is anchored below by an inferior rotation anchor zone 125. The inferior rotation anchor zone 125 provides an attachment point for the bottom of overlay rotation zone 122 as well as a surface area for adhesion to upper 108. Adhesion of the inferior rotation anchor zone 125 to shoe 100 allows force from overlay rotation zone 122 to be transmitted into upper 108 and associated eyestay 109 of the shoe 100. The inferior rotation anchor zone 125 may extend along the bottom opening of posterior gusset 115 and may extend down eyestay 109 as well as down upper 108. This ability to distribute force among various shoe components provides a mechanically advantageous place to enable overlay rotation zone 122 to manage multiple forces. While in use, when elastic zone 121 of the elastomeric overlay 120 (FIG. 1) is managing forces, these forces are counterbalanced by overlay rotation zone 122 working together with narrow channel 116 of upper 108, which, in turn, are delivered into shoe 100. The forces from overlay rotation zone 122 apply a force vector that is directed nominally down and to the front as received by inferior rotation anchor zone 125.

The overlay rotation zone 122 is anchored above by a superior rotation anchor zone 124. The superior rotation anchor zone 124 provides an attachment point for the top of overlay rotation zone 122 as well as a surface area for adhesion to collar yoke 104. Adhesion of the superior rotation anchor zone 124 to collar yoke 104 of shoe 100 allows force from the overlay rotation zone 122 to be transmitted in and out of collar yoke 104 during use. In order for forces to be most effectively transmitted from a user's leg 118 to elastic zone 121 during use, they first receive leverage through the fulcrum defined by the overlay rotation zone 122. The superior rotation anchor zone 124 applies forces from collar yoke 104 into overlay rotation zone 122. The superior rotation anchor zone 124 may be geometrically designed to ensure proper bonding to collar yoke 104, proper force transmission from the collar yoke 104 into the overlay rotation zone 122, and reduction in buckling or slumping of collar yoke 104.

Collar Yoke Force Management

Continuing to refer to FIG. 4, zone 123 of the overlay 120 is referred to herein as a collar yoke adhesion zone 123. In the aspects, the collar yoke adhesion zone 123 provides multiple benefits. Together with the collar yoke 104, zone 123 provides supplemental force carrying ability among the eyelets 106, the overlay rotation zone 122 and elastic zone 121. Zone 123 also provides supplemental rigidity to collar yoke 104 to minimize slumping or buckling of the collar yoke's constituent parts under load. Zone 123 provides aesthetic differentiation and can be configured to enable a limited amount of elasticity and thereby offer an amount of energy storage and return.

Overlay Materials

Each of the zones of the elastomeric overlay 120 described above may be comprised of the same, different elastomeric constituents or constituents of varying composition. For example, the elastic zone 121 may have a softer durometer and increased stretch as compared to the collar yoke adhesion zone 123. This can be accomplished by using a common substrate and varying the thickness, durometer, curing qualities, and other parameters as known in the art or by using a variety of different substrates in different locations of the same overlay 120, such as thermoplastic rubber, thermoplastic urethane, silicones, and the like.

Eyestay 109 and Sidewall

FIG. 2 shows a view of the exterior surface of the shoe 100 with the elastomeric overlay 120 removed. An eye stay 109 is incorporated around the eyelets 106, and then horizontally rearward under channel 116 (FIG. 3) until it is locked, for example, with the heel counter panel 110.

The eyestay 109 provides natural rigidity to shoe 100. As forces from rotation zone 122, inferior rotation anchor zone 125, and channel 116 are passed into eyestay 109, these forces can be spread across a greater area so that comfort can be maintained on the user and the longevity of shoe 100 can be maintained.

Forces into eyestay 109 from the rotation zone 122, inferior rotation anchor zone 125, and channel 116 during use are predominantly downward and forward and, as such, can be managed in multiple ways. Some of the force may travel down eyestay 109 into upper 108 and into sole 101, 102. Some of the force may be transmitted into the eyelets 106 and into laces 105 and into tongue 107, especially below anterior gusset 114. These forces are suspended along the top surface of the foot, travel through the foot and consequently into the midsole 102 and outsole 101. A sidewall is generally considered a side panel of upper 108. Sidewalls often hold aesthetic adornments such as shoe logos and may also be used to provide rigidity and structural stiffness to shoe 100. Sidewalls may be reinforced by caging or tension bearing stitching 138. Some of the force may travel through the rigidity of upper 108 and sidewall allowing compressive forces to reach the sole 101, 102 without passing through the foot during locomotion.

Usage of stiff materials for upper 108, sound stitching, inclusion of tension bearing stitching 138 elements between eyelets 106 and midsole 102, or the usage of supplemental external materials to create a cage are mechanisms that may be applied to increase the structural strength and force carrying capacity of the sidewall of upper 108. As such, applying these techniques will improve force transmission from the overlay rotation zone 122 and channel 106 through eyestay 109, through heel counter panel 110, and directly into upper 108.

Upper 108

FIG. 3 shows a view of the exterior surface of the shoe 100 with the elastomeric overlay 120, eyestay 109 and heel counter panel 110 removed. These side and rear views allow a view of details of upper 108, which in this aspect may be a continuous piece of sheet material that flows through the narrow channel 116 and into the collar yoke 104. FIG. 3 may demonstrate that traditional shoe construction can be easily applied.

Stitching Overlap

FIG. 2 shows detail of eyestay stitching 111 and counter panel stitching 112. In this aspect, narrow channel 116 (FIG. 3) is further reinforced by intersection of stitching 119 that results in an "X" shaped stitching overlap 113 forming a point at the intersection. This "X" shaped stitching overlap 113 may be created by overlapping eyestay stitching 111 with counter panel stitching 112, or may be created by independent stitching path construction where the stitching acts similarly to the cables of a suspension bridge. By locating the intersection of stitching overlap 113 in narrow channel 116 and overlay rotation zone 122, strength against tension and shear are provided while still allowing a range of rotation motion during use.

A stitching overlap may be created with the intersection of tension-bearing stitching 138 used in some high performance athletic shoes. FIG. 7A is a representation of an application of tension-bearing stitching paths configured to maintain stability of shoe 100, support upper 108 of shoe 100 from slumping below narrow channel 116 and provide an ability for narrow channel 116 to pivot while maintaining integrity. In this approach, four parallel rows of "S" (and reverse "S") shaped tension-bearing stitching 138 paths are curved and overlap at a common "X" point 113. A similar effect can be created with various other combinations of straight lines and curved lines intersecting at a desired point of rotation where the lines comprise stitching, tension-bearing stitching 138, caging and the like.

Gathered Material in Channel 116

The material used in construction of upper 108 may pass through narrow channel 116 in a flat manner. The material may also be gathered in a manner that creates at least one crease in the material that is generally oriented horizontal to the floor. Those familiar with fabrics will be familiar with the process of gathering. The stitching overlap 113 can then be applied over top of the gathered fabric. By gathering the fabric, the overlay rotation zone 122 is provided with additional range of rotation motion.

Many shoes are created with multiple layers of materials. In shoe 100, some layers may pass through narrow channel 116 flat, while some layers may include gathering depending on the application of shoe 100.

Supplemental Material in Channel 116

To add further support and longevity in narrow channel 116, additional materials may be integrated with the materials used for constructing upper 108. For example, a small patch of fabric may reside between the outer surface material of upper 108 and the liner material. This additional material may include a variety of fabrics, for example, one way stretch fabric, two way stretch fabric, fabrics containing high strength materials such as para-aramid fibers, or other fabrics known in the art. The additional material may be bonded to upper 108. The additional material may simply be integrated into upper 108 by virtue of attachment through stitching overlap 113. The additional material may lay flat or be gathered in narrow channel 116. The overlay may also be supported in rotation zone 122 in other ways, for example, encircling the narrow channel 116 and overlay material of the rotation zone 122 with material (for example, multiple wraps of thread, ribbon, elastomeric material, as one might wrap an eyelet to a fishing rod).

Supplemental Stiffeners

FIGS. 6 and 7 show supplemental stiffeners. The use of supplemental stiffening is common in sneaker construction.

The technique may be applied, for example, in the creation of heel counter 130. The use of supplemental stiffeners can be implemented in various ways. Following traditional design of heel counters 130, stiffeners made of plastic sheet are sandwiched between a sock liner and padding system 137 and upper 108. Force may be transferred to a supplemental stiffener indirectly through a layer of upper 108 or sock liner and padding system 137 during use. It may also be transferred into and out of a supplemental stiffener by providing direct fastening between elements of an elastomeric overlay 120 and supplemental stiffener.

Tension, torque, compression, shear and other forces across a collar yoke 104 can distort the collar yoke 104 during use. While a collar yoke 104 made from multiple layers of sturdy sheet materials such as leather or similar materials may be able to withstand slumping or bending without reinforcement, many shoe designs do not have such stiff materials and are likely to bend, slump or otherwise deform under pressure. This deformation may prevent the range of motion found in a particular application to become usable. Therefore, shoes without sufficient strength in upper materials may require reinforcement in order to maintain their shape and longevity. The nature, required rigidity, required materials and require design are based upon the spring rates and forces designed into the footwear system of the first aspect. A collar yoke stiffener 131 (FIG. 6) may be responsible for assisting proper force transfer within and across collar yoke 104 while also protecting collar yoke 104 from slumping, buckling or otherwise losing its intended and comfortable shape.

Referring now to FIG. 8, shoe 100 is shown to have multiple forces acting upon it during locomotion. The forces shown in this drawing comprise primary forces associated with the energy management of shoe 100. Other forces associated with routine use of shoe 100 are acknowledged but not shown here to help ensure clarity. These primary energy management forces include a spring force, a shin force and a force exerted on the pivot point (the vicinity of channel 116). Shin force is a force associated with the front face of the lower leg 118. Spring force is a force generally parallel to the Achilles tendon associated with the elastic zone 121 and elastomeric overlay 120. The force exerted on the pivot point is associated with the forces through narrow channel 116 and overlay rotation zone 122. Hypothetical dimensions of collar yoke 104 are shown in FIG. 8 to be a moment arm of 5 cm between the pivot point and the shin force, and 8 cm between the pivot point and the spring force. A spring rate in the elastic zone 121 of 25 Newton/cm can lead to a spring force of 50 Newton as a result of a 2 cm stretch of elastic zone 121 while the ankle is near maximum dorsiflexion. A 50 Newton force assuming a moment arm of 8 cm leads to a torque of 400 Newton-cm on the collar yoke 104. Knowing that there is a lateral and medial side of the collar yoke 104, and assuming a moment arm of 5 cm to the eyelets 106, there is an approximate force of 40 Newton to the lateral eyelets 106 and 40 Newton to the medial eyelets 106, resulting in a collective shin force of 80 Newton. There is also a force upon the pivot point of 103 Newton that is oriented down and forward, nominally along eyestay 109. The geometry of such a system also enables it to transform some of the work into electrical current which can be stored or used as it is generated. For example, an elastic member may include a coaxial device that enables generation of electric current as the elastic element is stretched and or released. A variety of small power harvesting mechanisms may be employed, examples comprise but are not limited to solenoids, coils, piezoelectrics, micro-electric generator systems, reciprocating members to drive alternators, and the like.

Since the collar yoke 104 can be subject to significant forces, including a collar yoke stiffener 131 can help better manage those forces. An eyestay and collar stiffener 133 can help manage forces transmitted through channel 116 and overlay rotation zone 122. As forces increase, there is a tendency for upper 108 to slump or buckle. The eyestay and collar stiffener 133 can support eyestay 109, collar yoke 104 and upper 108 of shoe 100 from slumping or bending under the force received from the collar yoke 104. The size and shape of the eyestay and collar stiffener 133 can vary in accordance with the amount of force anticipated. While some of the downward force in collar yoke 104 will be transmitted into the malleolus bulges, much of the force from collar yoke 104 is transmitted down and forward, into upper 108 in alignment with the long axis of eyestay 109. Eyestay 109 and eyestay and collar stiffener 133 may be designed to pass multiple eyelets 106 to help ensure that forces are distributed and do not localize in one vulnerable spot. Such stiffeners may be optimized to meet shoe application requirements. As an example FIG. 7B shows a variation of eyestay and collar stiffener 140.

The inferior eyestay and collar stiffener 133 can be fastened by a number of means including adhesives, stitching, grommeting of eyelets 106, anchoring to sidewall cage materials, anchoring to the midsole 102, and other means known in the art.

An upper stiffener 135 can help manage forces transmitted through channel 116 and rotation zone 122. As forces increase, there is a tendency for upper 108 to slump or buckle. Upper stiffener 135 can support the eyestay and collar stiffener 134. It can also transmit forces directly to midsole 102, reducing the amount of force distributed on the foot. The size and shape of upper stiffener 135 can vary in accordance with the amount of force anticipated. Upper stiffener 135 is shown adjacent but not connected to eyestay and collar stiffener 134. These two components may be integrated as one singular piece of material or may reside adjacent to each other. Upper stiffener 135 may further be integrated as one singular piece with the heel counter. Upper stiffener 135 can be further strengthened by integration with cage materials over the sidewall integration with tension bearing stitching 138 elements which connect eyelets 106 to midsole 102.

Supplemental Stiffener Interface Area

Referring again to FIG. 6, eyestay and collar stiffener 133 has a radiused receiving area 134. Collar yoke stiffener 131 has a radiused protrusion 132 that sits proximal to the eyestay and collar stiffener's radiused receiving area 134. Protrustion 132 has a smaller radius than the receiving area 134. By fastening eyestay and collar stiffener 133 and collar yoke stiffener 131 to the exterior shoe surface or to elastomeric overlay 120, a rotating joint is created that facilitates rotation. Orienting the radius of the eyestay and collar stiffener's radiused receiving area 134 towards the rear, the radius acts as a cup device that anticipates the forward and downward forces that are transmitted from the collar yoke 104 and the collar yoke stiffener 131. The differential in radius allows for a small amount of fore and aft laxity to reflect glide of the talus on the ankle mortice with ankle flexion and extension.

Supplemental Stiffener Alternatives

The term "supplemental stiffener" is used to generically refer to a stiffener constructed from any number of materials or combination of materials that can be employed according to the needs of each application. The common use of plastic sheet in heel counters of athletic shoes makes plastic sheet one choice for this application. Supplemental stiffening may also be achieved by judicious choice of leathers and other upper materials in layers and or laminates in areas of support.

That said, a wide variety of other materials can also be used. For example, use of carbon fiber and fiberglass components may be applied in many higher performance athletic shoes. A benefit of carbon fiber is its ability to be contoured in three dimensions with singular or multiple curves, including complex saddle shapes, while maintaining light weight and strength. Very high performance applications may require carbon fiber to enable high spring rates and energy storage and return capabilities. Metals and alloys can be used in sheet format, castings or other forms for certain applications, and may be used in toe box protection and shank creation. The use of laminated or corrugated sheets can also improve the structural qualities of the stiffeners. Use of higher forces and higher strength supplemental stiffeners may require stronger joint construction at their pivot interface proximal to narrow channel 116. A variety of hinge types may be used for a high strength pivot interface, including ball joints, pin hinges where the pin is either made of a high strength material or a shoe lace or other means known in the art.

Additionally, the use of tension bearing stitching 138 or fibers to manage tensile forces between the eyestay and sole or heel counter establishes excellent opportunity for improving upper rigidity. The use of suspension bridge-like geometries creates stability in sidewalls. Similar tensile patterns can be established circumferentially to further boost stiffness.

Additionally, the sides of collar yoke 104 may be constructed with horizontally oriented corrugated or hollow elements that resist bending near the Achilles, but enable flex and bending above the malleolus bulge. This further enables an oval shape of collar yoke 104 to apply force to the sides of the lower leg 118 without overly constricting the back of the lower leg.

Adhesive Application

FIG. 5 focuses on adhesive application and bonding to the substrate. The use of adhesives is well known for fastening in the footwear industry. Bonding of elastomeric overlay 120 to the surface below can be optimized. By eliminating the use of adhesives in close proximity to either end of elastic zone 121 or small areas within the rotation zone 122, one can reduce the likelihood of overly high pressure points and extend the working range of motion and longevity of the elastomeric overlay 120. A diagram of zones that can be kept free of adhesives is shown in FIG. 5 and is labeled by grey zones 128.

Spring Rate Versus Cross Sectional Area

Assuming a consistent material selection and preparation across elastic zone 121 (FIG. 4) of elastomeric overlay 120 (FIG. 1), the spring rate of elastic zone 121 is correlated against the cross sectional area of the molded elastic member within the zone. Narrowing of the elastic zone 121 as viewed from the rear will reduce the cross-sectional area, assuming a constant thickness. This may be a problem in the event that a designer wishes to use an hourglass type of shape from the rear view. The starting spring rate of elastic zone 121 is predicated upon the narrowest cross sectional area. As such, it may be necessary to increase the thickness of elastic zone 121 to compensate for narrowing of elastic zone 121. Providing a longer volume with a consistent cross sectional area provides a more uniform spring rate and lower likelihood of undue fatigue in a small volume that could shorten the life of a product.

Lacing 105

As currently taught, the user tightens laces 105 of shoe 100 in the same way as is done with other high top athletic shoes. Laces 105 are oriented as shown in lace routing 136 such that they travel from eyestay 109 below anterior gusset 114 back to a loop in proximity to narrow channel 116 prior to moving up to eyelets 106 in collar yoke 104. In this way, rotation of collar yoke 104 will not place unnecessary forces that may loosen or tighten laces 105 during use.

A user of shoe 100 has an option to point their toes while tightening their shoelaces 105 to reduce tension in the elastic zone 121, but this is not a requirement. The user ties shoe 100 to the desired collar tightness, just as one would do with a conventional high top shoe. When shoe 100 is adequately tightened, shoe 100 may operate its force management features (for example, FIG. 8). When shoe 100 is worn slack and untied, the force management features are inactive. The user has an option to somewhat reduce the amount of engagement of the force management feature by intentionally keeping the collar yoke 104 loosely tied, thereby limiting the amount of range of motion that can be engaged. An elongated geometry of collar yoke 104, as mentioned earlier, restricts the amount of collar force applied to the rear face of lower leg 118, even when the user tightens the collar yoke 104 fully.

User Adjustment of Spring Rate

Some users of shoe 100 may wish to have ability to adjust the spring rate of their shoes in excess of the spring rate of elastic zone 121 of overlay 120. There are several ways that can be implemented, including the following four ways.

First, providing at least one supplemental elastic member that is integrated to the back of the heel counter region. The elastic member may be anchored near the interface to midsole 102 and have a neutral length short of the heel counter height. When not in use, the elastic member may reside external to shoe 100 or in a pocketed area. The user then has an option of pulling the top end of the elastic member and engaging it into a fastening device above posterior gusset 115. For example a small gage elastic cord may be utilized as the elastic member. It may be anchored at midsole 102 on its bottom end, and its top end may have a small hook affixed. When not in use, the small hook is visible above the heel counter, and when in use, the small hook could engage with a receptacle above posterior gusset 115, thereby increasing the spring rate. The user could then adjust the supplemental elastic member(s) to match their desired level of force management for the activity in which they plan to engage. Any variety of anchoring systems can be employed. Shoe 100 may be constructed with a pull tab above the heel counter that extends back behind the limits of shoe 100. Having the supplemental elastic member and anchoring devices visible at the back of shoe 100 would have a similar aesthetic impact as a rear pull tab.

Second, coaxial elastic materials through the elastic zone. Similar to variation 1 in the paragraph above, the supplemental elastic member may be anchored along the sides of the collar yoke 104. By creating at least one hollow opening through elastic zone 121, an additional pair of elastic members can be oriented through elastic zone 121. Supplemental elastic members can be anchored at the base of the heel counter away from contact with the skin. They can then traverse past the heel counter and up through a hollow core of the elastic zone 121. They can then branch to the left and right sides of collar yoke 104 where they can be made tight or loose by the user. Adjustable anchoring can be accomplished by a variety of means, including lacing and ties, straps with hook and loop fasteners, etc.

Third, altering the active spring geometry. Elastic zone 121 can be altered by restricting its motion through a supplemental device. If elastic zone 121 has a slice down its midline as viewed from the rear, a physical element may be inserted that displaces the sides of the split elastic member outward, thus consuming some of the spring length and providing engagement of the elastic member at an earlier point of ankle rotation.

Fourth, supplemental elastic sheet material. The exposed area of the posterior gusset may be covered by an elastic sheet material. Any number of materials could be selected, including elastic wovens, non worvens, elastomeric sheet materials, etc. The shoe could be supplied with a variety of posterior gusset covers, each with a different spring rate to supplement the spring rate of the elastic zone 121. Posterior gusset covers would need to be anchored above and below the gusset in order to transfer and manage forces.

Thus, through a footwear system of the first aspect, elastic mechanisms may be integrated into footwear which may assist user locomotion selectably by the user's either lacing the collar yoke 104 more tightly or loosely. Under flexion or dorsiflexion, pressure is applied from lower leg 118 into tongue 107 and from tongue 107 into laces 105. Laces 105 transfer forces into eyelets 106, and eyelets 106 transfer forces into a combination of the collar yoke 104, optional collar yoke stiffener 131, and overlay 120 (in the collar yoke adhesion zone 123). These components collectively manage torsional forces with narrow channel 116 and rotation zone 122 providing a fulcrum (through the superior rotation anchor zone 124) and then apply force into elastic zone 121 (through the superior elastic anchor zone) during use. Elastic zone 121 applies force into (through the inferior elastic anchor zone 127) the heel counter panel of the shoe 110. This force is then translated from the heel counter panel 110 area of the shoe into the foot.

As the user increases flexion and dorsiflexion, elastic zone 121 absorbs force and stores it as potential energy. This externalization of force reduces the amount of force that needs to be managed by the Achilles tendon, calf muscles and various other muscles & tendons and so elastic zone 121 assists a user's Achilles tendon. This reduction in force conserves energy of the user and can reduce fatigue.

As the user continues in their stride and starts to extend and plantar flex, the potential energy in elastic zone 121 is released and forces are exerted into the leg 118 and foot. This results in a locomotion system inducing the foot to extend and plantar flex, providing a harmonized return of energy at the same time the body requires energy to propel their gait. This application of force over time and distance results in work produced by the footwear energy management system. The work produced by the system can benefit the user by supplementing the output of work by the users' tendons and muscles thereby improving performance and enabling faster locomotion or higher jumping; or the work produced by the system can displace work required by the user's tendons and muscles thereby reducing the consumption of oxygen by the muscles and reducing the tendency toward fatigue.

Spring Location

Location of a tension spring within this aspect is within the elastic zone 121 of the overlay 120. Spring force may be designed into additional areas in other variations of this first aspect. For example, the attachment of eyelets 106 to collar yoke 104 may include an elastic component.

Application to Boots and Footwear for Other Vocations and Athletic Endeavors

The above description may be applied, for example, in design of high-top style athletic shoes. The same approach may also be employed within other footwear—such as hiking boots, work boots, military boots, cleated shoes, and so on which may be modified to incorporate the structural elements of the first aspect. A wide variety of sports may benefit from integration of such a system into their specific footwear, basketball players benefit from higher jumping and improved endurance & speed, volleyball players benefit from higher jumping and further distance in leaping reaches, baseball players benefit from higher top sprinting speeds, football players benefit from offsetting some loading on their Achilles during blocking, soccer and rugby players benefit from improved stamina and speed, runners and joggers benefit from reduced load on Achilles and improved endurance and speed over flat and hilly terrain, walkers benefit from improved endurance and easier hill climbing, hikers benefit from improved heel lock-down and lower likelihood of heel blistering while also enjoying improved endurance and the dynamic offset of pack weight, general footwear wearers enjoy the benefits of new and exciting aesthetic differentiation and styling made possible by the system. All of these individuals may benefit from the protective benefits conferred by the system as well. The integrated endoskeleton, together with the integrated tension spring confer similar if not superior benefits to a separate hinged ankle brace in service of reducing forces that conduce towards inversion and eversion injuries. The externalization of forces also relieves pressure from the long arches of the foot, reducing the stresses that conduce towards plantar fasciitis and other sources of foot pain.

Aspect 2

Table of Reference Numerals:

Second aspect of a shoe 200
outsole 201
elastic member 202
interface between elastic member and outsole 203
rotatable collar yoke 204
rotation zone 205
interface between elastic member and collar yoke 206
alternative routing of elastic member 207
shaped elastic member 208
heel counter 209
posterior gusset 210
upper 211
liner 212
eyelet 213

FIG. 9 shows various side views (FIGS. 9A, 9C and 9D) and a rear view (FIG. 9B) of another aspect of a shoe 200 incorporating many of the structural elements of first aspect shoe 100. Shoe 200 functions similarly to the initial aspect, but highlights different ways in which to create and anchor an elastic zone as well as different ways to create a rotation zone. This aspect creates elastic tension through the use of an elastic member in lieu of an elastic zone within an elastomeric overlay as shown in the first aspect (FIGS. 1-8).

FIG. 9 shows three different approaches to the creation of an elastic member. FIG. 9A shows an external side view of the aspect and FIG. 9B shows an external rear view of the aspect. FIG. 9C shows a cutaway view of the same aspect to reveal construction layers, with a different approach to the shape and anchoring of the elastic member. FIG. 9D shows a different approach to the shaping, placement and anchoring of the elastic member.

An elastic member 202 running parallel to an Achilles tendon during use provides the force carrying capability between a collar yoke 204 and the heel area of shoe 200. In this configuration, the elastic member 202 is anchored at its base by becoming integral with shoe outsole 201 at an interface point 203. Modern athletic shoe construction often relies upon a variety of materials and colors in the construction of an outsole 201. Interface point 203 enables a continuous mold to service the outsole 201 and elastic member 202.

The elastic member 202 may have different material and performance properties than the material in outsole 201, allowing the elastic member to have higher qualities of elasticity with reduced elastomeric loss, while outsole 201 may have higher scuff resistance and wear properties.

Elastic member 202 is anchored at its top by splitting into a "Y" shape and fastening to both sides of collar yoke 204. Collar yoke 204 may include a supplemental stiffener element or it may rely upon a single or multiple layer construction of upper material to enable it to properly manage forces between the leg, rotation zone 205 (FIG. 9A) and elastic member 202. If a supplemental stiffener element is used, elastic member 202 may be anchored directly into the supplemental stiffener element. Elastic member 202 may also be anchored at the top by an adjustable feature, such as a link to a hook and loop strap system (not shown) that provided a fastener with adjustable length, or a series of hooks which can provide variable spring lengths.

Figure 9A:
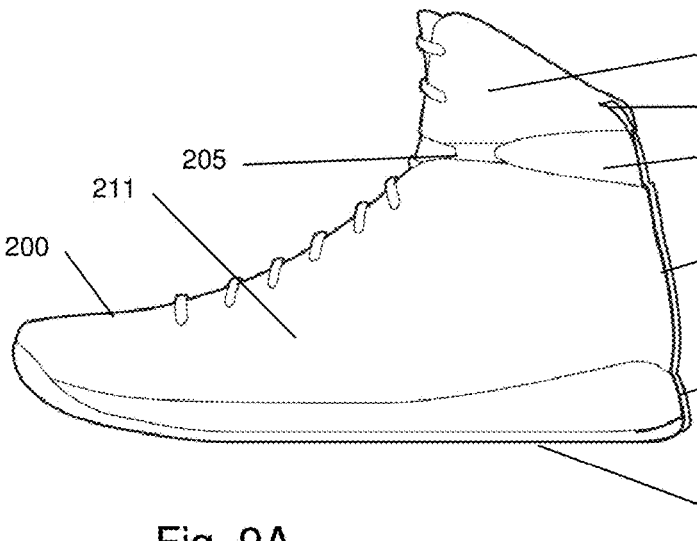
FIGS. 9A-D are views of another aspect of footwear, the aspect having a rotatable collar yoke, in accordance with an aspect of the present disclosure.
Figure 9B:
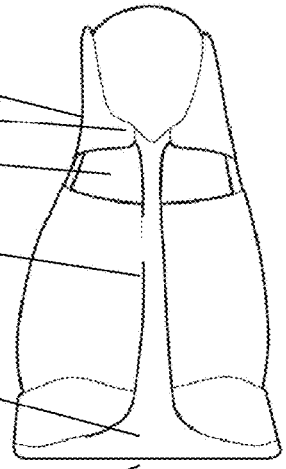
Figure 9C:
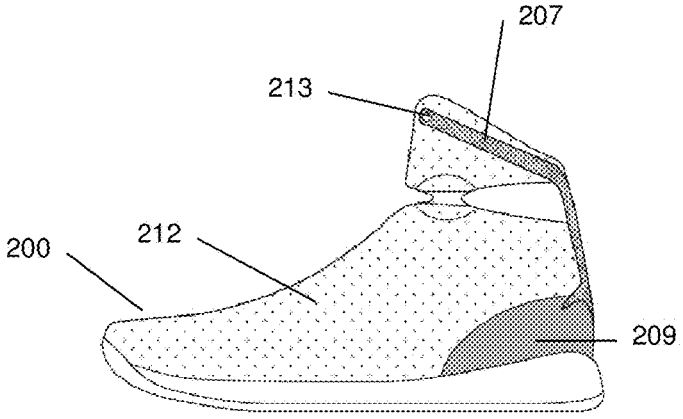

FIG. 9C shows another approach to an elastic member 207. In this instance, the elastic member 207 is anchored at its top at one of the eyelets 213, for example, a top-most eyelet of collar yoke 204. The elastic member is supported through collar yoke 204. Elastic member 207 is anchored at its base, for example, by attaching to an internal heel counter 212.

Figure 9D:
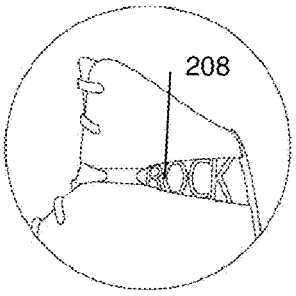

FIG. 9D shows another approach to an elastic member 208. In this instance, elastic member 208 is formed in a visually appealing shape. For example, elastic member 208 may be formed with shaped elastomeric material to create the letters R-O-C-K. This is one example of a visually appealing shape, and many other shapes may be employed. This is one example of the use of elastomeric material. Other spring materials may be employed—such as woven and nonwoven fabrics, sheet rubber, silicones, or other materials known in the art. Sheet materials such as latex may be employed where an appealing graphic is printed on the latex and the graphic changes its appearance upon stretch of the latex sheet during the opening of posterior gusset 210.

The various approaches in the design of the elastic members 202, 207 and 208, the superior anchor points and inferior anchor points may be arranged in a variety of combinations and still be novel. These approaches may also be employed with elements of the elastomeric overlay as shown in the prior aspect to create novel aesthetic and functional solutions.

Each of the designs in FIGS. 9A, 9B, 9C and 9D utilize a rotation zone 205. In this aspect, rotation zone 205 may be created from a flexible material that is bonded to the upper material above and below rotation zone 205. Flexible materials may include woven and non-woven fabrics, vinyls, rubbers, urethanes, silicones, and such materials known in the art. The materials may be single layered or a composite of multiple materials in multiple layers.

Any need for supplemental reinforcement of the areas above and below rotation zone 205 will depend upon the nature of the materials selected for upper 211 as well as the desired spring force of elastic member 202. If upper materials do not have sufficient rigidity to accommodate the spring forces during use, supplemental reinforcement may be introduced as described in the first aspect.

Aspect 3

Diagonal Tension Spring to Sliding Yoke

Table of Reference Numerals

- third aspect of a shoe 300
- heel counter panel 301
- tension spring 302
- collar 303
- top collar yoke lobe 304
- eyelets 305
- D-ring 306
- curved D ring 307
- pivot point 308
- anchor stitching 310
- leg 311
- passageway 312
- inlet to passageway 313
- tongue 315
- laces 316
- sliding surface 317
- semi-rigid member 318
- upper 319
- foot 320

FIG. 10 shows several views of a third aspect of a shoe which practices an energy management system similarly to the first aspect, shoe 300. FIGS. 10A and 10B show external side and rear views, respectively. FIG. 10C shows an internal view of shoe 300, while FIGS. 10D and 10E show additional variations of the third aspect.

FIG. 10 includes drawings of a modified high top athletic shoe 300, with a diagonal tension spring 302 at the top of shoe 300. Tension spring 302 may have an inferior anchor above a heel counter 310 and a superior anchor at a high top collar yoke lobe 304. The shoe 300 includes an upper 319 and a collar assembly 303 that is the above the upper 319.

Upper Anchor Variations

Without specific drawing references, force from a leg 311 is transferred into a tongue, into laces, into eyelets, into a yoke, into a tension spring, into the rear of the shoe above the heel counter during locomotion.

Tension spring 302 may be anchored to the high top collar yoke lobe 304 through a variety of means. FIG. 100 shows the top collar yoke lobe 304 as a multiple ply construction of vinyl, fabric, leather or other material common in shoe making. In this aspect, tension spring 302 is sandwiched between the plies of the material used to construct the top collar yoke lobe 304 and anchored by connection to eyelets 305.

Figure 10A:
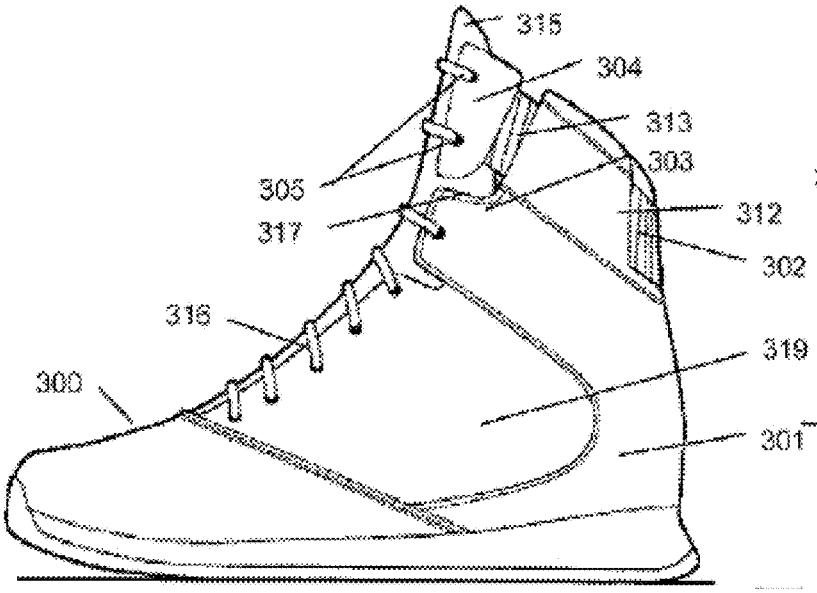
FIGS. 10A-E are views of another aspect of footwear, the aspect having a collar yoke tab and diagonal spring, in accordance with an aspect of the present disclosure.
Figure 10B:
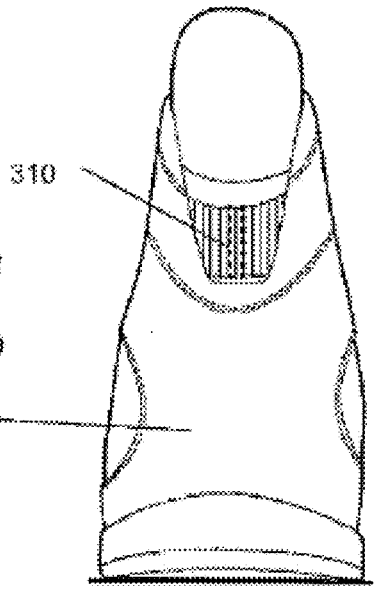
Figure 10C:
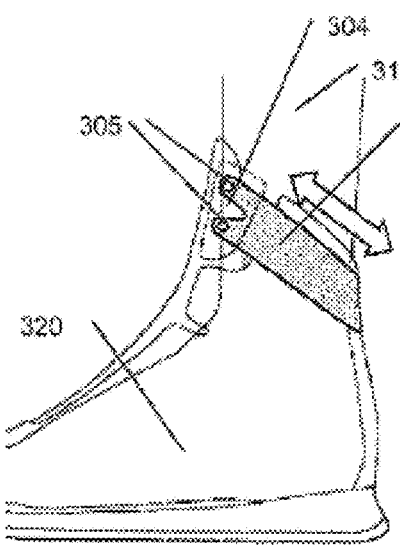
Figure 10D:
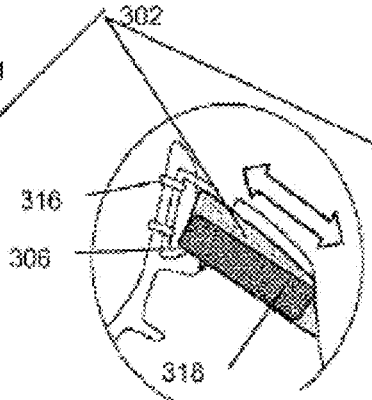

FIG. 10D shows tension spring 302 coupled to an off-set D-Ring 306. Laces, 316 are also connected through the off-set D-Ring 306. D-Ring 306 acts in lieu of the top collar yoke lobe 304.

Figure 10E:
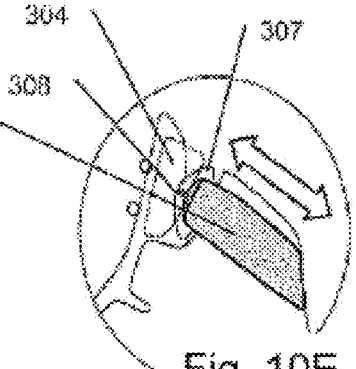

FIG. 10E shows tension spring 302 attached to a curved D-Ring 307 which can be attached to a top collar yoke lobe 304. Curved D-Ring 307 is fastened rotatably through a pivot point 308 to the top collar yoke lobe 304. The pivot point 308 allows the top collar yoke lobe 304 to rotate relative to the spring and allow laces 316 to lay flat against the user's leg 311.

In each of the configurations of FIG. 10, force is applied to and from the lower front face of leg 311, into a tongue 315, into laces 316, into eyelets 305, into the top collar yoke lobe 304 or D-Ring 306, into tension spring 302, into the rear of shoe 300 above the heel counter during locomotion.

Flexibility in shoe 300 to allow forward rotation of the leg 311 is enabled by separation of the of the top collar yoke lobe 304 away from the rest of the collar 303. This allows range of motion of the lobe to follow the leg 311 as it moves forward in flexion towards dorsiflexion and back in extension towards plantar flexion. The tension spring 302 has primary force direction in linear tension, but also can resist shear and rotation.

Tension spring 302 is anchored, for example, to the top of the heel counter panel 301 through stitching 310, adhesive or other common means in proximity to the top of the heel counter 301. In this manner, force from the tension spring 302 is transferred into the shoe 300 during locomotion. Shoe 300 thereby may transfer force into a users' foot 320.

Construction

Tension spring 302 passes through a passageway 312 created in the collar 303. The passageway 312 for spring 302 is created to allow tension spring 302 to stretch linearly (direction arrow) with minimal resistance, but provides support to assist tension spring 302 from being pulled or slumping in the downward direction during motion of leg 311. This resistance in the downward direction helps prevent high top collar yoke lobe 304 from excessively slumping down the user's leg 311 in dorsiflexion or plantar flexion. The energy management system of shoe 300 can be further supported against slump by use of a semi-rigid member 318 that can add supplemental rigidity to tension spring 302 while inside passageway 312 and act as a cantilever to prevent downward slump of top collar yoke lobe 304. Semi-rigid member 318 can be fastened to tension spring 302 or attached to high top collar yoke lobe 304.

Lacing Detail

When the laces 316 are loose, the top collar yoke lobe 304 is pulled by tension in tension spring 302 to a resting spot against the vertical front face of the collar 303. The shoe 300 therefore can maintain the appearance of current high top athletic shoe designs. To tighten the shoe 300, the user may position his or her foot in the plantar flexed position (tip toe) and tighten the shoe as one would any other high top shoe. Upon returning to an upright stance, the tension spring 302 stretches to reflect the increase in distance between top collar yoke lobe 304 and top of the heel counter 310.

Locomotion of Shoe 300

In the gait cycle, the length of tension spring 302 expands during flexion/dorsiflexion and contracts during extension/plantar flexion. In this manner, tension spring 302 is able to contribute to energy management, for example, in a similar manner as the aspects described above. Dorsiflexion in the ankle leads to forward motion of leg 311 relative to the back of the foot 320, which applies force on tongue 315, which applies force on laces 316, which apply force on top collar yoke lobe 304, which applies a diagonal force (directional arrow) on tension spring 302 which manages the energy and applies force on the inferior anchor 310 above the heal counter panel 301, which is part of shoe 300, which imparts upward force on the heel of foot 320. The end result is that the forces extend the foot toward plantar flexion.

Tension spring 302 exerts force against dorsiflexion thereby saving muscle exertion in the early phase of the gait cycle. The result of applying force over distance is that the work results in elastic potential energy being stored in tension spring 302. Later in the gait cycle as the ankle starts to extend toward plantar flexion, tension spring 302 then exerts force to support plantar flexion thereby saving muscle exertion in that phase of the gait cycle.

Figure 13:
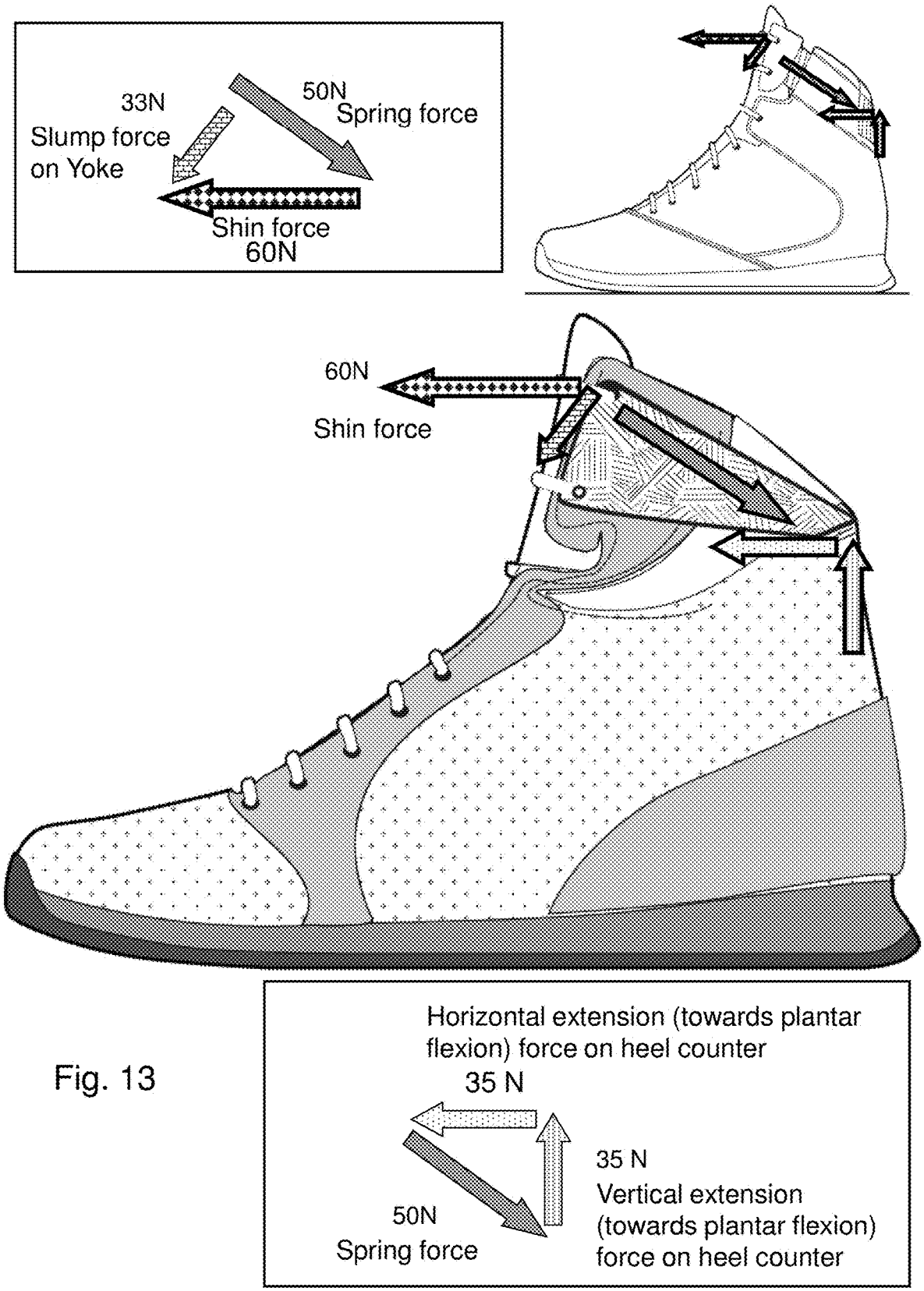
FIG. 13 shows a hypothetical diagram of forces applied to one side of an aspect according to FIGS. 10 or 11, in accordance with an aspect of the present disclosure.

Depending upon the activity, such an energy management system can create a range of motion of 2.5 cm or more across primary tension spring 401. Referring now to FIG. 13, primary forces associated with diagonal tension spring aspects are described. Aspect shoe 300 and aspect shoe 400 are both shown for clarity, and represent similar force arrangements. Other forces associated with gait and athletic usage are acknowledged but not shown to help ensure clarity of the drawing. Five forces are shown, spring force, shin force, slump force, horizontal extension force, and vertical extension force. Spring force is associated with a tension spring, for example, spring 302. Shin force is associated with the front face of the lower leg and passes through a tongue, for example, tongue 315 prior to being transferred to other components. Slump force is associated with a tendency for the top collar yoke lobe 304, for example, lobe 304 to slide down the front face of the leg. Horizontal extension force is associated with an area above the top of the heel counter panel 301 and drives shoe 300, 400 forward relative to the foot. Vertical extension force is associated with an area above the top of the heel counter panel 301 and lifts shoe 300, 400 up relative to the foot. The horizontal and vertical extension forces work to keep shoe 300, 400 in close contact with the foot, and also help drive plantar flexion motion. Assuming that the lateral and medial tension springs 302 have a collective spring rate of 20 Newton/cm, an increase in length of 2.5 cm could provide 50 Newton of force at full extension. As this force is anchored near the top of the heel counter panel 301, the force creates the equivalent of approximately 35 Newton in the lifting direction and 35 Newton in the forward direction. This diagonal direction of the linear force upon the top of the heel counter panel 301 area aids in lifting the heel of the shoe 300 toward the heel of the user, improving comfort and security of the shoe 300 against the foot while also driving plantar flexion motion.

Range of motion of top collar yoke lobe 304 is dependent upon maintaining position on the lower leg 311 and prevention of slumping down the leg. Provision of a surface for allowing top collar yoke lobe 304 to slide fore and aft in alignment with tension spring 302 without slumping down can be accomplished in many ways. For example, use of a sliding surface 317 (FIG. 10A). This sliding surface 317 allows fore and aft motion of top collar yoke lobe 304 while resisting downward motion by top collar yoke lobe 304.

User Adjustment of Spring Tension

This third aspect could be modified to also include adjustment features that enable a user to adjust the spring rate and laxity in shoe 300. For example, tension spring 302 shown in FIG. 10 can be passed through a length adjustment feature as may be known from the art of fabric webbing and straps found on backpacks and such. Tension spring 302 could also be adjusted by passing through a D-Ring 306 as shown in FIGS. 10D and 10E and then anchoring with a hook and loop anchor system as is common in footwear design. This would enable a user to adjust the initial spring laxity or tightness, thereby adjusting spring rate and complexion to meet their immediate needs.

Aspect 4

Diagonal Tension Spring to Hinged Yoke with Fore/Aft Laxity

Table of Reference Numerals:

Fourth shoe aspect 400 primary tension spring 401 supplemental tension spring 402
inferior anchor 403
heel counter 404
heel counter panel 405
collar of the shoe 406
eyelet 407
anterior gusset 408
posterior gusset 409
top collar yoke lobe 410
narrow channel of material 412
laces 414
flexible sock liner 415
tongue 416
stitching 417
eyestay 418
upper 420

FIG. 11 shows a fourth shoe aspect having an energy management system similar to that of the first aspect which will be further discussed with reference to FIG. 13, a shoe 400 having a diagonal tension spring system 401, 402. FIG. 11A shows an external side view while FIG. 11B shows a rear view of the same aspect. FIG. 11C shows a side view of a partial cutaway of the same aspect while 11D shows the rear view of the same shoe 400.

Figure 11A:
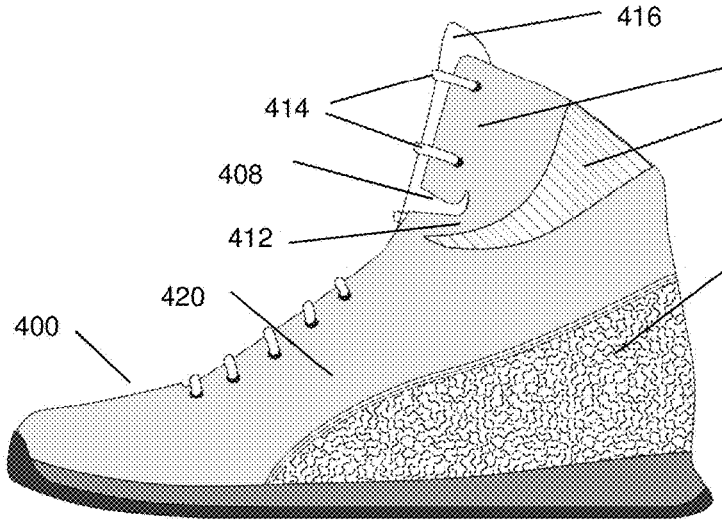
FIGS. 11A-D are views of another aspect of footwear, the aspect having a collar yoke and a combination of springs, in accordance with an aspect of the present disclosure.
Figure 11B:
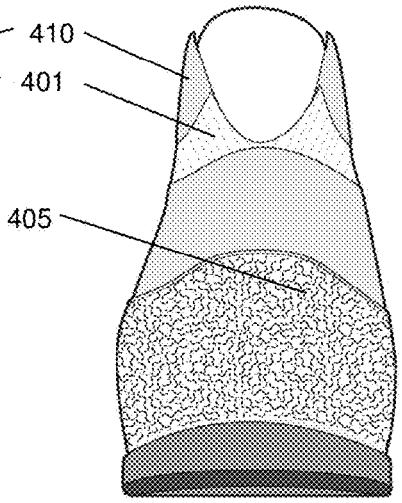
Figure 11C:
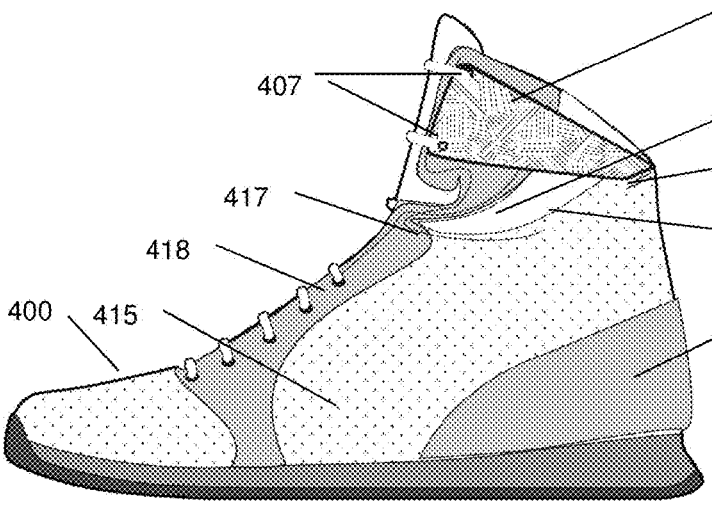
Figure 11D:
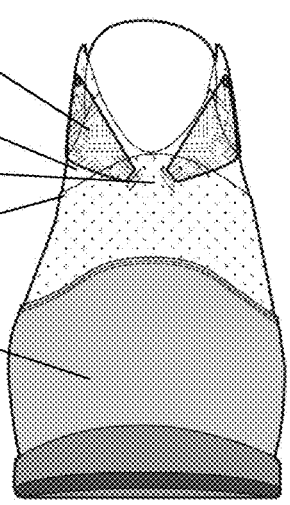

FIGS. 11A, 11B, 11C and 11D are drawings, for example, of a modified high top athletic shoe 400, with a shaped anterior gusset 408 and a posterior gusset 409 which divide the upper 420 such that a narrow channel of material 412 remains thereby creating a top collar yoke lobe 410 section of upper 420. Top collar yoke lobe 410 is capable of motion during use and is also connected to a collar 406 by at least one tension spring 401, 402 oriented diagonally. A diagonal tension spring system may include at least one of a primary tension spring 401 (FIGS. 11A and 11B) and supplemental tension spring 402 (FIGS. 11C and 11D). So spring 401 overlays spring 402. The primary tension spring 401 is made out of sheet material and has an inferior anchor along a collar of the shoe 406 and a superior anchor along the boundary surface of the high top collar yoke lobe 410 with the posterior gusset 409. The secondary tension spring 402 has an inferior anchor 403 above the top of a heel counter 404 and a superior anchor at a high top collar yoke lobe 410 by connection to eyelets 407. Inferior anchors can be fastened through any common means. Anchors may affix to internal layers such as flexible liner material 415, layered materials used in construction or outer surfaces such as upper 420.

Flexibility in the shoe 400 to allow forward rotation of the leg is enabled by distinction of the of the top collar yoke lobe 410 as a movable entity relative to the rest of the collar 406 by means of a shaped forward gusset 408 and a posterior gusset 409. The positioning of said gussets results in a narrow channel of material 412 that enables rotation in the top collar yoke lobe 410 as well as fore and aft laxity of motion. The tension springs 401 and 402 have primary force direction in linear tension and can manage forces between the top collar yoke lobe 410 and collar 406.

Lacing and Appearance

When the laces 414 are loose during use, top collar yoke lobe 410 is pulled by tension in tension springs 401 and 402 to a resting spot dictated by the pre-tensioning of springs 401, 402. Shoe 400 therefore does not suffer from negative aesthetic impact of appendages or ancillary equipment. Shoe 400 can thereby maintain appearance qualities similar to other high top athletic shoes and offer an opportunity for delivering appealing ornamental designs that engage and interest buyers.

To tighten shoe 400, the user may position his or her foot in the plantar flexed position (tip toe) and tighten shoe 400 as one would any other high top shoe. Upon returning to an upright stance, tension springs 401 and 402 stretch to reflect the increase in distance between top collar yoke lobe 410 and top of the inferior anchor 403 and collar 406.

Foam padding is commonly used in the construction of athletic shoes. It is assumed that a shoe designer would select an appropriate grade of foam padding to employ within the posterior gusset 409 space to maintain the appropriate comfort to the user. Padding would need to be able to compress and stretch across its planar dimensions to accommodate range of motion in the posterior gusset 409. This range of motion can be further accommodated by incisions across the foam surface to enable further stretch.

Function

In the gait cycle, the lengths of tension springs 401 and 402 expand during dorsiflexion motion and contract during plantar flexion motion. In this manner, tension springs 401 and 402 are able to contribute to an energy management of shoe 400. The tension springs 401 and 402 exert force against dorsiflexion thereby saving muscle exertion in the early phase of the gait cycle. The result of applying force over distance is that the work results in elastic potential energy being stored in tension springs 401 and 402. Later in the gait cycle as the ankle starts to extend towards plantar flexion, springs 401, 402 then exert force to support plantar flexion thereby saving muscle exertion in that phase of the gait cycle.

Dorsiflexion motion in the ankle leads to forward motion of the leg 411 relative to the ankle which applies force on the tongue 416, which applies force on the laces 414, which apply force on the top collar yoke lobe 410, which applies diagonal force on springs 401 and 402, which manage the energy and apply force on the inferior anchor 403 above the heel counter 404; thereby imparting an upward force on the heel of foot.

Depending upon the activity, such an energy management system can create a nominal range of motion of 2.5 cm or more across primary tension spring 401. Assuming that primary tension spring 401 has a spring rate of 20 Newtons/cm, an increase in length of 2.5 cm could provide 50 Newton of force at full extension. Assuming that the supplemental tension spring 402 has a spring rate of 10 Newtons/cm, an increase in length of 2.0 cm could provide an additional force of 20 Newton at full extension. The diagonal direction of the linear forces aids in lifting the heel of shoe 400 toward the heel of the user, improving comfort and security.

The resting length and spring rate of the two springs 401 and 402 can be tuned to provide non-tension spring rates that are advantageous to athletic activity. For example, the supplemental tension spring 402 could have a spring rate of 30 Newtons/cm, but have 1 cm of laxity prior to engagement. This would yield no increased spring force until more than 1 cm of bottom spring extension. At full extension of 2.0 cm, the spring would then provide an additional 30 N of force.

Reinforcement

Range of motion of the top collar yoke lobe 410 is dependent upon maintaining position on the lower leg and prevention of slumping down the leg. Stitching 417 is shown as one means of increasing the rigidity of an internal or external eyestay 418. Eyestay 418 is shown traversing to the midsole as a means to help resist downward motion along the top of the foot surface or slumping. In this fourth aspect, stitching 417 can improve the resilience and viability of the shoe's construction material—such as vinyl, fabric, leather, and the like. The stitching 417 can also be crossed, as shown, in an "X" shaped pattern in the area of narrow channel 412. The "X" shaped pattern allows for rotation across narrow channel 412 while minimizing deformation and wear from shear, tension or compression. Eyestay 418 may also be made more rigid by the addition of supplemental materials or stiffeners.

Forward Gusset Shape

The anterior gusset 408 has an upward facing component at an end pointing toward top collar yoke lobe 410. The boundaries of the anterior gusset 408 are created by the convergence of an outer radius emanating from a continuation of the gusset's lower edge which meets an inner radius emanating from a continuation of the gusset's upper edge. Such an upward facing removal of material is designed to facilitate a small amount of forward laxity of the top collar yoke lobe 410. While a straight-walled anterior gusset 408 with no upturn may enable rotation across narrow channel 412, such an anterior gusset may resist fore and aft motion of top collar yoke lobe 410. Shaping of anterior gusset 408 with an upward facing component provides laxity to enable a small amount of fore and aft motion of top collar yoke lobe 410 to follow the fore and aft range of motion of the leg associated with slide laxity in the ankle joint while minimizing resistance and extending the longevity of the narrow channel 412.

Aspect 5

Diagonal Tension and Stay System

Table of Reference Numerals:

- Fifth shoe aspect 500
- bi-directional springs 502
- inferior anchors along the bottom collar 504
- superior anchors along the top collar 505
- rotatable stays 506
- bottom collar 509
- top collar yoke 510
- leg 511
- bootie 512
- strap closure 515
- floating bootie 514

FIG. 12 shows a fifth shoe aspect, shoe 500. FIG. 12A shows an external side view while FIG. 12B shows a rear view of shoe 500. FIG. 12C shows a partial cutaway view of shoe 500 as does FIG. 12D which also includes a view of a user's leg 511 and the user's foot in a tight fitting bootie 512 of shoe 500.

FIGS. 12A, 12B, 12C and 12D are drawings of a modified high top athletic shoe 500, with bi-directional springs 502. One example of bi-directional springs is elastomeric sheet which offers spring force in both horizontal and vertical planes. Springs 502 have an inferior anchor along the bottom collar 504 and a superior anchor along the top collar 505.

Flexibility in shoe 500 to allow forward rotation of the leg 511 is enabled by separation of the top collar yoke 510 away from bottom collar 509 by means of rotatable stays 506. By rotatable stays is intended the ability to assist rotation of the leg 511 during locomotion. Rotatable stays 506 have inferior anchors along the bottom collar 504 and superior anchors along the top collar 505. Rotatable stays 506 may be fastened to their anchor points in a variety of ways, such as stitching or through resting in a sewn pocket, or other means. Rotatable stays 506 may be integral with the springs 502 or may be positioned adjacent.

In the gait cycle, the position of top collar yoke 510 relative to bottom collar 509 moves forward in dorsiflexion and rearward in plantar flexion. Biasing the geometric resting angle of the rotatable stays 506, one can create a vertical motion relative to the horizontal motion. By rotatable, it is intended that each rotatable stay 506 creates a three bar linkage, where the top collar yoke 510 represents one bar, the rotatable stays 506 represent one bar and the bottom collar 509 represent one bar. During the gait cycle, the top collar yoke 510 moves fore and aft relative to the bottom collar 509. This fore and aft motion results in a change in rotation angle of the stay relative to the top collar yoke 510 and bottom collar 509. Using geometric principles, one can establish a starting angle and length of the rotatable stays 506 and thereby create a motion tangential to the fore aft motion which can either create more or less distance between the top collar yoke 510 and bottom collar 509.

Figure 12A:
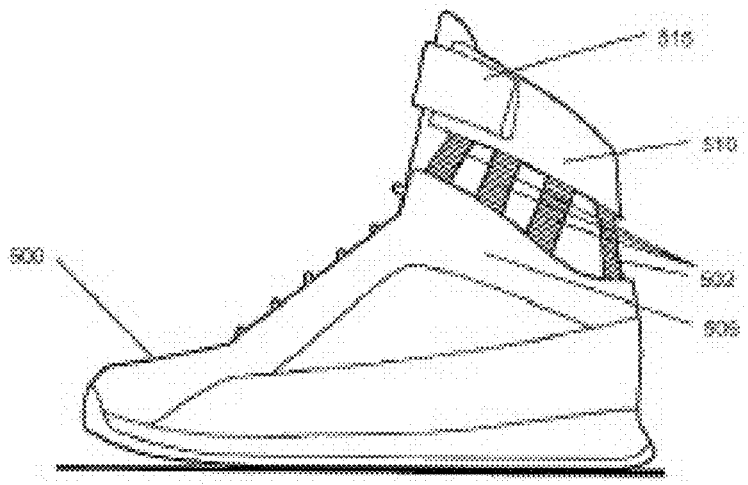
FIGS. 12A-D are views of yet another aspect of footwear, the aspect having a top collar and stay arrangement, in accordance with an aspect of the present disclosure.
Figure 12B:
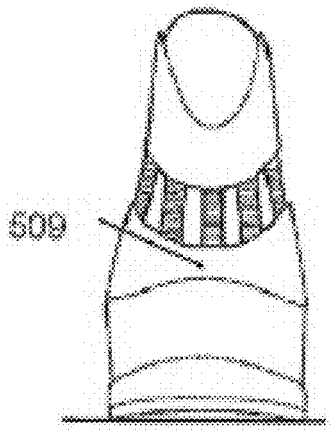
Figure 12C:
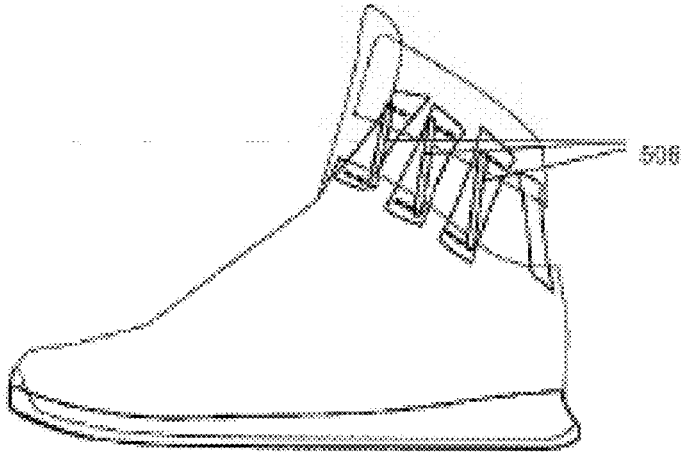

When rotatable stays 506 are oriented in a forward-canted angle at rest, as shown in FIG. 12C, forward motion of the top collar yoke 510 results in a reduction in gap between the top collar yoke 510 and bottom collar 509. This reduction in distance between collars pulls the heel of shoe 500 up relative to the top collar yoke 510 as it moves forward during dorsiflexion. By having the top collar yoke 510 place downward force on the front of leg 511 as well as the sides of the lower leg 511 through the malleolus ankle bulge, the energy management system of shoe 500 can place an equal and opposite lifting force on the bottom rear of the foot to drive the user towards plantar flexion.

Depending upon the activity, such a system can create a forward range of motion of 2 cm or more in top collar yoke 510 relative to bottom collar 509, and a vertical range of motion of 0.4 cm or more in the gap between top collar yoke 510 relative to bottom collar 509.

The aspect in FIG. 12 also may include an internal slipper-type of liner known in the industry as a bootie 512. Booties are alternative means of providing comfortable liners. In shoe 500, the heel area of bootie 512 may be connected to top collar yoke 510.

Figure 12D:
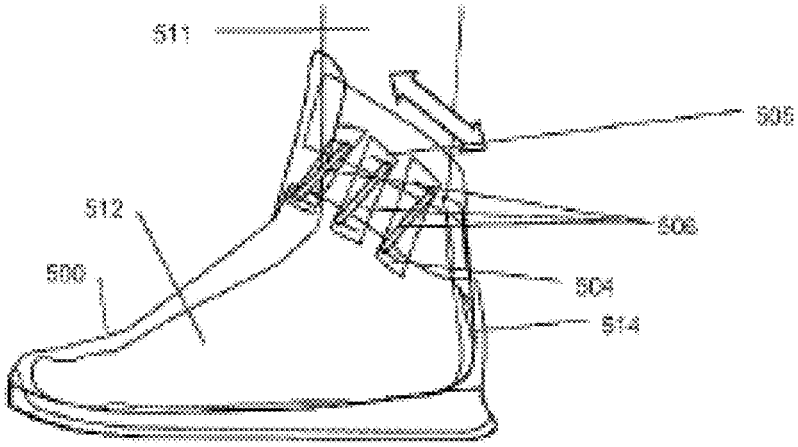

When stays 506 are oriented in a rearward canted angle at rest, as shown in FIG. 12D, forward motion of top collar yoke 510 results in an increase in gap between the top collar yoke 510 and bottom collar 509. This increase in distance between collars pulls the heel of bootie 512 up relative to shoe 500 during dorsiflexion. By having top collar yoke 510 place upward force on the foot through the bootie 512, the system can place an equal and opposite lifting force on the bottom rear of the foot to drive the user towards plantar flexion.

Depending upon the activity, such a system can create a forward range of motion of 2 cm or more in the top collar yoke 510 relative to the bottom collar 509, and a vertical range of motion of 0.3 cm or more in lifting the bootie 512.

Aspect 6

Open Yoke Vertical Spring Sandal

Table of Reference Numerals:

- Sixth aspect—shoe 600 in the form of a sandal
- outsole 601
- footbed 602
- elastic member 603
- inferior elastic anchor 604
- superior elastic anchor 605
- forward strap stanchion 606
- aft strap stanchion 607 foot strap 608
front ankle strap 609
rear ankle strap 610
yoke side 611
yoke pivot 612
leg strap pivot 613
leg strap 614
aft strap stanchion stiffeners 615
yoke stiffeners 616

Figure 14:
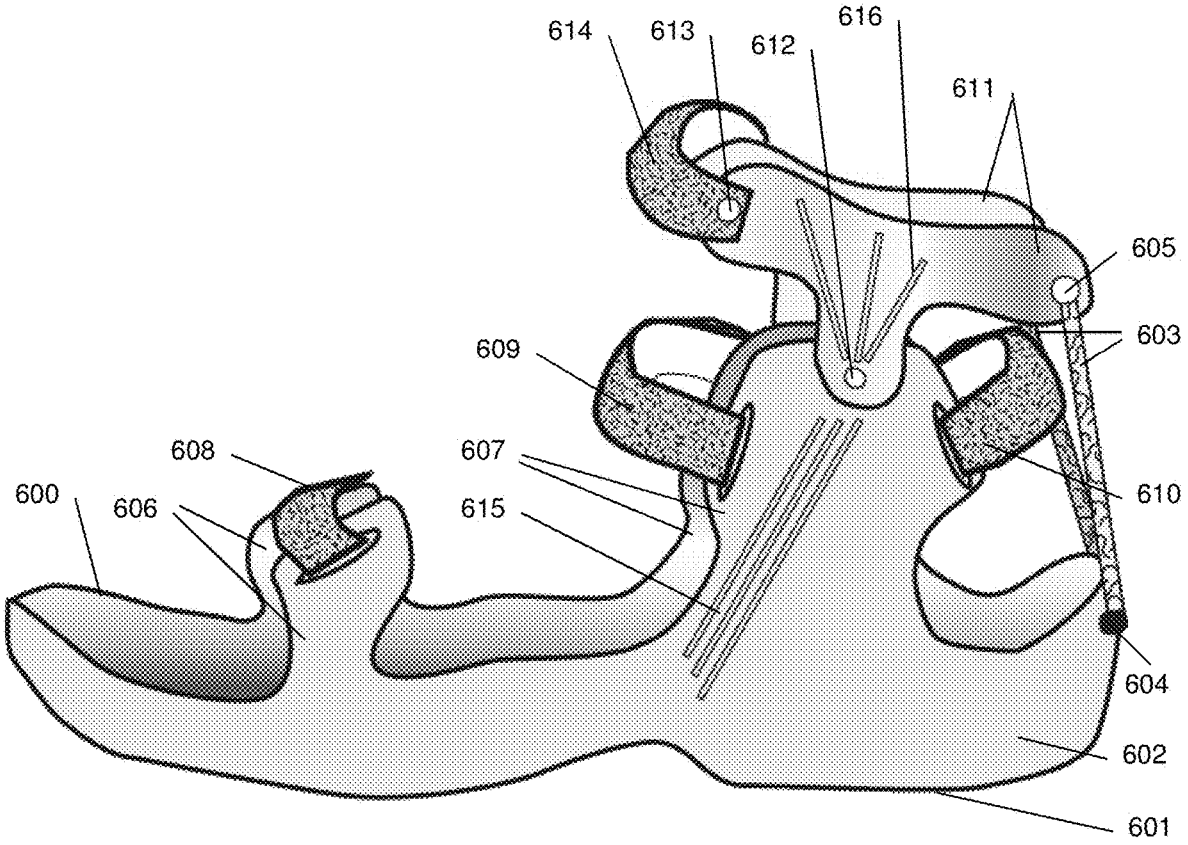
FIG. 14 shows another footwear aspect in the form of a sandal with an open yoke, in accordance with an aspect of the present disclosure.

FIG. 14 shows an external side view of sixth aspect, sandal 600. FIG. 14 is a drawing of a modified sandal 600, with an open yoke system that transfers force from a leg over a pivot to a spring.

The foot is held to the sandal 600 by way of sandal straps, which include a foot strap 608, front ankle strap 609 and rear ankle strap 610. The foot strap 608 is anchored to the sandal 600 by a forward strap stanchion 606. Ankle straps 609, 610 are anchored to shoe 600 by an aft strap stanchion 607. The configuration of straps described here is only one of many configurations possible in sandal design. People with knowledge of the art may configure other strap systems for the traditional elements of the sandal in ways that fit their application.

Force is received from the lower leg into a leg strap 614. The leg strap 614 is an element of a yoke and is rotatably anchored to a yoke side 611 through a leg strap pivot 613. A purpose of leg strap pivot 613 is to enable sufficient rotation of leg strap 614 to enable leg strap 614 to lie flat against the user's lower leg, distributing pressure evenly and reducing possibilities of pressure points and chaffing.

Flexibility in the sandal 600 to allow forward rotation of the leg in dorsiflexion is enabled by allowing yoke sides 611 to rotate. Rotation is enabled by a yoke pivot 612 which rotatably connects each yoke side 611 to an aft strap stanchion 607.

A superior elastic anchor 605 connects a yoke side 611 to an elastic member 603. The elastic member 603 may be made of a variety of elastic materials, for example rubber, silicone, thermoplastics, urethanes, etc and may be in a variety of shapes, such as round cord, flat cord, sheet or other shapes depending on the design. Elastic member 603 may be of an off the shelf material such as a bungee cord, or it may be custom shaped (ie: molded) for the application. Elastic member 603 may include two or more separate elements (two shown) or may comprise a singular element that is divided at the top (for example, Y shape) to enable connection to the medial and lateral yoke sides 611 via the superior elastic anchors 605. Elastic member 603 may also be shaped, for example, through the use of a molded elastomeric component cast into a "Y" shape.

Aft Stanchion

The aft strap stanchion 607 of sandal 600 will be taller than in typical sandal applications. This additional height provides an ability to elevate yoke pivot 612 to a location that is closer to an axis of rotation of the ankle during use. To be clear, the elevation of a yoke pivot 612 on the medial side may be higher than a yoke pivot 612 on the lateral side to help keep the axis of yoke rotation similar to the axis of ankle rotation.

To help manage forces in the aft strap stanchion 607, further reinforcement may be necessary. The aft strap stanchion 607 may be reinforced in a variety of ways, by judicious choice of materials, layers and thicknesses or by addition of supplemental aft stanchion stiffeners 615. These stiffeners may be of same or different materials as the aft strap stanchion 607.

Function

Force from the front of the user's lower leg is transmitted into leg strap 614, which is transmitted into leg strap pivot 613, which is transmitted into yoke side 611 during locomotion. With the benefit of yoke pivot 612, the yoke 614, 611 rotates to transfer force into the superior elastic anchor 605, which is transmitted into elastic member 603, which is transmitted into inferior elastic anchor 604, which is transmitted into footbed 602 and thereby into the heel area of the foot. Components are described as independent elements herein, but may be constructed in various other ways known to a design in the sandal arts. For example the yoke sides 611 may incorporate a leg strap 614 and be one contiguous object which has sufficient flexibility in the strap area to obviate the need for a yoke pivot 612.

Fold-Away

As with the other rotating aspects described herein, sandal 600 stores potential energy during dorsiflexion and returns it during plantar flexion. Yoke sides 611 and leg strap 614 may be rotated aft and worn behind or under the foot when support from elastic member 603 is not desired.

Spring Adjustment

As with other aspects, spring 603 may be tuned to various applications and also adjusted by the user to suit the user's needs. Elastic member 603 may be anchored to the yoke side 611 by a variety of means, including hook and loop fasteners, buckles, adjustable straps and the like.

Application of the Aspect in Various Environments

Sandals are used worldwide for a wide variety of applications. Sandals are often used in many lower income areas as a low cost footwear alternative. Many people, especially people of limited income, rely upon walking as their primary means of mobility. The ability of a sandal to offer improved gait performance can translate to an easier experience of walking, especially when one is relying upon walking as their primary means of mobility.

A person who weighs 600 N and who uses a sandal as disclosed herein with a 30N/cm spring rate may experience approximately 3 to 8% of ankle forces externalized out of their body and into the sandal during their gait. This assistance can facilitate mobility and dynamically offset the weight of a load carried by the user. For people who rely on walking for mobility, this can be a distinct advantage.

Application of an Open Yoke System in Other Footwear

This same type of open yoke energy management system may also be employed in closed shoes, such as running shoes or tennis shoes which are traditionally not sold as high tops. In the sandal aspect, the yoke 614, 611 is supported by a yoke pivot 612 into an aft strap stanchion 607. In a closed shoe such as a tennis shoe or running shoe, yoke sides 611 could be attached via a pivot into a sidewall of the upper of the shoe. The shoe may need to have additional support within its sidewall to prevent slumping or buckling.

When used in such shoes, their sidewall and upper may be supported by additional caging, by tension bearing stitching between the eyelets and the midsole, by the inclusion of stiffeners such as employed in heel counters, by adding additional layers of upper material, by extending the arch support or shank up the sidewall to behave as a stanchion, to incorporate a stanchion via a molded overlay on the outside of the upper, or related design methodology. By encasing a support member between the interior comfort layer of a shoe and the exterior surface of a shoe, one can restrict motion of the support member. Such an approach may be termed hoop banding force. Such hoop banding force may be supplied by orienting shoe laces and tension elements between the laces and other laces and between laces and the sole such that sagging of the support member is limited.

The vertical reach of open yoke system may vary according to application. For applications which require minimal force, the open yoke system may be created with minimal height sufficient only to avoid interference with the foot and any chaffing discomfort. For applications which require higher forces, the open yoke system may be extended to a significantly higher height to increase leverage and reduce the amount of force applied into the shin.

Aspect 7

Tan Boots Having a Cantilevered Yoke

Table of Reference Numerals:

Seventh shoe aspect 700 in the form of a boot
outsole 701
heel counter panel 702
lower collar 703
elastic sheet 704
collar yoke cantilever 705
cantilever support 706
leg collar 707
upper eye stay 708
anterior gusset 709
eyelets 710
quarter panel 711
lower eye stay 712
toe box 713
elastomeric material 714
heel counter 715
yoke reinforcement 716
cantilever reinforcement 717
sock liner and padding system 718
upper eye stay reinforcement 719
lower eye stay reinforcement 720
structural toe protector 721
ventilation hole 730
interface 731
integrated heel counter 732
radial reinforcement pattern 733
circumferential reinforcement pattern 734
eyestay integration 735

FIG. 15 shows side views of a seventh aspect of a shoe, boot 700. FIG. 15 is a drawing, for example, of a modified military boot 700, with a collar yoke cantilever system that transfers force from a leg over a pivot to an elastic spring system.

Figure 15A:
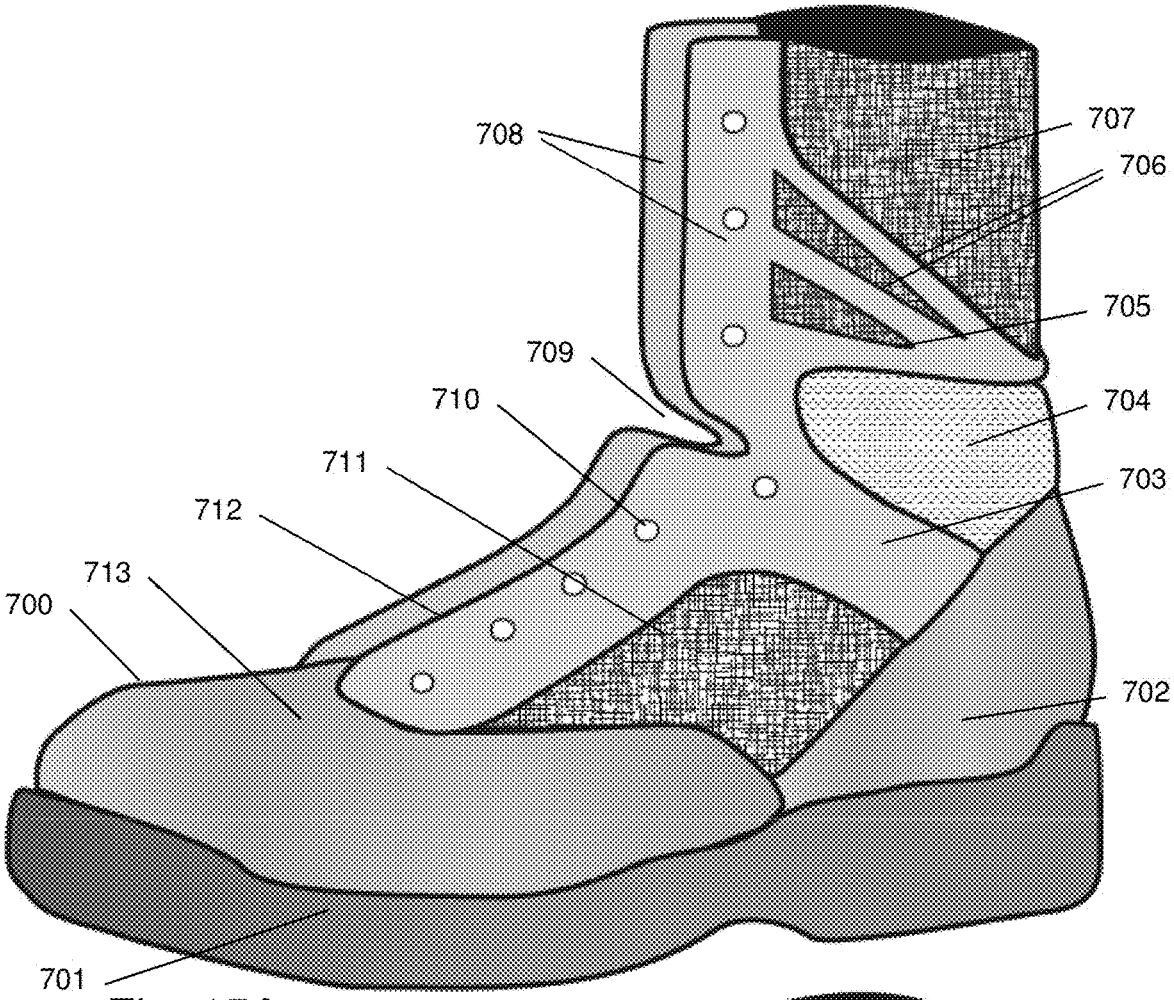
FIGS. 15A-D are views of another footwear aspect in the form of a boot with a collar yoke cantilever, in accordance with an aspect of the present disclosure.
Figure 15B:
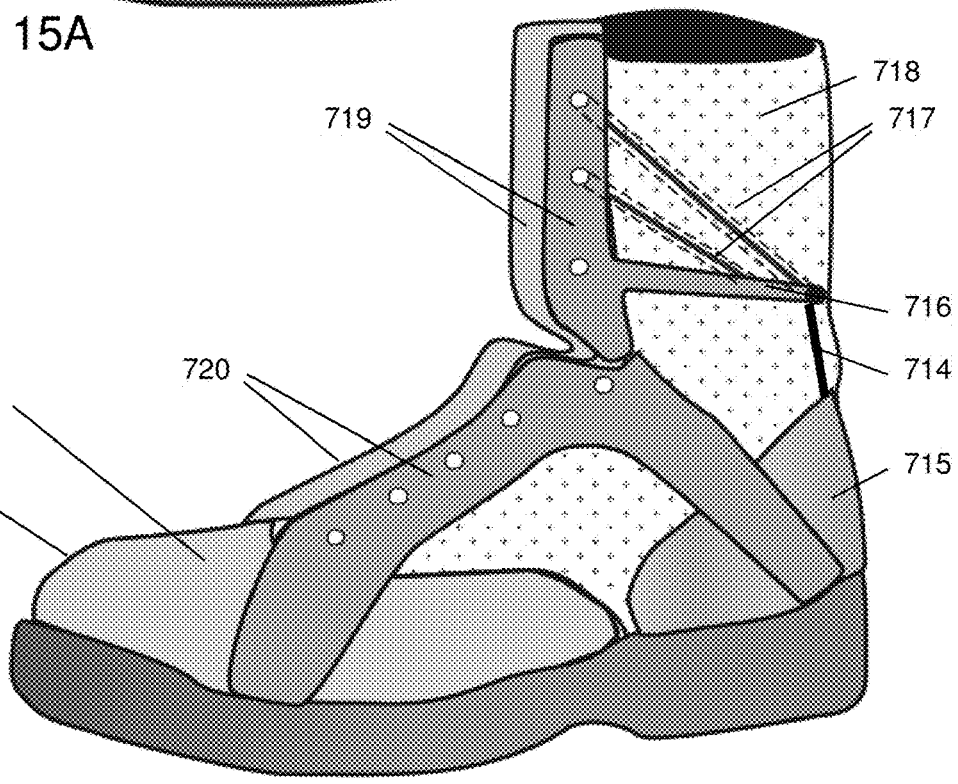

FIG. 15A is an external side view of the aspect, and FIG. 15B is a side view of the same aspect with external layers removed to enable viewing of internal construction layers.

Figure 15C:
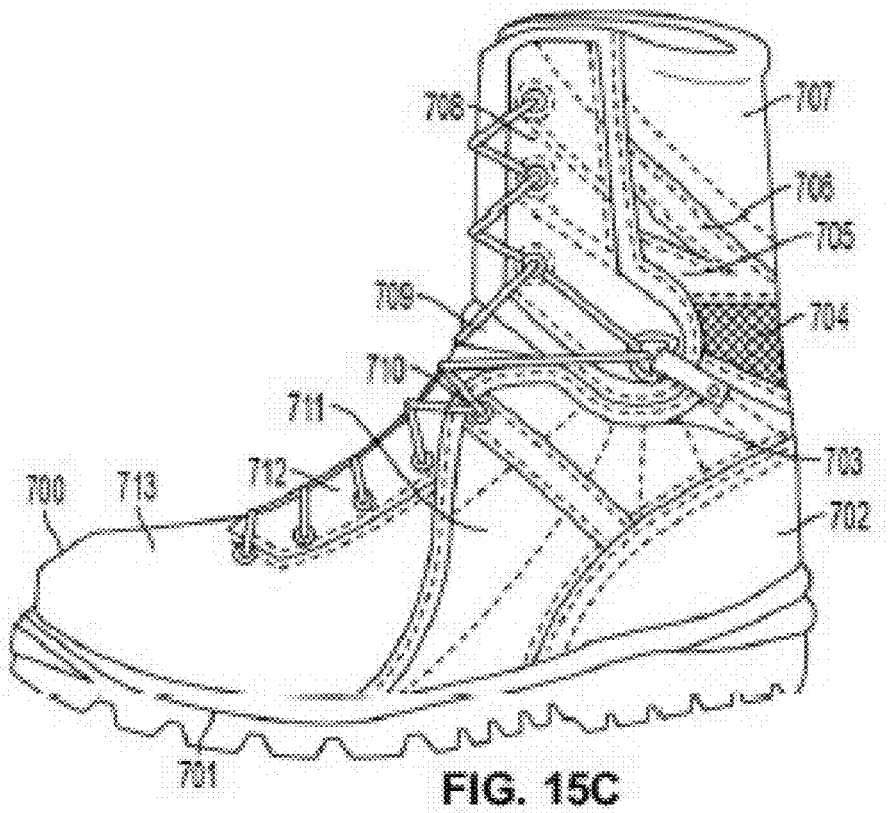
Figure 15D:
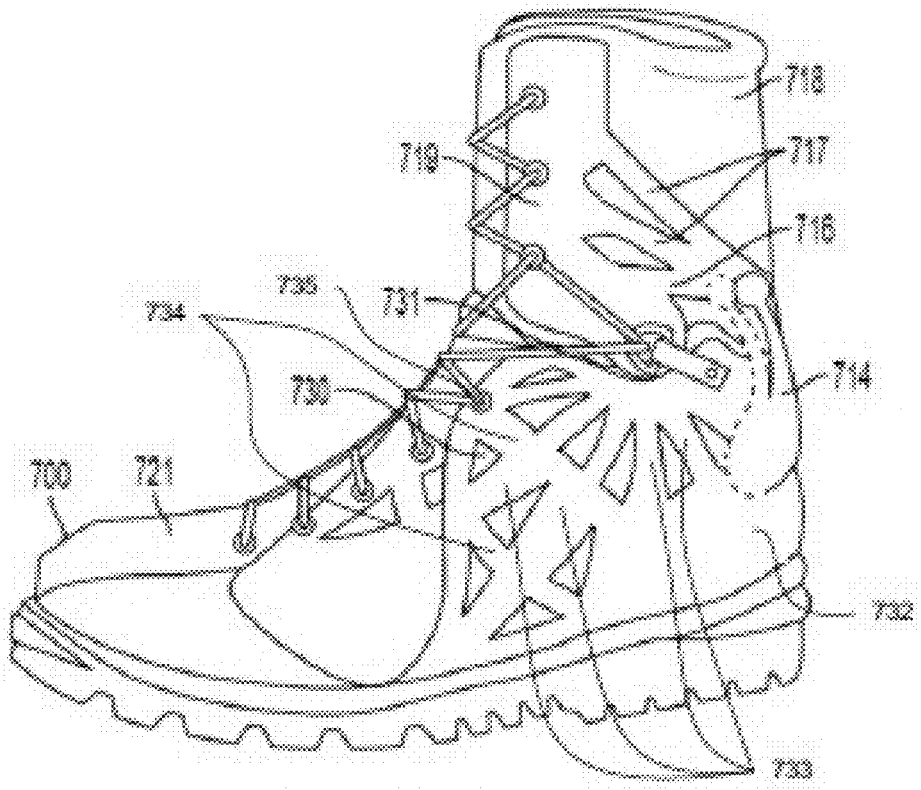

FIG. 15C is another rendering of an external side view of an aspect, and FIG. 15D is a side view of the same aspect depicted in FIG. 15C with external layers removed to enable viewing of internal construction members.

Boot 700 has been modified to enable a variety of elastic spring combinations to be deployed in a manner that is consistent with various design and aesthetic constraints. For example, military boot standards typically require adherence with a code for uniforms. These codes often limit the addition of any additional nontraditional appendages to the exterior surface of the boot. For example, the use of metal hooks, buckles or appendages may be limited, deviation from color specifications may be limited and so on. Boot 700 as depicted and described herein enables integration of force management approaches which may enable boot 700 to remain within various uniform codes.

Many boots have similar designs to high top athletic shoes, especially hiking boots and other configurations such as law enforcement boots and boots worn by safety personnel. This enables boot 700 to practice principles of design of earlier-described aspects to incorporate an energy management system as described above as well as vice-versa.

A challenge with certain tall boots, including military boots constructed for warm weather or light weight boots, is that the portion of the collar which wraps the lower leg is often made of a low rigidity woven material, often as thin as a single ply canvas, woven nylon, duck fabric or similar. Adding additional materials to supply rigidity to the collar to enable a collar yoke as described in earlier aspects may not be optimal in such boots. Moreover, in order to maintain practicality, designs should enable the collar to release heat and moisture and maintain warm weather comfort.

In boot 700, a technique is shown if FIG. 15 that enables the collar to continue use of low rigidity canvas type materials for warm weather applications and still benefit from integration of other aspects of this disclosure.

Referring to FIG. 15, boot 700 includes an anterior gusset 709 that interrupts a lower eye stay 712 from an upper eye stay 708. The upper eye stay 708 is designed to have significant rigidity to enable it to support a collar yoke cantilever 705. Similarly to a sail boat where the mast supports a boom, the upper eye stay 708 is able to support a collar yoke cantilever 705 with the assistance of at least one cantilever support 706. Cantilever support 706 acts in tension to help connect the collar yoke cantilever 705 with the upper part of the upper eyestay 708. Alignment with eyelets 710 allows the cantilever supports 706 to position their superior anchors to receive further support under tension.

Boot 700 may have two eyestays, upper 708 and lower 712. Collar yoke cantilever 705 and cantilever supports 706 may be all cut from the same blank and be contiguous. Typical materials for boot construction include leather and heavy vinyl sheet among other materials. If these materials are not sufficient to maintain proper shape, these components may be reinforced. An under-layer of supportive material may be added. The upper eye stay 708 may be reinforced by an upper eyestay reinforcement 719. Lower eyestay 712 may be reinforced by a lower eyestay reinforcement 720. Collar yoke cantilever 705 may be reinforced by a collar yoke reinforcement 716. Such reinforcement may include the use of materials such as plastic sheet, carbon fiber, leather, and other materials familiar in the art. Stitching between layers of elements may add further strength. These elements are shown in FIG. 15B and FIG. 15D on top of the boot's sock liner and padding system 718 which is presumed to be able to stretch as needed. FIG. 15D is a cutaway view of an aspect of the present disclosure.

Spring Rates

In this system, the collar yoke cantilever 705 can suspend a variety of elastic systems. Elastic sheet material 704 can be anchored below the collar yoke cantilever 705 and above the foot collar 703 and heel counter panel 702 defining at least one elastic member. The elastic sheet material 704 may include a variety of woven elastic fabrics, nonwoven elastic fabrics, fabrics with single and multiple directions of stretch, sheet materials, and others. Elastic sheet material 704 can displace the typical canvas upper material in this area, saving also the cost and weight of the typical material and keeping material costs lower as well as keeping any weight increases lower. Also, the elastic sheet material can be used in combination with an external material that has sufficient aesthetic, stretch and protective qualities but insufficient spring rate to enable desired force. Elastic force potential may also be integrated into an area of the sock liner and padding system 718. Sock liner and padding systems need to accommodate the range of motion in proximity to the rear gusset. This may be accomplished in several ways, for example, by gathering sections of linier and bonding elastic material thereto or removing a section of traditional liner material or displacing traditional materials with stretchable material, especially in the gusset areas.

The spring rate of the elastic sheet material 704 may provide the entire elastic function of the system. In another configuration, the force of the elastic sheet material 704 may be augmented or replaced by a supplemental layer of elastomeric material 714 in either a sheet, cord, molded, or other custom shaped configuration. In yet another configuration, elastic sheet material 704 may be augmented or replaced by a powered system that imparts a compressive force that supplements the available force and power of a passive spring system alone. Such a powered system could include a motor, cable, solenoid, artificial muscle, pneumatic, hydraulic, combustion based solution in series or parallel with spring elements.

User Adjustable Spring Rates

In another variation, the supplemental layer of elastomeric material 714 may be adjusted by the user upon demand. By providing at least one user controllable internal anchor, a user can engage a supplemental layer of elastomeric material 714 upon the collar yoke cantilever 705. Snaps, buttons, hook and eye, hook and loop are all methods of enabling adjustable tension on a supplemental layer of elastomeric material 714 within the boot.

One approach to engaging the supplemental layer of elastomeric material 714 is to have the material be anchored near the bottom of a heel counter, behind the heel counter away from contact with the skin. A connector such as a length of shoe lace material may be affixed to the top of the supplemental layer of elastomeric material 714. This length of shoe lace would be of similar aesthetic uniform design but not be contiguous with the main lace used for tightening the boot. This connector lace could be guided past the collar yoke cantilever 705 and adjacent to a cantilever support 706 to an eyelet 710, out one eyelet 710, along the outside face of an upper eyestay 708 and back into another eyelet 710, down adjacent to another cantilever support 706, past the collar yoke cantilever 705 to the same or separate supplemental layer of elastomeric material 714. In this way, the connector lace would lay flat against upper eyestay 708 when the supplemental layer of elastomeric material 714 is gently engaged, and could be pulled tight to a plastic hook on the opposite side eyestay 708 to more fully engage the supplemental layer of elastomeric material 714. In this way, the engagement of the supplemental layer of elastomeric material 714 would be controlled by a connector lace and plastic hook of similar appearance to the main lace and plastic hooks of boot 700, without need for supplemental knots, fasteners and the like. This configuration continues the principles of an energy management system herein that further support integration within footwear and conformity with required aesthetic limitations.

In applications without uniform regulations which prohibit external appendages, a number of other mechanisms may be employed to allow the user to control and adjust the spring tension. For example, cam lock systems, adjustment screws, tuning screws similar to those on guitars and the like may be used.

Reinforcement and Rotation

In all of these variations of boot 700, the upper eyestay 708 will experience a downward force when the elastic system is engaged. To resist slumping down the leg, especially in hot weather boots and other with fabric collars, the upper eyestay 708 may be supported by the lower eyestay 712 as well as the foot collar 703. These are shown in one contiguous material in FIG. 15A which depicts an outer layer of materials, such as leather. This contiguous element can be further reinforced by the upper eyestay reinforcement 719 and the foot collar reinforcement 720 which anchors the unit to the sole (FIG. 15B). These reinforcements are shown non-contiguous, with mating surfaces that resemble a ball joint. The point of rotation is designed to be aft of the anterior gusset 709 to move it close to the ankle joint. In this aspect foot collar reinforcement 720 passes over the heel counter 715 as well as the structural toe protector 721, but may be incorporated with either. Said reinforcement elements, in a preferred aspect are designed integral within footwear between inner materials such as sock liners and padding and outer layers such as leather uppers. Said reinforcement elements, by virtue of their strength and anchoring to the sole provides the upper eye stay 708 with support to prevent sliding down the ankle as well as a favorable rotation point for driving necessary spring performance. Heel counter 715 may incorporate reinforcements as shown in integrated heel counter 732. Integrated heel counter 732 includes ventilation holes 730. Integrated heel counter shows how the heel cup as an integrated unit with the reinforcement elements, it must carry the necessary forces while resisting deformation. Integrated heel counter 732 provides an interface zone 731. Such an interface zone ideally allows for rotation of the ankle, together with fore/aft laxity to resemble the actual ankle degrees of freedom, for example by allowing the 'ball' member to have a smaller radius than the 'socket' member. The interface is shown with the center of the shared radius above the interface as a means of providing additional support to the ankle yoke. The center of the shared radius may also be below the interface to more closely resemble the ankle joint and mortise. Integrated heel counter 732 ensures that ventilation holes 730 are oriented so that they preserve key aspects of strength. Ventilation holes 730 are arranged to enable integrated heel counter 732 to maintain a radial reinforcement pattern 733 that can bear forces emanating from the collar yoke, into interface zone 731 and transmit said forces through the mid sole and sole into the ground. Such arrangement helps resist slumping of the sidewall of the article of footwear when under a compressive load. Ventilation holes 730 are also arranged to enable integrated heel counter 732 to maintain a circumferential reinforcement pattern 734 that can assist in managing forces that augment the stability of integrated heel counter 732. Such a circumferential reinforcement pattern 734 can be integrated with eyelet holes 735 or an eyestay.

Circumferential forces, also described in this application as "hoop banding" is a means of gaining additional benefit from maintaining a tensile load from the lacing towards the sole and heel. This tensile force acts like a band around a wooden barrel, and thereby counteracts the tendency of integrated heel counter 732 to slump while under load. Tensile force may be carried through the circumferential reinforcement pattern of the integrated heel counter 732, or through other materials outside of integrated heel counter 732. Integrated heel counter 732 may be designed to prevent said circumferential forces from placing undue force on the top of the foot, for example by selecting materials that resist this impingement under load, or by allowing the lateral and medial sides of the integrated heel counter to be oriented such that they abut each other (directly or through an intermediate object) when the laces are tightened. As forces upon interface zone 731 increase, there is an increased tendency to slump, and the material chosen for integrated heel counter 732 will be selected based upon the forecasted demands that will be placed upon that footwear, for example, lighter duty application may be supported by plastic type materials while more intense applications may be supported by composite type materials. Integrated heel counter 732 is shown in this aspect, but may be employed in other footwear aspects discussed in the aspects herein and beyond.

Integration of Collar Yoke

Together with the integrated heel counter 732 confers the benefits of a hinged ankle brace to the ankle/foot area. Because collar yoke and integrated heel counter 732 are integrated within the layers of the footwear, they receive the benefit of comfort conferred by padding and sock liner. As compared to wearing a brace on the foot inside the shoe, said comfort is realized through the benefit of separating the structural elements of the endoskeleton behind the sock liner and padding. This separation helps reduce irritation, friction, impingement, pressure points, heat build-up, moisture buildup and other factors that conduce towards discomfort. Yet another benefit of this integration is improved aesthetics—as the support elements may be incorporated without being apparent to the outside world. Yet another benefit of this integration is to overcome the need for a wearer to purchase a footwear that is larger than normally used, to allow room for a brace.

As an alternative to a typical hinged ankle brace, integration of elastomeric material 714 confers the benefit of maintaining a baseline pressure on the footwear, maintaining closer contact of the heel of the foot to the inside heel of the footwear thereby reducing opportunities for misalignment and discomfort.

The result is that the solution is appropriate for people who wish to protect their ankles from untoward forces to the ankle. This is beneficial to those wishing to gain a prophylaxis from primary injury, to find support during recuperation from an earlier injury, or to help prevent re-injury. The improved comfort, potential for metabolic performance improvement and ease of use, are hypothesized to overcome multiple reasons for not wearing an ankle brace. Improving compliance with ankle bracing provides a population based benefit by making it easier for more people to gain the benefits of bracing more frequently without the need for a separate brace and its associated discomfort and inconvenience.

Stitching for Rotation

The stitching of the eyestays 708, 712 may be altered in the vicinity of desired rotation. Eyestays are typically stitched to the upper on their fore and aft sides. This may be altered in the rotation area, for example, by switching from straight stitching on the fore and aft sides to zig zag stitching in the rotation area to enable some laxity in the leather while in the rotation area. Or, the straight stitching from the fore side of the upper eyestay 708 may be crossed over the mid of the eyestays in the rotation area, and similarly the fore side stitching of the lower eyestay 712 may be crossed over the mid of the eyestays in the rotation area. These two intersecting straight stitches would then create an "X" at the center of desired rotation area. Even without crossing over, stitching may be configured in an "X" pattern or even a multi-point star pattern as found in an asterisk of various legs. Another pattern might include a vertical "U" shaped series of stitching that intersects with an inverted "U" shaped series of stitching. Woven or non-woven materials may be gathered and applied to external surface of the boot to provide improved strength and longevity across multiple flex cycles.

Applications of the Aspect

People wear boots with different vocational requirements than sneakers. Often, this means that the same pair of boots is worn for extended hours for repeated days. Boots are exposed to harsh terrain and a broad variety of outdoor climates. Military troops are often given a small yearly stipend of money that is used towards the purchase of boots, resulting in the demand for low cost boots which may lack higher priced features such as glove leather linings. New boots are often considered stiff and this stiffness results in significant motion of the foot within the boot during the gait cycle, as the foot tends to flex while the boot does not. This is further exacerbated when boots are purchased that do not have the desired fit to the user's foot. This lack of flexibility and comfort features can lead to the formation of unwanted blisters, calluses and sore spots.

Boots are typically worn as a primary piece of footwear across multiple activities. These activities may include low impact activity such as meal preparation or warehouse work for much of the day, interspersed with infrequent bursts of high impact activity such as running, jogging or marching.

The anterior and posterior gussets of boot 700 provide better range of motion of the boot when new. This allows the high collar of boot 700 to rotate evenly with the lower leg and the main part of the boot to stay stationary relative to the foot. This reduces unwanted motion and friction between the foot/leg and boot 700 and improves comfort.

The elastic sheet material can provide primary tension spring performance that supplies a low baseline of spring rate action. This low spring rate has the capability to pull the heel of the boot close to the heel of the foot, similar to a pair of suspenders. This reduces movement between the heel of the boot and heel of the foot, which is a primary cause of friction that leads to blistering and pain, thereby reducing the tendency towards blistering.

The primary tension spring force from the elastic sheet material also provides a low baseline of active support to the ankle system, thereby externalizing some tendon and muscle force outside the body and into the boot. This small benefit may accrue over a full day of use of the boots to reduce fatigue.

The supplemental tension spring force may be engaged when desired. For example, if the user is preparing for a hike or a march, the supplemental tension spring could be engaged prior to the start of the activity and released upon its conclusion. Thus, the performance benefits of the supplemental tension spring would be available on demand without requiring the user to have it engaged throughout the entire day. This can be beneficial when carrying backpacks and materiel. Each additional Newton of materiel translates to a corresponding increase on Achilles tendon force, typically cited as 1.2 to 3.0 depending upon activity & gait. A backpack weighing 270 Newton (~60 pounds) will require additional exertion by the wearer carrying it. Using aspects of this disclosure with a spring rate of 30 N/cm, could offset 8 to 20% of the force of the pack upon the Achilles, thus delivering a significant dynamic weight reduction (dynamic reduction of 4 to 12 pounds) with a minimum addition of weight or cost to the boots.

The geometry of such a system enables it to transform some of the work into electrical current which can be stored or used as it is generated. For example, an elastic member may include a coaxial device that enables generation of electric current as the elastic element is stretched and or released. A variety of small power harvesting mechanisms may be employed, examples comprise but are not limited to solenoids, coils, piezoelectrics, micro-electric generator systems, reciprocating members to drive alternators, and the like.

More aggressive performance characteristics could be realized by the integration of high performance supplemental support systems. While boot manufacturing practices often use plastic sheet for heel counter reinforcement, it is also known that stamped metal pieces are common for use in steel toes and metal shanks. High performance plastics, fiberglass and carbon fiber are also known in high performance boot applications such as cold weather boots. As such, manufacturers familiar with such materials may choose to offer a boot with high strength reinforcements that would enable a more aggressive primary or secondary spring rate to be used.

Novel concepts described in this aspect of boot 700 may be adopted into other types of footwear, especially athletic shoes, trail running shoes, low hiking boots, etc. For example, in FIG. 7B variations of the collar yoke cantilever and adjustability mechanisms are shown. Variation of a collar yoke cantilever stiffener 139 is shown as an example of how these techniques described for application in boots can be adopted into athletic footwear. Similarly, concepts from earlier aspects can be applied into the boot category.

Other aspects of footwear may come to the mind of one of ordinary skill in the art of footwear design through an understanding of the principles of the structural elements of an energy management system as described herein. Further variations than those described above are within the appreciation of one skilled in the arts and such variations are to be considered within the scope of the claims which follow.

Aspect 8

Detachable Lower Limb Yoke

Table of Reference Numerals:

- Boot and yoke extension 800
- Footwear with receptacle 801
- Anterior gusset 802
- Posterior gusset 803
- Receptacle for yoke extension leg 804
- Yoke extension 805
- Vent holes 806
- Tension adjusting mechanism 807
- Connector 808
- Interface between connector and elastic member 809
- Elastic member 810
- Interface between elastic member and fastener 811
- Male fastener 812
- Female fastener 813
- Yoke extension leg 814
- Front face 815
- Rear face 816
- Collar yoke 817

Figure 16A:
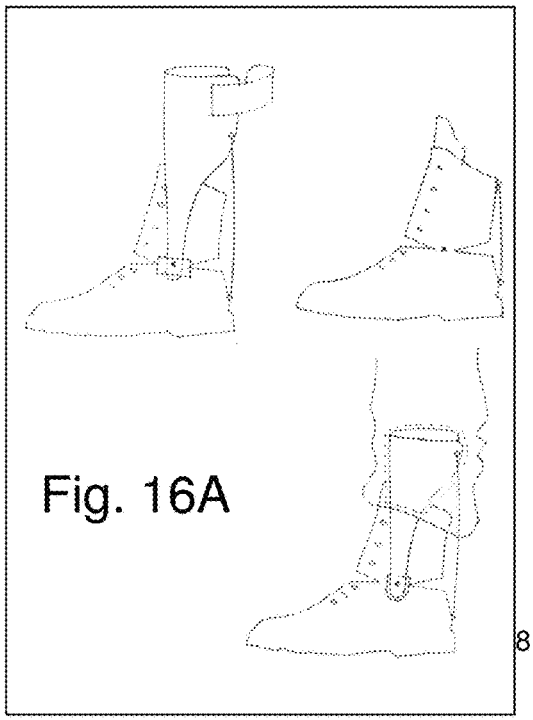
FIGS. 16A and 16B are views of several views of an eight aspect of a boot and yoke extension, in accordance with an aspect of the present disclosure.
Figure 16B:
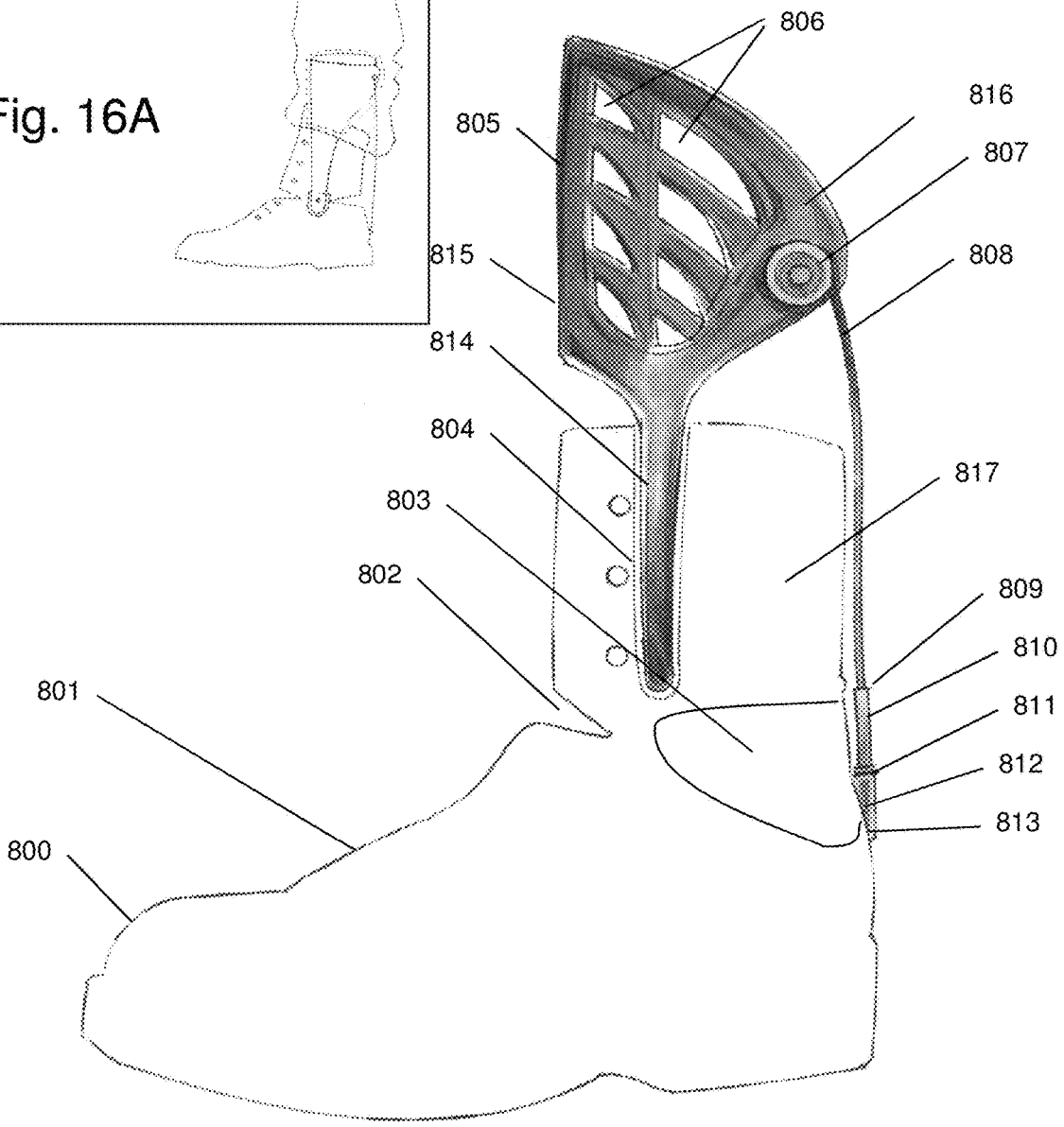

FIG. 16B shows a side view of an eighth aspect of a boot and yoke extension 800. FIG. 16B is a drawing, for example, of a modified military boot and yoke extension combination that transfers force from a leg over a pivot into and out of an elastic spring system. FIG. 16B is an external side view of the aspect. FIG. 16A is a side view, highlighting integration with pants.

Boot and yoke extension 800 has been modified to enable a variety of elastic spring combinations to be deployed in a manner that is consistent with various design and aesthetic constraints. For example, military boot standards typically require adherence with a code for uniforms. These codes often limit the addition of any nontraditional appendages to the exterior surface of the boot. For example, the use of metal hooks, buckles or appendages may be limited, deviation from color specifications may be limited and so on. Boot and yoke extension 800 as depicted and described herein enables integration of force management approaches which may enable boot and yoke extension 800 to remain within military uniform codes.

Yoke extension 805 provides an additional means beyond a collar yoke of harvesting force from the front face of the lower leg. Force may be harvested from the shin face of the lower leg jointly by a collar yoke 817 and yoke extension 805 or with all of the force being harvested by the yoke extension 805.

Yoke extension 805 comprises a front face 815 that harvests force from a lower leg, rear face 816 that imparts force vertically through tension adjusting mechanism 807, connector 808, interface between connector and elastic member 809, elastic member 810, interface between elastic member and fastener 811, male fastener 812, female fastener 813, which collectively transmit force into the heel area of the article of footwear 801. Pivot forces are managed through yoke extension leg 814 into collar yoke 817 and into article of footwear 801.

Because the front face 815 may contact the shin at a greater distance from the ankle joint as compared to any given collar yoke, it may harvest energy from the shin face with greater leverage and therefore requires less contact force. Front face 815 may also be designed with a larger surface area than possible in any given collar yoke. In such a way, a yoke extension 805 may have both increased leverage and increase surface area contact with the shin allowing it to harvest significantly more force from the front of the shin face and also reduce the pressure on the shin face.

In an aspect, front face 815 must have a surface area that is sufficient to distribute forces on the shin face of the lower leg that are within the tolerable limits for the application. Such limits may vary with, for example, the duration and significance of physical activity. For example an athlete competing in an intense short duration sporting event may be willing to endure high pressure and significant discomfort, where a pedestrian walking on their way to work may wish to avoid any discomfort.

Yoke extension 805 may be expanded in its surface area such that it also acts as a shin protector. Pairing a boot, shoe, sneaker or other article of footwear with a detachable shin protector has the opportunity to provide benefit to many users in both comfort as well as functionality. Shin protection is commonly worn in many applications. For example, shin protection is used in athletic pursuits such as soccer, vocational pursuits such as logging, and military applications for shin protection.

Front face 815 may be configured in a variety of fashions. It may be semi-rigid as shown in the drawings by creating a one-piece design with semi-rigid materials selected from a broad array of plastics, composite structures, metal allows, and combinations thereof.

Front face 815 may also be designed as shown in FIG. 16A and other figures herein—which create a shin face by suspending shoe laces, straps, fabric or other materials between opposing sides of a multi-piece yoke. Replacing a semi-rigid design with a non-rigid material may reduce the impact protection of front face 815, but offers a variety of other benefits.

Yoke extension 805 as shown in the aspect of FIG. 16B may be attached and detached by a user to the collar yoke 817 of an article of footwear 801 in a manner that enables yoke extension 805 to rotate at a hinge point, positioned such that the axis of rotation of the hinge point is along or in near proximity to the axis of rotation of the ankle joint.

Yoke extension 805 is connected to article of footwear 801 in a manner that enables it to be attached and detached at will by a user without special tools. Such attachment must have sufficient strength that it allows anticipated forces to be conducted while under dynamic load without failure of the connection. Article of footwear 801 may have structural elements below the ankle that provide sufficient stability to accept the associated forces.

Enabling yoke extension 805 to connect and disconnect from article of footwear 801 allows a user to have greater personal control over the assistance provided. Article of footwear 801 may be configured with a small amount of spring force in posterior gusset 803, and the addition of yoke extension 805 may augment the baseline spring force of article of footwear 801. Separating yoke extension 805 and article of footwear 801 also provides the ability for the yoke extension 805 to be integrated into an article of functional lower limb clothing, such as pants, long underwear, body suit, etc.

A wide variety of means may allow the yoke extension 805 to be detachably and rotatably attached to the footwear 801. Yoke extension 805 may be attached to collar yoke 817 by a variety of means including providing a sleeve or holster such as receptacle for yoke extension leg 804 that receives yoke extension leg 814, by providing mechanical fasteners to connect yoke extension leg 814 to collar yoke 817, by providing a variety of other means including buttons, laces, hook, hook & loop, or other known approaches. Many other means may be employed to connect extension yoke leg 814 to article of footwear 801 in a manner that augments the rotational hinge qualities of the interface between collar yoke 817 and the base of article of footwear 801, including the integration of a ball & socket joint, a heim joint, a rod end, a ball and socket pair in which the male rotating ball element's radius is smaller than the radius of the female socket side of the joint thereby providing some fore & aft laxity, etc.

Tension adjusting mechanism 807 is responsible for providing an upper anchor upon rear face 816 for connector 808 and providing adjustment to the available length of connector 808. Tension adjusting mechanism 807 may be a rotating ratchet, mechanical ratchets, cam-lock devices, winch, knob, linear accommodating device, motor powered device, slide lock mechanism, solenoid, hook and loop fastener, hook & eyelet, cleat, anchor holes, laces with knots, etc.

Tension adjusting mechanism 807 may be powered by the user's strength, by stepper motor, by stored elastic energy, by a motion powered ratchet, etc. There is a variability in load upon the tension adjusting mechanism 807 such that the effort to adjust the mechanism is easier during the swing phase of the gait when the user is plantar flexed.

Connector 808 may be adjustably attached to tension adjusting mechanism 807. Connector 808 also connects to elastic member 810 through interface between connector and elastic member 809. Connector 808 may comprise a variety of tension bearing materials, including a shoe lace, woven cord, string, cable, etc. As the yoke extender will have medial and lateral sides, there are a variety of ways to enable adjustment. In the aspect depicted in FIG. 16B, a single adjusting mechanism 807 controls a single connector 808. Connector 808 is anchored to the medial instance of rear face 816 in a fixed fashion then proceeds through a loop at interface between connector and elastic member 809 and continues until it adjustably attaches to adjusting mechanism 807 which is mounted on the lateral instance of rear face 816. Pre-load tension may also be adjusted by having separate adjusting mechanisms 807 for the medial and lateral sides of yoke extension 805.

Elastic member 810 may be a single element, or there may be multiple elements. For example, multiple spring rates and lengths may be deployed to provide non-linear spring rates and for variable performance depending upon free length of connector 808.

In an aspect, the connector 808 is longer than the elastic member 810. The tension adjusting member 807 allows elastic member 810 to be pre-loaded very precisely and to a desired state. This allows, for example, the starting point of spring force to be adjusted such that spring force may be set by to accommodate requirements of the user. Tension adjusting member 807 may pre-load and stretch the elastic member 810 to a multiple of it's the elastic member 810's initial length. This provides a great variety of performance levels in the same system.

Lower end of the elastic member may be anchored to the article of footwear in a variety of ways. Elastic member 810. The interface between elastic member and fastener 811, may attach elastic member directly or through a connector to male fastener 812. Male fastener 812 attaches to female fastener 813. Female fastener 813 is anchored to article of footwear 801. The use of the terms male and female with regard to male fastener 812 and female fastener 813 are for descriptive purposes but not intended to limit the ways in which elastic member 810 may be anchored to article of footwear 801. In FIG. 16B the preferred aspect is shown with male fastener 812 and female fastener 813 to be of interlocking pairs of any variety of materials suitable for the load and environmental and mission conditions. Other means of attachable and detachable fastening may be used.

Use of increased spring rates in the elastic member 810 may require advanced materials selection for the support members within article of footwear 801 and yoke extension 805 components.

Biofeedback may provide intelligence to adjust the pre-load of elastic member 810 to a level that is optimal for the users needs. When user is running the paid out length of connector 808 may be shortened to increase pre-load. This can provide superior performance while also reducing the need to engage high pre-loads while walking or while trying to accelerate to a running pace. If desired, user is allowed to reach a steady state of running, hiking, marching, etc before the unit adjusts pre-load and adds tension.

Biofeedback may also sense when the user is in a mode where surplus energy may be harvested (i.e. downhill walking or hiking, casual walking). This would allow electricity generating devices to work in parallel with the passive spring-based devices to harvest electrical power when minimally disruptive and/or helpful.

Aspect 9

Detachable Lower Limb Yoke

Table of Reference Numerals:

Boot and yoke extension 900

Footwear with receptacle 901

Anterior gusset 902
Posterior gusset 903
Receptacle for yoke extension leg 904
Yoke extension 905
Vent holes 906
Tension adjusting mechanism 907
Connector 908
Interface between connector and elastic member 909
Elastic member 910
Interface between elastic member and fastener 911
Male fastener 912
Female fastener 913
Yoke extension leg 914
Front face 915
Rear face 916
Collar yoke 917
Supplemental power element 918
Rotation point 919
Body wear 920
Layered shin interface 922

Figure 17A:
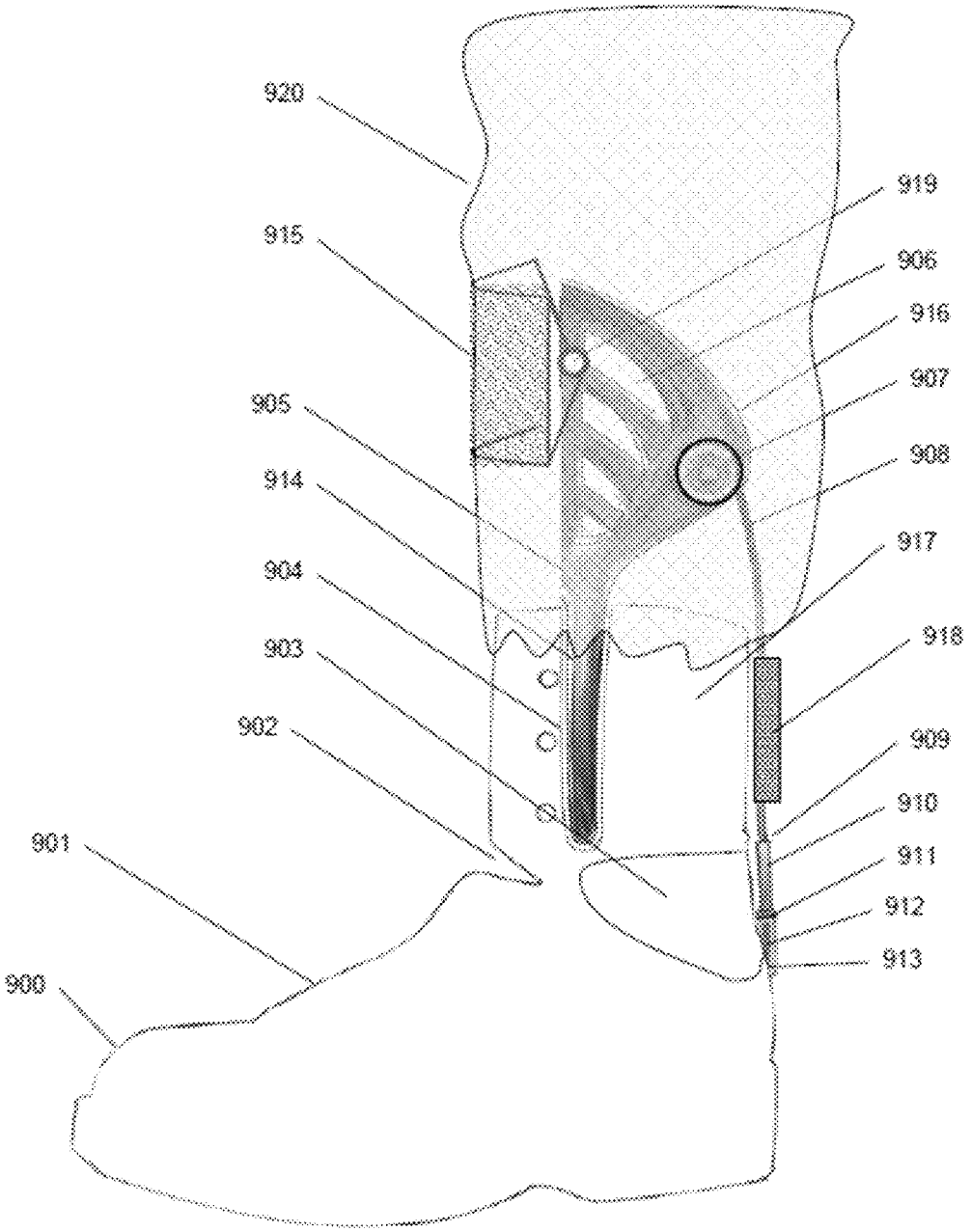
FIGS. 17A-17C show several views of a boot and yoke extension, wherein the boot and yoke extension combination transfers force from a leg over a pivot into and out of an elastic spring system, in accordance with various aspects of the present disclosure.

FIG. 17A shows a side view of a ninth aspect of a boot and yoke extension 900.

FIG. 17A depicts a military boot and yoke extension combination that transfers force from a leg over a pivot into and out of an elastic spring system. FIG. 17A is an external layered side view of the aspect.

Figure 17B:
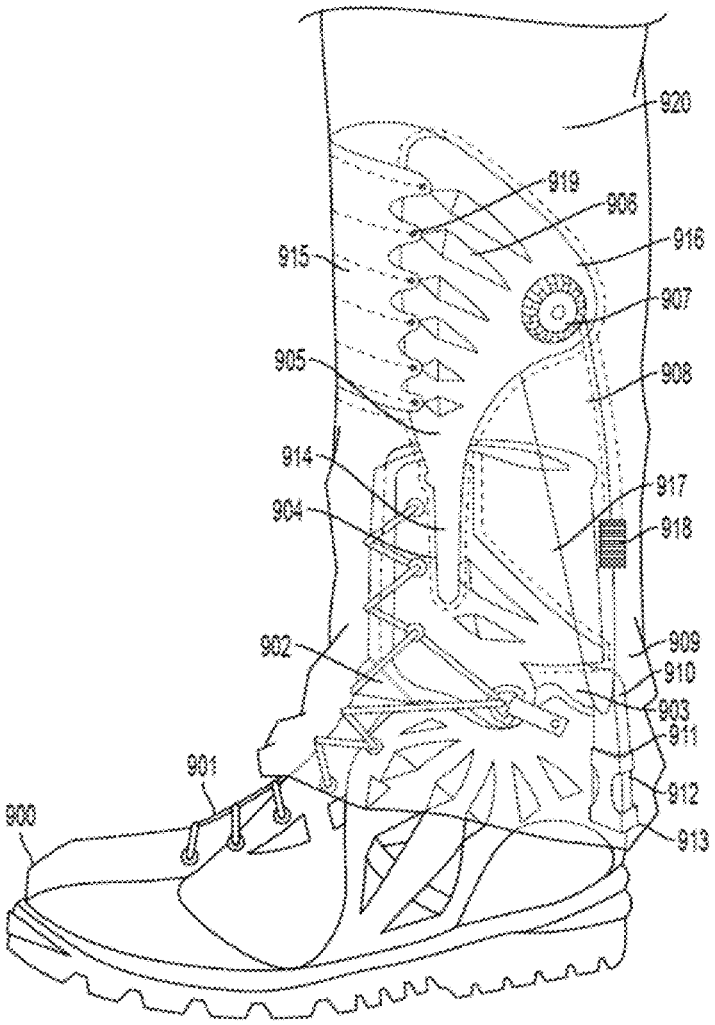

FIG. 17B shows yet another layered cutaway side view of another aspect.

This aspect highlights body wear 920, which was mentioned in other aspects, but not shown to maintain ease of explanation. Yoke extension 905 may be integrated into body wear 920 in a permanent or removable fashion. Body wear 920 comprises a variety of functional clothing, such as uniform trousers, coveralls, long underwear, pants, socks, shin protection, and other articles of clothing, including clothing for the lower limbs as well as the trunk.

Front face 915 is shown here as a separate element that bridges between lateral and medial sides of yoke extension 905. While yoke extension 805 of the previous aspect is shown as a continuous material from lateral to medial, yoke extension variation 905 has two separate sides that are bridged by elements associated with front face 915. Rotation point 919 provides the ability for front face 915 to lay flat against the shin face.

Figure 17C:
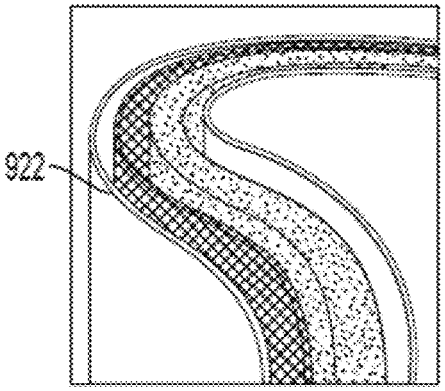

As shown in FIG. 17C, front face 915 may comprise a variety of woven or non-woven fabric elements as shown in layered shin interface 922. This may include webbing, foam padded fabric, mesh, combinations of materials, etc. Front face 915 may be integral with body wear 920 where material of body wear 920 becomes a layer of the shin interface 922. In such a way, yoke extension 905 utilizes construction elements of body wear 920 to serve as front face 915. Or, expressed in different words, body wear 920 may be improved by integrating yoke extension 905 such that the body wear is able to carry force loads. For example, if medial and lateral sides of a two-piece yoke extension 905 are sewn into a pair of pants, the front surface of the pants may be employed as the front face 915. In such a way, yoke extension 905 may share functional utility with body wear 920, or using different words, body wear 920 may share functional utility with yoke extension 915. Similarly, body wear 920 may not be required to transmit load, but rather provide a suitable pocket to hold the yoke extension 905 in place. In such a configuration, pocket may allow yoke extension 905 to be hidden from the outside. Pocket may have openings to allow yoke extension legs 914 to be inserted into boot 900 and cables and tension also to pass through the openings and attach to the article of footwear.

Similarly, elastic member 910 may be integral with body wear 920. For example, elastomeric elements may be sewn into the body wear 920, or a highly stretchable fabric may comprise the lower rear leg section of body wear 920, or some combination of stretchable material together with elastomeric element. In so doing, the fastener 912 may be selected such that it provides a secure fitting without being disruptive if the fastener was not attached to the article of footwear. Elastic member 910 may be incorporated in series above than the upper anchor or the yoke extender 905 with additional elastic members to serve the knee system or the rest of the body. Such additional elastic members may carry spring potential energy, propulsion, or compression/pro-preoception elements. In another aspect, elastic member 910 and connector 908 may travel through an opening in the body wear 920.

Supplemental power element 918 may be integrated above or below elastic member 910. Supplemental power element 918 is designed to provide a twitch-like contraction similar to a muscular contraction. Contraction force may be powered by a variety of means, including electrical, liquid fuel, gaseous fuel, accumulator, hydraulic or pneumatic pulse, electro-rheological gel, motor, etc; such power source perhaps being mounted to the yoke extension 905, article of footwear 900, or on some other device which may be connected to the yoke extension 905 via a connector such as a cable.

In an aspect, supplemental power element 918 may provide a contraction of 0.1 cm to 5 cm or more. Contraction occurs in similar time required to achieve proper plantar flexion through toe-off which is approximately 0.10-0.20 seconds in duration for typical gait duration of 1.1 seconds. Many variations of the supplemental power element will produce a significantly faster contraction speed than 0.15 seconds. For example, propane ignited or electrical solenoid powered systems may exert their contractions in less than 0.05 seconds. External power element 918 may fire rapidly and the resulting pulse of energy may be impractical to deliver directly into the body. The benefit of arranging the linear contraction of the supplemental power element 918 in series with the elastic member 910 is that elastic member 910 can absorb a rapid contraction of kinetic energy, damp high frequency pulses, store potential energy, and then deliver stored potential energy over time as the user moves in plantar flexion towards toe-off. As such, the notion of using a fast-twitch type of supplemental power unit 918 is greatly simplified.

Contraction may be timed to coincide with the start of plantar flexion approximately during mid-stance. This can be evaluated and measured by an electronic or mechanical control device by evaluating ankle angle and observing when the dorsiflexion angle has reached its peak and when it is staring to reduce and tend towards plantar flexion. It may also be evaluated by a variety of other means, for example, analysis of strain gauge data to understand tension in the elastic member 910 or at anchor points; or through other means such as accelerometers or a combination of signal processing to determine optimized firing time.

Depending upon the speed of contraction, elastic member 910 in series with supplemental power element 918 may need to be supplemented by a damping system. A parallel length of an elastomeric material may be integrated adjacent to elastic member 910. Alternately, the material selection for elastic member 910 may include a variety of materials, some of which may be selected for their damping qualities, such that harmonics and pulses are damped without wasting too much energy as heat.

One such approach for delivering compression force is through electrorheological materials and devices. Such materials and devices may be applied in parallel or series with other elastomeric materials to provide a solution that has a natural spring rate, as well as the ability to provide propulsive force. Such materials may reside in the region of the elastic elements, or they may be incorporated into the sole of the footwear, along the upper anchor point or elsewhere.

In another aspect, supplemental power element may be an electrorheological materials and devices, an electric motor, a pneumatic device, a hydraulic device, a linear actuator, and the like.

One such linear contraction motor may be derived from a free-piston engine type of arrangement. In such an arrangement a piston may be fired within a cylinder to impart a linear force. A combination of springs on either side of the piston provide a natural return to a state of readiness while in a static mode. Such a free piston would need to operate at approximately 60 to 80 complete cycles per minute, which is rather low compared to a stock two cycle design. As such, the dwell between cycles would be significant and require that the ignition chamber be of appropriate volume to accept a fuel mixture and be capable of ignition without an active compression activity such as would be provided by a starter-motor on a traditional engine. While this lack of a compression event may limit efficiency, the power available in a free piston arrangement surpasses the power required for a body-mounted application. As such, a reduced efficiency would be acceptable for this application. Having a lower compression will also reduce the sound signature of the free-piston engine's intake and exhaust activities, which is highly desirable in military applications.

Supplemental power element 918 may be mounted in a variety of positions. In the aspect shown, it is positioned in series with connector 908. Supplemental power element 918 may also be anchored rigidly to article of footwear 901 or yoke extension 905.

Not shown in FIGS. 17A-C is a concept of applying multiple tension carrying devices. For example, mimicking the Talofibular and Calcaneofibular ligaments, oriented to provide additional joint stability and resist inversion and eversion forces. Also, two or more exotendons that parallel the Achilles on the lateral and medial sides, so that there is an opportunity to reduce ankle inversion and eversion forces, may be incorporated in to boot and yoke extension 900.

Force Diagrams and Hoop Banding

Figure 18:
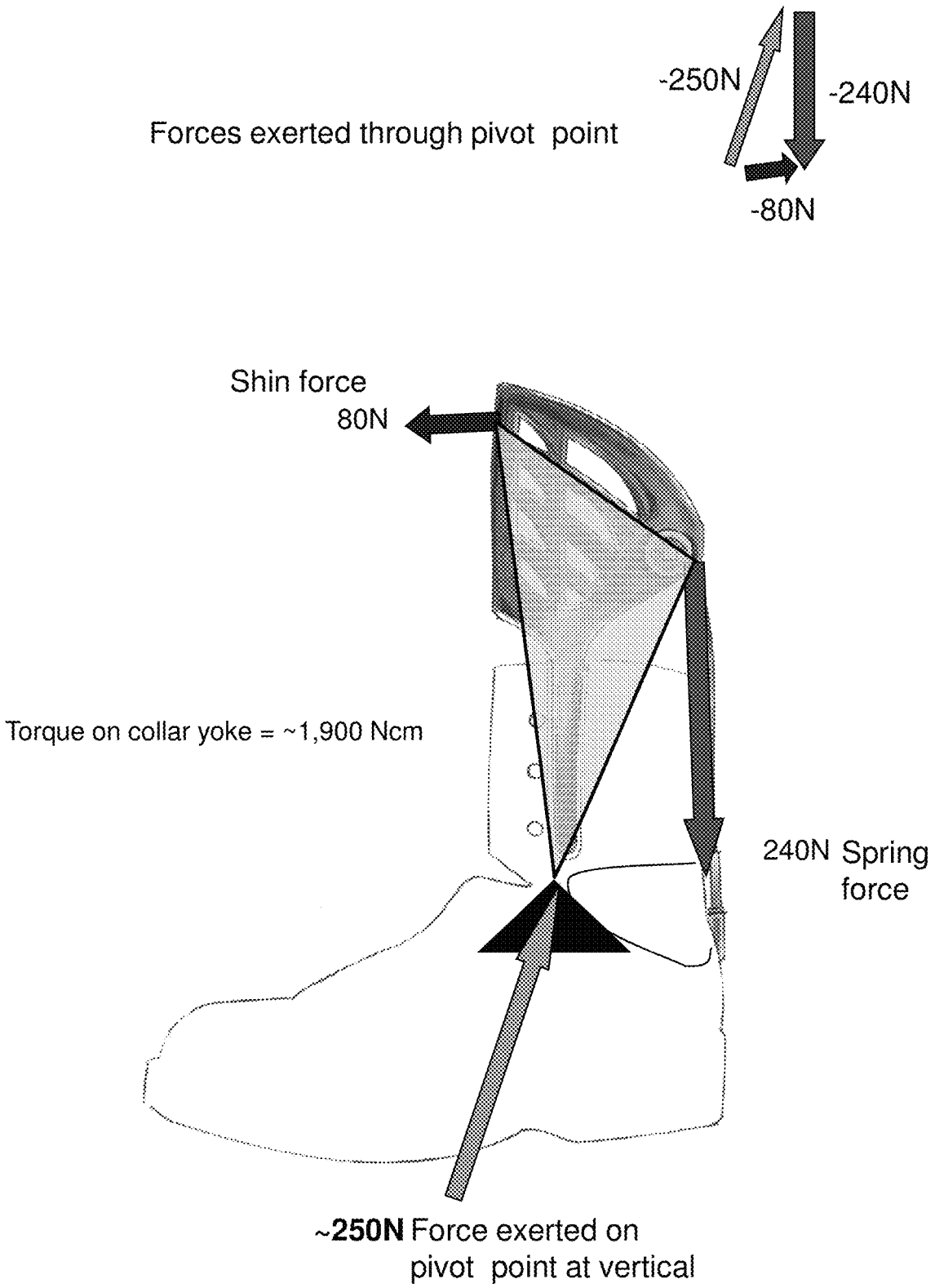
FIG. 18 depicts a force diagram associated with a yoke extender system, in accordance with an aspect of the present disclosure.
Figure 19:
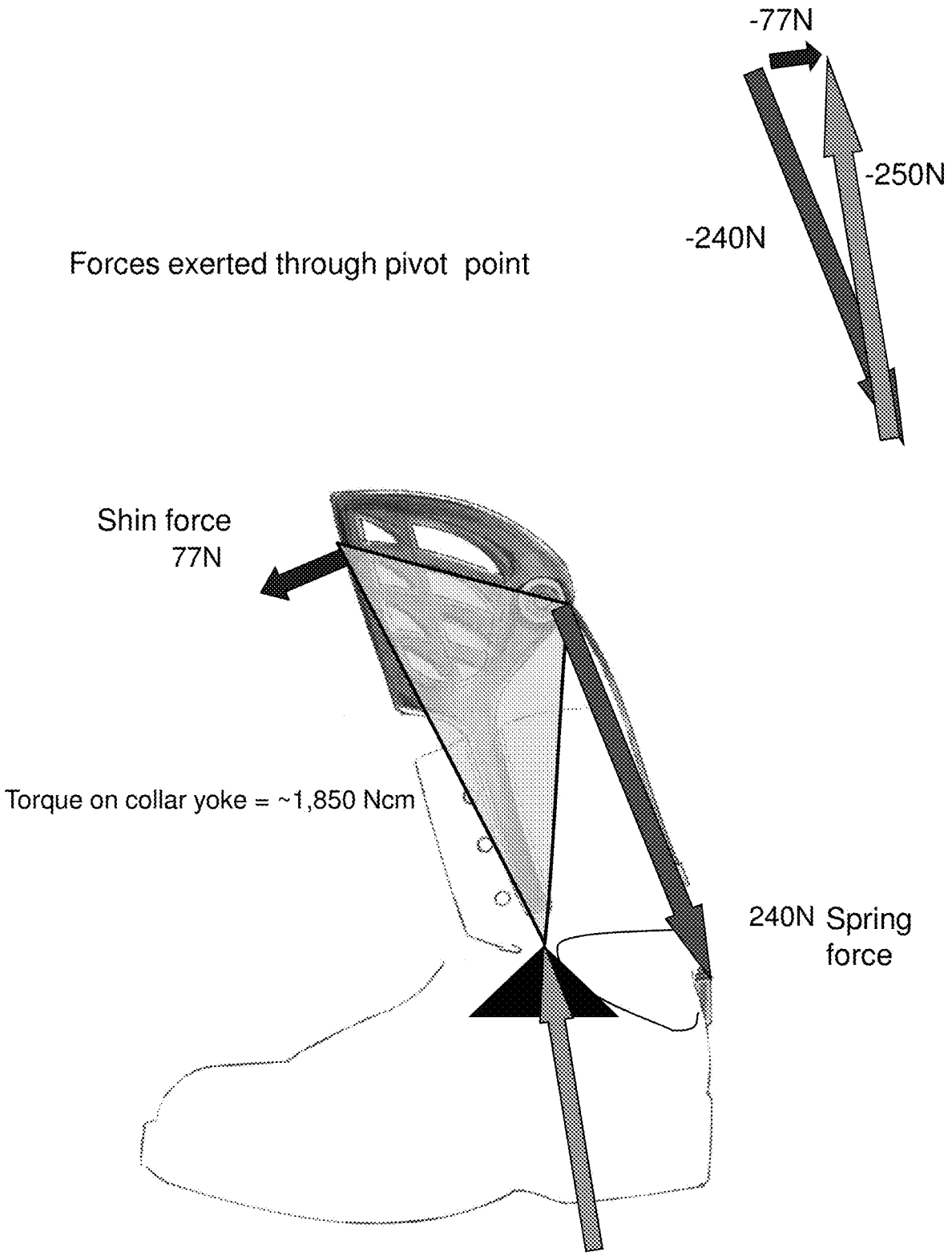
FIG. 19 depicts a force diagram associated with a yoke extender system, during dorsiflexion motion of the user's ankle, in accordance with an aspect of the present disclosure.

FIGS. 18-19 depict force diagrams associated with a yoke extender system. The force path of the system changes as compared to a low cut ankle boot or sneaker with the collar yoke integrated with less height above the ankle joint. As the height of the collar yoke and yoke extender increases above the ankle, several changes occur in the force diagram. Given a constant spring force, as height above ankle increases, the amount of force on the front face of the shin decreases as a result of the increase in leverage. Assuming that the collar yoke or yoke extender primarily relies upon a sliding interface between the front of the shin and the collar yoke or yoke extender front face, then there is only minimal vertical force exerted from the interaction with the front of the leg. The combined forces from the spring element at the rear of the unit and the front interface with the leg therefore impart a downward and forward force upon the hinged joint that aligns in proximity with the ankle joint's axis of rotation.

The higher elevation of the collar yoke or yoke extender results in more force being oriented closer to vertical. For example, in very short collar yokes, much force in transmitted near parallel to the eye stays at the top of the upper—forward and downward. In very tall yoke extenders, the forces are more vertical.

The rotation of the ankle changes the force dynamics. For example, as the ankle dorsiflexes, and the ankle joint angle becomes closed, the forward force through the hinge joint increases relative to the vertical downward force. Knowing the force dynamics experienced by the hinge joint, we can better understand the requirements upon the sidewalls of the footwear and any stiffeners that support the hinge joint. The sidewalls of the shoe will likely be reinforced to carry this force into the sole, so that forces are circumvented around the foot. This will reduce strain on the long arches of the foot and may reduce likelihood of injury or assist recovery after injury.

Several aspects have shown a variety of stiffeners and hinge support mechanisms. These approaches are shown to demonstrate various approaches and can be applied in a variety of aspects, not just the aspect shown in the figure in which it is described. As spring force and preloads increase, the need for internal support of the hinge points also known as rotation zones increases. Under significant force, sidewalls of the shoes will slump. Stiffeners and endoskeletal support members provide a mechanically sound foundation for the hinge & rotation points thereby maintaining vertical, lateral and fore/aft, and torsional stability.

The hoop banding effect is described herein as the support provided when an element is sandwiched between two elements, an interior fixed element and an outer cicumferential element. As an example, imagine a 1 cm square rod of balsa wood and imagine the compressive force it could withstand prior to failure as a result of buckling or slumping. Now, imagine the same balsa rod sandwiched against a 15 cm diameter pipe, wrapped tightly by duct tape. In the wrapped aspect, the balsa can carry a significantly higher compressive load because it is restrained from buckling in multiple directions. We call this stabilization approach "hoop banding". Similarly, hoop banding may provide endoskeleton elements with additional stability and capacity than could be achieved without hoop banding. The foot acts as the inner element and the body of the shoe provides the circumferential wrap. Circumferential force may be provided by tightening the laces of the footwear. Laces, eyelets and tension elements that support eyelets may need to be positioned such that their force will accentuate hoop banding effect. Hoop banding will magnify the compressive load carrying capability of internal endoskeletal members. This allows the footwear manufacturer to create a circumferential force that maintains the shape of an endoskeleton even under load. Significant downward force can be carried through the body of the footwear and any support endoskeleton without having to pass through the foot.

The solution described herein may be equally considered as a mechanical system integrated into footwear and body wear as much as it may be considered as footwear with an integrated mechanical system and bodywear with an integrated mechanical system. It is believed that a minimalist embodiment may be commercialized at a price that is sufficiently affordable so as to be reasonable for people of ordinary means (athletes, recuperating patients, military personnel, mail carriers, etc).

Supplemental Power Element—Fuel Power

Table of Reference Numerals:

Supplemental Piston 1000
Fuel 1002
Fuel injector 1004
Fuel line 106
Casing 1008
Piston base 1010
Return spring 1012
Ignition chamber 1014
Piston base 1016
Connecting rod 1018
Air intake 1020
Piston ring 1022*a, b*
Piston return shock dampener 1024
Spark plug 1026
Piston 1028
Exhaust outlet 1030*a,b*
Noise attenuation chamber 1032
Exhaust port 1034

Figure 20:
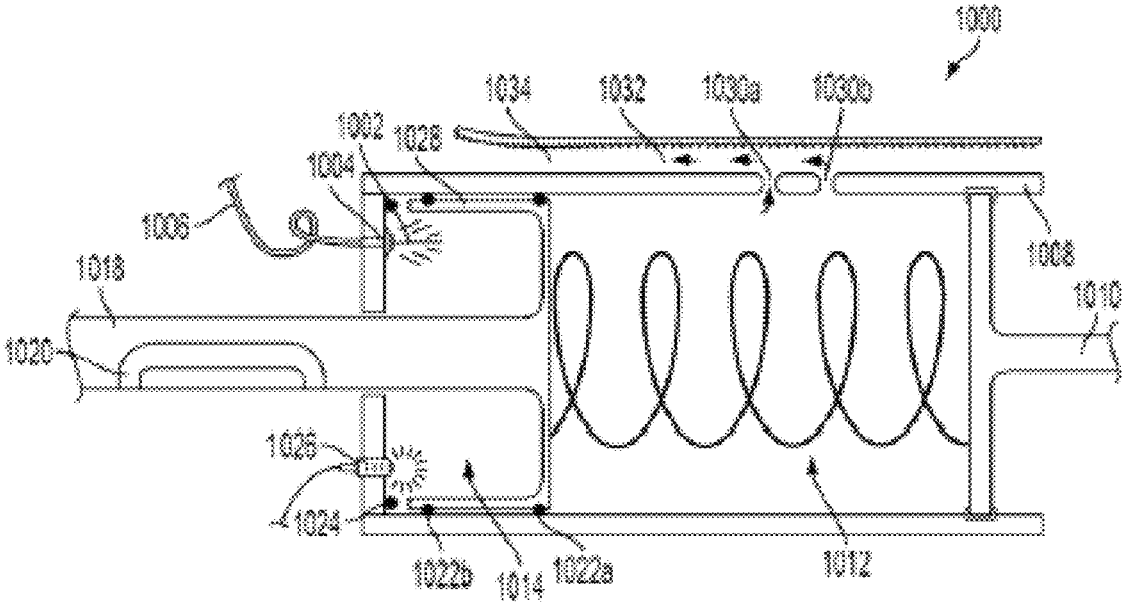
FIG. 20, is a cutaway side view of a supplemental power element, wherein supplemental power element is powered by fuel, in accordance with an aspect of the present disclosure.

Referring now to FIG. 20, a cutaway side view of supplemental power element 918, wherein supplemental power element 918 is a supplemental piston 1000 powered by fuel 1002 in accordance with an aspect of the present disclosure, is shown.

FIG. 20 is an example of a supplemental power element to provide compressive force in series or parallel with elastic member(s) of any aspect.

Supplemental power element 918 is shown explicitly in aspect 9 shown in FIG. 17*s*. 17A-C, but supplemental power elements 918 may be applied to other aspects and at additional locations. Many approaches may be used to provide compressive force.

FIG. 20 shows an arrangement akin to a free piston engine design. In an aspect, a solution would include a small reservoir of gaseous fuel 1002—such as propane, propane/propylene mixtures, methylacetylene-propadiene propane, acetylene, etc. Fuel 1002 may include carbon constituents alone or a mix of carbon constituents and air or oxygen. Oxygen may be supplied or supplemented through natural aspiration or a compressed oxygen cylinder. Supplemental power elements 918 may at least partially be constructed from ceramic, composite, or other lightweight materials. Portions of supplemental power element 918 may be constructed of materials chosen for their favorable sealing capabilities and low dependence on oil-film type lubrication. Fuel may be introduced into cylinder 1008 via a fuel injector 1004. Fuel injector 1004 may further comprise a fuel line 1006 connected to a fuel source on one end portion and fuel injector on another end portion and configured to transfer fuel 1002 from the fuel source to fuel injector 1004.

In an exemplary state, the following four strokes occur.

Stroke 1—dorsiflexion will pull the sliding piston during a 0.3 to 0.4 second period as the leg rotates over the ankle prior to mid-stance. Sliding piston would include a piston 1028 and a connecting rod 1018. Connecting rod 1018 would protrude rigidly from the top of piston 1028, through the combustion chamber 1014, through a sealed orifice in the roof of the combustion cylinder 1008. In such a top-mounted connecting rod design, we are able to attain a compressive force during the combustion stroke. Mounting the end of the top mounted connecting rod 1018 and the body of cylinder 1008 in series with the elastic element allows the system to experience the forces within the elastic member system. As dorsiflexion increases, tension forces move the sliding piston against cylinder 1008 and compress the air in combustion chamber 1014.

Stroke 2—Fuel 1002 will be introduced, the volume of which will further increase the cylinder pressure. Spark ignition, provided by a spark plug 1026, will detonate the mix and the piston 1028 will be forced away, creating a compressive pulling force on the elements to which it is attached.

In such a way, the supplemental piston 1000 provides 1 to 5 cm or more of compressive twitch force travel—similar to muscle.

Near the end of piston travel in stroke 2, during the end of the combustion cycle, cylinder 1008 is vented out the bottom of the shaft 1010, similar to a 2 stroke engine, to discharge exhaust into a noise reduction chamber, which is then followed by the opening of an inlet valve 1020 to admit fresh air. In the figure example shown, inlet valve 1020 is embedded into connecting rod 1018, other inlet valve 1020 configurations can be substituted as needed. Piston 1028 pushes against a return spring 1012 which assists in returning the sliding piston back to a compression stroke.

The strength of return spring 1012, weight of piston 1028, length of travel, mean effective pressure of combustion and other factors will determine dynamic motion of supplemental piston 1000. The system can be tuned to operate in a 2 stroke or 4 stroke mode. The two stroke mode would repeat at this point, the strength of the return spring starting the compression stroke, however the 4 stroke description follows here.

Stroke 3—Following the combustion stroke, return spring 1012 pushes piston 1028 back into cylinder 1008. This coincides with the swing phase of the gate.

Stroke 4—This return creates a rebound which expands cylinder 1008 back to the open position, providing a shorter duration secondary venting of exhaust and providing fresh air inlet.

The beginning of stroke 4 allows return spring 1012 to load and start piston 1028 moving in the compression direction again which starts stroke 1 again. Dorsiflexion action continues to pull piston 1028 and compresses the air in combustion chamber 1014. Within a short time of attaining the maximum point of dorsiflexion, fuel is injected into combustion chamber 1014 and the fuel air mix is then ignited.

Given a bore of approximately 1 to 1.5 cm and compression in combustion chamber 1014 of 2 to 4 bar (resulting from both dorsiflexion based compression of naturally aspirated air, together with injection of high pressure gaseous fuel 1002), may yield a peak combustion pressure of approximately 10 to 20 bar. This would result in a peak force of approximately 75 to 150 Newtons.

Piston 1028 may comprise one or more piston rings 1022 (labeled, for clarity, as piston rings 1022*a,b* in FIG. 20). Piston ring 1022 is configured to facilitate, among other traits, smooth movement of piston 1028 within cylinder 1008. Piston ring 1022 may also provide an air tight barrier to prevent premature release of the fuel and air mixture in combustion chamber 1014.

Cylinder 1008 may further comprise a piston shock dampener 1024. Piston shock dampener 1024 may be a flexible ring placed in contact with the top portion of cylinder in the path of piston 1028. Piston shock dampener 1024 may be configured to contact piston 1028 on the upstroke of piston 1028 and compressively absorb kinetic energy from piston 1028.

Exhaust gases may exit cylinder 1008 by first passing through one or more exhaust outlets 1030 (labeled, for clarity, as exhaust outlets 1030*a,b* in FIG. 20) located on the cylinder walls. Exhaust gas may then pass into a noise attenuation chamber 1032, configured to absorb and deflect sonic energy via, for example, irregular surface contours. Exhaust gases may leave supplemental piston 1000 via one or more exhaust ports located on noise attenuation chamber 1032.

Patella Bridge Knee System

Table of Reference Numerals:

Patella bridge knee system 1100
Clothing 1102
Femur section 1104
Hammock 1106
Upper tension device 1108
Tibia member 1110
Hinge 1112
Lower tension device 1114
Footwear 1116
Force carrying member 1118
Belt 1120
Knee cushion 1124
Damper 1126
Thigh strap 1128

Figure 21A:
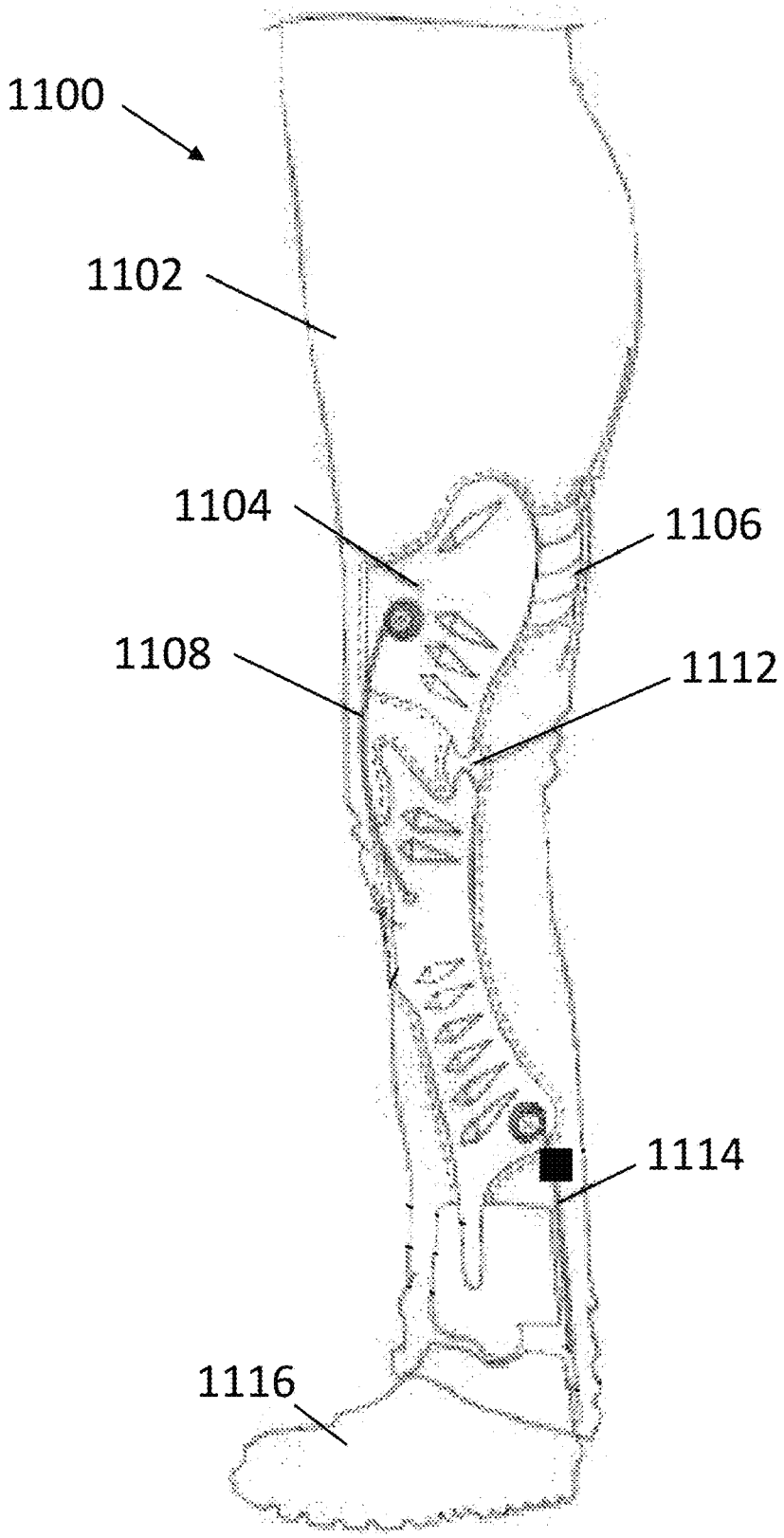
FIG. 21A is a view of a patella bridge knee system in accordance with aspects of the disclosure.

Referring now to FIG. 21A, a side view of a patella bridge knee system 1100, in accordance with an aspect of the disclosure, is shown.

Patella bridge knee system 1100 comprises a tibia member 1110 and a femur section 1104. Such systems can be developed to utilize yoke extension 905 described earlier (e.g., with reference to FIGS. 16-17B) as a platform to support a device that spans the knee cap (patella). Tibia member 1110 may comprise boot and yoke extension device 900, wherein yoke extension 905 and the associated portions have been configured to extend to a location near the patella. For example, this would require the shin guard to be longer and extend up close to the patella without interfering with the range of motion of the patella or the ligaments & tendons associated with the patella. An extended shin guard would then provide a platform on top of which a system could be built that would enable a tension device to be spread across the top of the patella. The bridge would prevent interference of an elastic member system from rubbing against any sesamoid activity. In another aspect, tibia member 1110 comprises only a portion of boot and yoke extension device 900.

In an aspect, the portions of tibia member 1110 proximal to the patella extend around the lateral and medial sides of the patella and are thicker than other portions of tibia member 1110, providing a larger moment arm between hinge 1112 and upper tension device's contact point. This increases the leverage of system 1100.

Tibia member 1110 may be horse-shoe shaped comprising a rigid front face which physically connects the lateral and medial portions of tibia member 1110. In another aspect, the lateral and medial portions of tibia member 1110 are joined by flexible members (not shown in FIG. 21B) configured in a fashion similar to hammock 1106.

Patella bridge knee system 1100 comprises femur section 1104 above the patella similar to yoke extension region of boot and yoke extension device 900. Such a semi-rigid platform may be created with a yoke type of device that is held in place by elastics. Femur section 1104 may also be integrated into body wear 1102, such as pants, thereby depending upon the wearers waist belt and or suspenders to prevent pulling the pants down.

Femur section 1104 may be a single piece configured to provide a forward upper anchor or actuation point for upper tension device 1108.

In an aspect, femur section 1104 is held in place via a hammock 1106. Hammock may be an elastic member connected on one end portion to the lateral portion of femur section 1104 and connected on another end portion to the medial portion of femur section. Both connections may occur at a similar vertical height. In another aspect, the vertical connection location of hammock 1104 varies on the lateral and medial portions of femur section 1104 in order to comfortably rest upon the user's body. Hammock 1104 is configured to hold patella bridge knee system 1100. Hammock 1004 also provides the necessary force for patella bridge knee system 1100 to extend the leg at the knee joint.

Patella bridge knee system 1100 may comprise an upper tension device 1108 which bridges across the top of the patella and provide an external tendon to assist the knee joint in extending, thereby reducing metabolic work. On one end portion, upper tension device 1108 may be connected to femur section 1104. On another end portion, upper tension device 1108 may be connected to tibia member 1110.

Upper tension device 1108 may comprise a tension adjusting mechanism, connector, interface between connector and elastic member, elastic member, interface between elastic member and fastener, male fastener, and female fastener, which collectively transmit force from femur section 1104 to tibia member 1110 in a similar in operation to other aspects of the present disclosure (e.g., transferring force from yoke extension 805 to heel area of article of footwear 801).

Femur section 1104 and tibia member 1110 may be movably connected near the user's patella via a hinge 1112. In an aspect, hinge 1112 is configured in a fashion similar to yoke pivot 612 of shoe 600, as shown in FIG. 14. In another aspect, hinge 1112 is configured with two axes of rotation, similar with other mechanical braces available commercially. In another aspect, hinge 1112 is configured with two axes of rotation, similar with other mechanical braces available commercially.

Patella bridge knee system 1100 may comprise a lower tension device 1114 which bridges from a portion of tibia member 1110 to footwear 1116, providing an external tendon to assist the ankle joint in operating, thereby reducing metabolic work. On one end portion, lower tension device 1114 may be connected to tibia member 1110. On another end portion, lower tension device 1114 may be connected to footwear 1116.

Lower tension device 1114 may comprise a tension adjusting mechanism, connector, interface between connector and elastic member, elastic member, interface between elastic member and fastener, male fastener, and female fastener, which collectively transmit force from tibia member 1110 to footwear 1116 in a similar in operation to other aspects of the present disclosure (e.g., transferring force from yoke extension 805 through an elastic or an elastic together with a powered system to heel area of article of footwear 801 as well as transferring force from yoke extension 805 through a rotatable object to ground).

Such a system may be designed to benefit from active devices which provide the height above the patella to prevent interference and which also can contribute force to the system. Such devices could respond to input by raising or lowering themselves vertically on a hinged rotation, or provide tensile force to force carrying members such as upper tension device 1108 and lower tension device 1114.

Clothing, 1102, such as trousers, may have pockets designed to receive portions of patella bridge knee system 1100. Additionally, pockets and channels between layers of fabric may be provided which create pathways for force carrying members, such as upper tension device 1108 and lower tension device 1114.

Figure 21B:
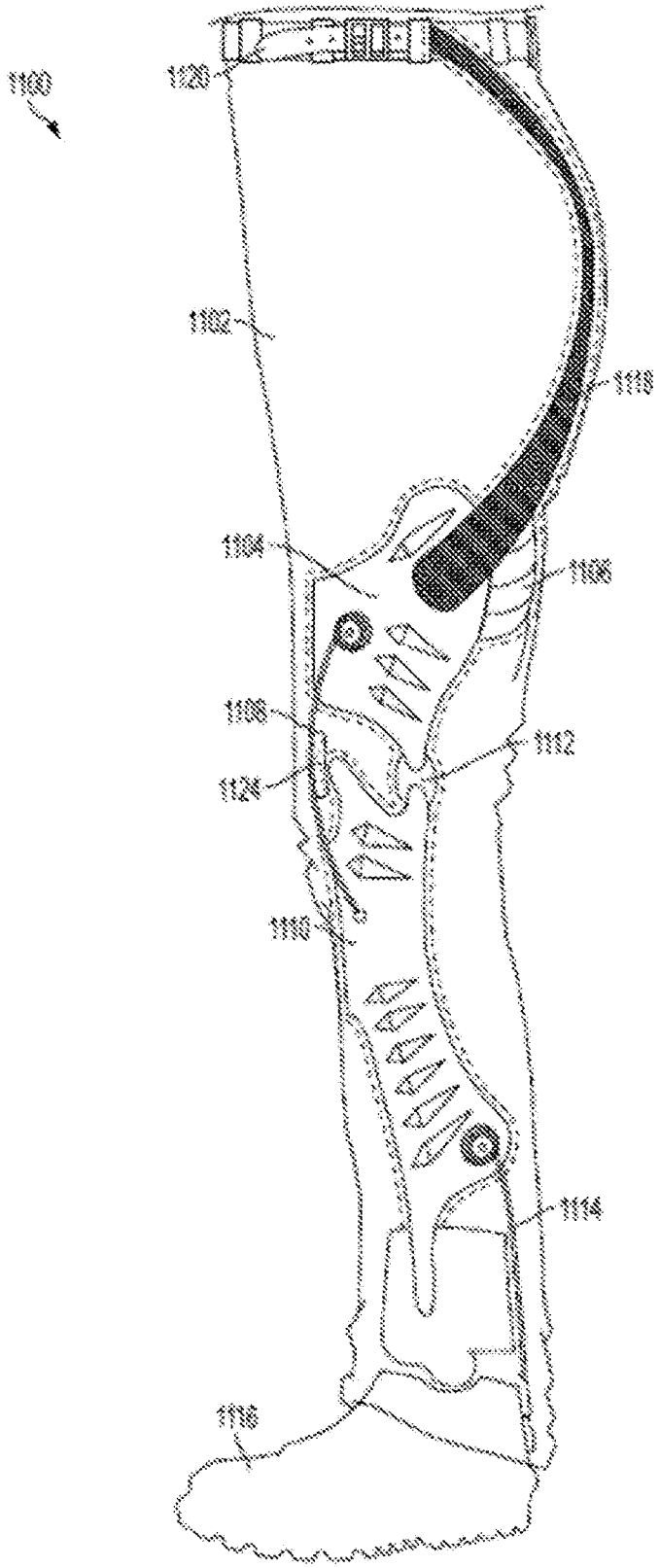
FIG. 21B is a view of a powered or passive patella bridge knee system, in accordance with various aspects of the present disclosure.

Now referring to FIG. 21B, a side view of patella bridge knee system 1100, wherein patella bridge knee system further comprises a hip anchor, in accordance with an aspect of the disclosure, is shown.

In an active system, an elastic member would span across the patella and be anchored above and below the patella. Active systems could impart a force across the patella in a variety of ways. One way would be to activate the anchor points so that they could pre-load tension across the elastic member. Another way would be to activate the members which provide elevation across the patella. By articulating the bridge members to provide additional height, two benefits would be accomplished. The elastic member stretched across the patella would experience a longer distance of stretch for an equivalent amount of knee rotation, thereby increasing force while the bridge members were extended. And, the elastic member stretched across the patella would impart a greater force on the leg, as the leverage would increase.

System 1100 elements may be activated in a variety of ways—rotating 10 to 60 degrees similar to pin ball machine flippers; expanding vertically in a linear piston fashion; etc. The objective is to increase at least the height of the bridge elements and their separation also where possible. In such a way, the distance between the points across which the tension system travels increases and the leverage upon the leg increases.

Such dynamic system 1100 elements may be powered electrically, such as by a solenoid or step motor, hydraulically or pneumatically, by combustion, etc.

A controller would activate the dynamic bridge elements in the propulsive phase of the gait, where straightening of the knee join propels the person up and forward. By adding external power through the dynamic bridge elements, less effort is required during negative work and added benefit is gained through positive work. Knee extension force may also be imparted by placing force on a cable or other such tensile element that is oriented above the hinge point.

Similar to a hinged knee brace, such a device also provides a hinged knee joint that can assist in maintaining joint stability to prevent injury or aid in recuperation. By integrating the rigid members inside clothing, such as a pair of trousers, as shown in FIG. 21B, it provides the ability for a user to don the device easily and wear it all day. The concealed aesthetics are pleasing. The user can adjust the tension of how tightly the femur segment is attached to the leg. This allows less conformation between device and leg (greater joint laxity) when the user has the device secured loosely and vice versa.

Patella bridge knee system 1100 may be integrated into clothing 1102, such as trousers, via the incorporation of a force carrying member 1118 (e.g., an elastomeric member) and a belt 1120. Force carrying member 1118 may connect on a first end portion to a portion of femur section 1104, such as the top portion of femur section 1104. Elastomeric member may connect on a second end portion to a hip anchor, such as a belt 1120. The hip anchor is configured to removably connect to user and provide a point for transferring force to and from the user. In another aspect, hip anchor is a portion of clothing 1102, such as a pant leg. Force carrying member 1118 may comprise a spring element, a powered element or both in parallel or series.

In aspects comprising force carrying member 1118, patella bridge knee system 1100 may provide the motive force to extend the hip join during appropriate portions of the gait cycle, as well as proprioception to help users better maintain proper posture. This may help prevent injury.

Force carrying member 1118 and other elements of patella bridge knee system 1100 may be fitted within a layer of clothing 1102 (e.g., trousers) to be concealed from the outside. It may also be fitted in other types of garments, such as long underwear, body suit, jump suit, etc.

Clothing 1102 may be designed to share in the carrying of some of the force loads. For example, where patella bridge knee system 1100 comprises hammock 1106, the fabric of the trousers may be connected to hammock 1106 and serve as a force carrying device. In another aspect, a separate hammock 1106 may simply reside in a pocket within the trousers and be removably connected to system 1100.

Force carrying member 1118 may work passively or in conjunction with a powered device in series or parallel to provide more extension power to the hip joint. Force carrying member 1118 may be attached to a fixed belt, an adjustable belt or an electronically actuated device.

Patella bridge knee system 1100 may further comprise a knee cushion 1124. Knee cushion 1124 may be configured to reduce forces imparted on the patella by other portions of system 1100. Knee cushion 1124 may be movably connected to portions of tibia member 1110 and femur section 1104. Knee cushion 1124 may be removable.

Figure 22:
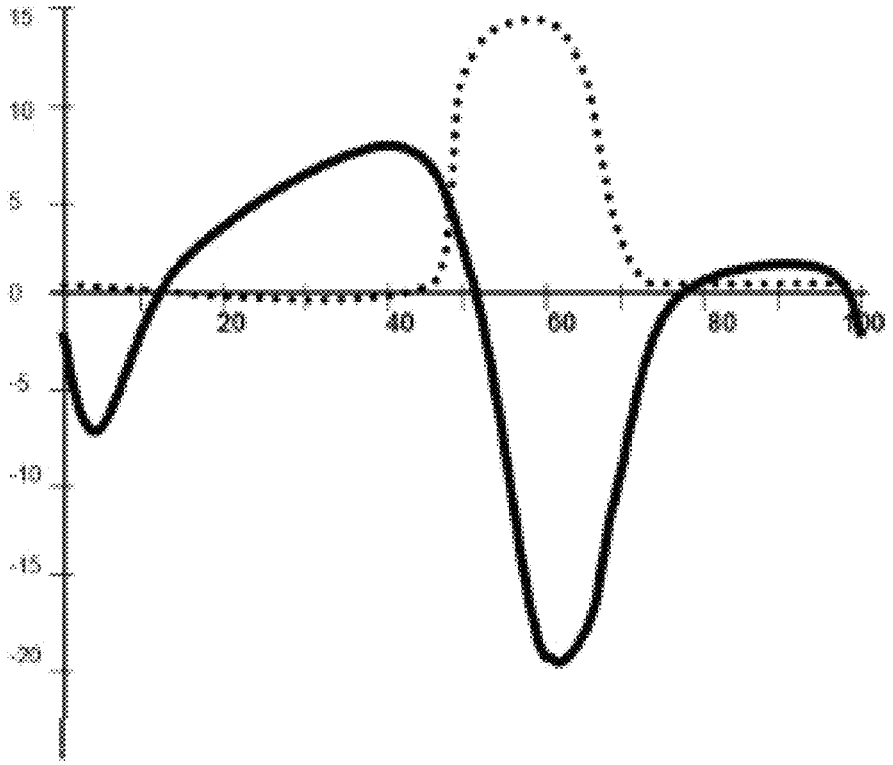
FIG. 22 is a graph depicting the angle of a user's angle during a typical gait cycle and input from a powered device, wherein the powered device is a portion of aspects of the present disclosure and is adapted to provide or harness power during the gait cycle, in accordance with aspects of the present disclosure.

Now referring to FIG. 22, a graph depicting the angle of a user's angle during a typical gait cycle and input from a powered device, wherein the powered device is a portion of aspects of the present disclosure and is adapted to provide or harness power during the gait cycle, in accordance with aspects of the present disclosure, is shown.

Figure 23:
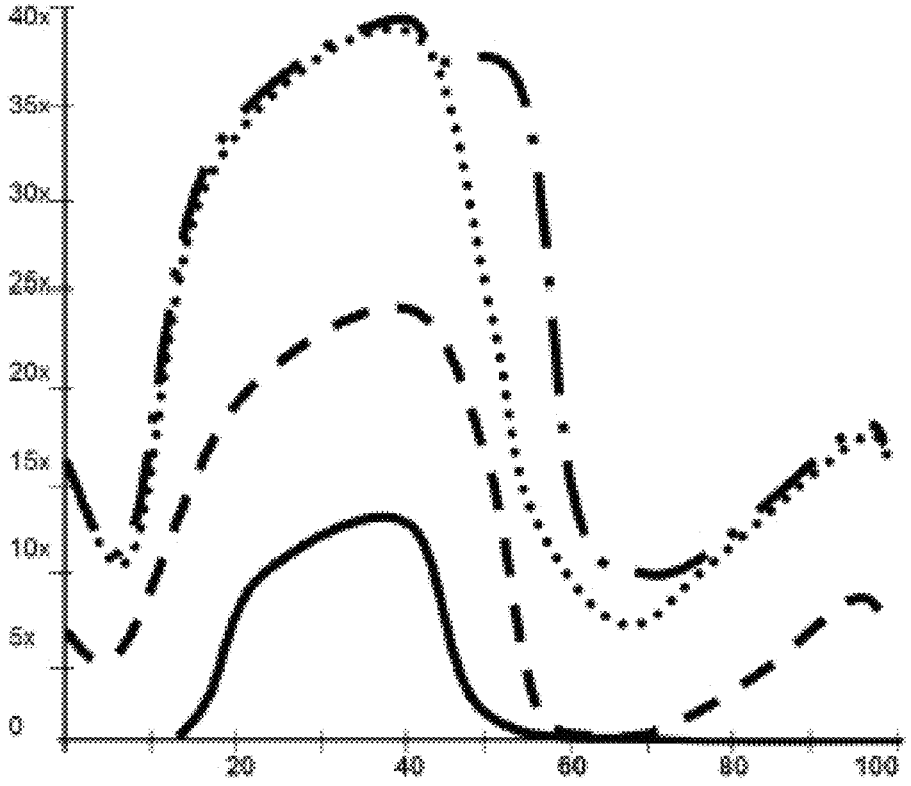
FIG. 23 is a graph showing tension within a spring anchored to portions of a device according to the present disclosure, wherein the spring has been preloaded, in accordance with aspects of the present disclosure.

Now referring to FIG. 23, a graph showing tension within a spring anchored to portions of a device according to the present disclosure, wherein the spring has been preloaded, in accordance with aspects of the present disclosure, is shown.

Patella Bridge Knee System

Table of Reference Numerals:

Boot 700
Dampers 740
Patella bridge knee system 1100
Dampers 1126
Thigh strap 1128

Figure 24:
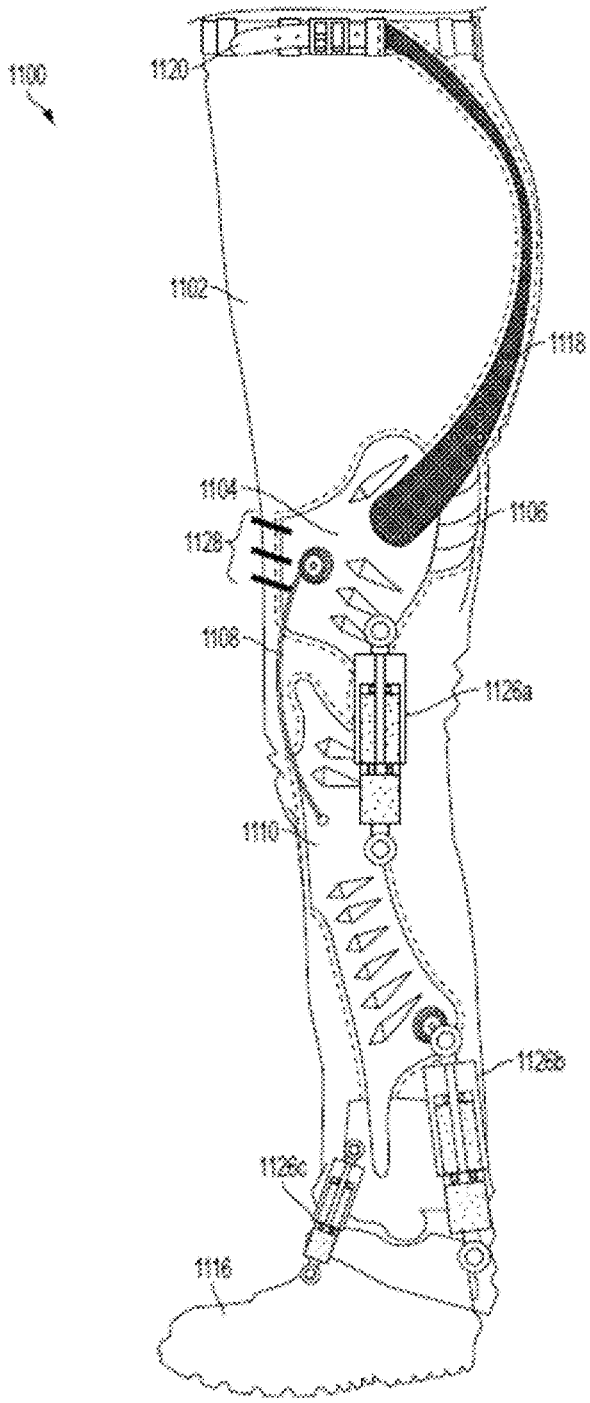
FIG. 24 shows side views of a patella bridge knee system, wherein the system comprises dampers, in accordance with aspects of the disclosure.

Now referring to FIG. 24, various side views of patella bridge knee system 1100, wherein the system comprises dampers, in accordance with aspects of the disclosure, are shown.

Patella bridge knee system 1100 may further comprise one or more dampers 1126 (labeled, for clarity, as damper 1126*a-c* in FIG. 24). Dampers 1126 are configured to absorb and dissipate forces imparted on system 1100 joints.

In an aspect, dampers 1126 may be removably attached to portions of patella brisge knee system 1100 such that damper 1126 may absorb and dissipate shocks (e.g., landing forces when a parachutist impacts the ground), rather than the joint associated with damper 1126, or the user's body. Endoskeleton allows for dampers to be inserted on either side of the joint on a detachable basis to enable attenuation and dissipation of forces when required. For example, during parachute landings devices can absorb landing force and dissipate untoward forces rather than shunting them to a neighboring joint or bone.

Damper 1126 may be designed to be easily attached and removed and carried in a pocket. This offers a superior solution to hook and loop wrap-around parachute ankle braces which have been highly successful in reducing injury but which are typically too cumbersome to be worn in combat.

Dampers 1126 may be positioned laterally and medially. Damper 1126 may comprise pneumatic or hydraulic dashpot type dampers, rippable stitch fabric dampers (as used in safety belts), aerogel based dampers, variable rigidity fabrics, variable stretch fabrics, or other devices that impart friction to dissipate energy and force. Variable rigidity fabrics may be passive, which are capable of increasing resistance to flexibility the faster they are deformed, and may comprise one or many layers of such fabric; and variable rigidity fabrics may be active, which are capable of increasing resistance to flexibility through controlled electrical input, and may comprise one or many layers of such fabric. Many of such fabrics have directionality to their resistance, and when orienting such fabrics, the direction of resistance would align with the direction necessary to resist inversion and eversion motion. Similar to variable flexibility fabrics, variable stretch fabrics resist expansion in one or more directions. Orientation of the controlled stretch property would align with the vertical across the gussets.

Damper 1126 may be positioned in other directions in order to dissipate energy in such axes. Such devices may also be influenced by forces applied to the feet so that dampers positioned laterally, medially, anteriorly and/or posteriorly respond differently. This may be controlled electronically by sensors and force input. It may also be actuated by a multi-chambered 'airbag' below the sole that displaces a fluid such as air into dampers. If the medial side of the foot lands first, it might cause inversion, thus the displaced fluid would charge the lateral damper to provide extra resistance to inversion.

In an aspect, patella bridge knee system 1100 is integrated into clothing 1102, such as a pair of trousers, allowing users to wear system 1100 all day with comfort. In order to further facilitate comfortable usage, it is envisioned that user will adjust the tightness of the femur section 1104 via adjustment of thigh strap 1128. Thigh strap 1128 may be a hook & loop adjustable strap across the top of the quadriceps hidden within the trousers.

Figure 25:
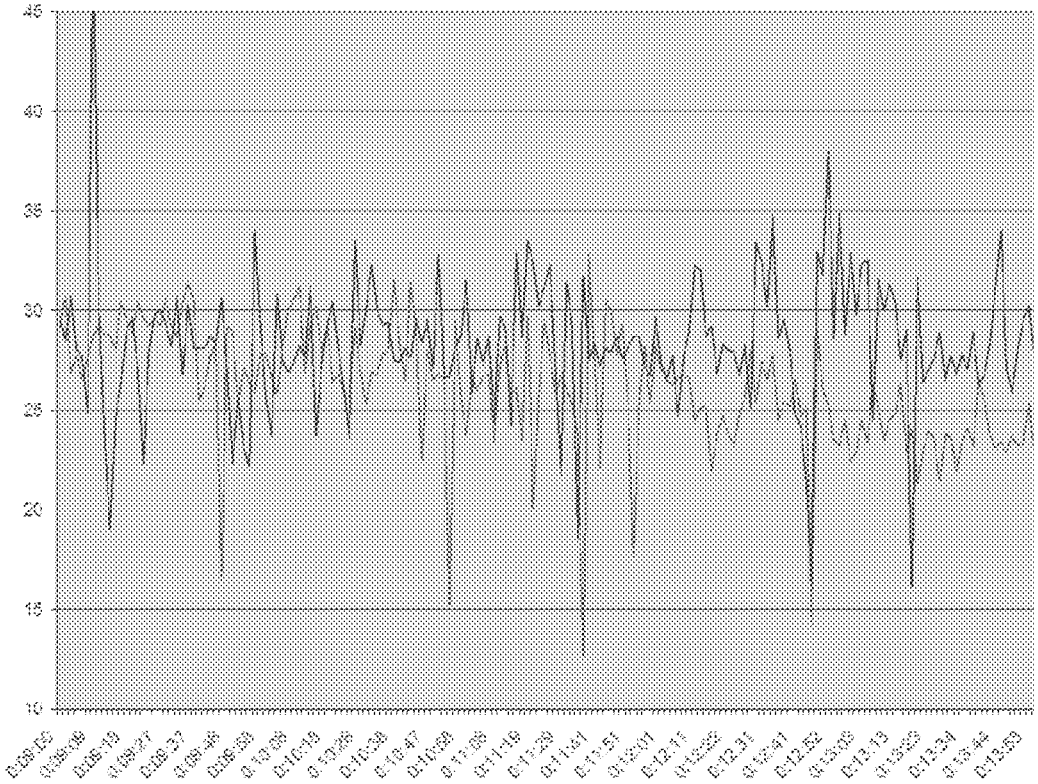
FIG. 25 shows treadmill test results by various test subjects when utilizing aspects of the present disclosure.

Users who wish to have greater conformation between the leg and the device will tighten thigh strap 1128. Tighter straps increase the ability for the device to manage joint stability. As such, tighter straps can lead to reduced laxity of the leg and endoskeleton system. This allows people to wear the devices at a degree of tightness that they find comfortable and increase tightness when needing extra joint stability or extra kinetic energy recovery Now referring to FIG. 25, a graph of treadmill test results by various test subjects when utilizing aspects of the present disclosure, is shown. FIG. 25 demonstrates that rudimentary prototypical devices created for the test were capable of influencing metabolic demand.

Further laboratory testing in university settings of volunteer participants under IRB approval have continued to show unanticipated benefits, including increase in jump height, increase in jump velocity, improvement in limiting of inversion/eversion range of motion, re-distribution of the center of plantar pressure between the sole of the foot and the footbed inside the shoe, and maintenance of postural stability as compared to ankle braces.

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should be defined only in accordance with the following claims and their equivalents.

In addition, it should be understood that the figures, which highlight the structure, methodology, functionality and advantages of the present disclosure, are presented as examples only. The present disclosure is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

BIBLIOGRAPHY

1. Sawicki, G S, Ferris, D P. Powered ankle exoskeletons reveal the metabolic cost of plantar flexor mechanical work during walking with longer steps at constant step frequency. The Journal of Experimental Biology; 212: 21-31. 2009
2. Sawicki, G S, Lewis, C L, Ferris, D P. It pays to have a spring in your step. Exercise Sport Science Review; Vol. 37, No. 3: 130-138. 2009.
3. Ferris, D P, Sawicki, G S, Daley, M A. A physiologist's perspective on robotic exoskeletons for human locomotion. International Journal of Humanoid Robotics; Vol. 4, No. 3: 507-528. 2007
4. Cain S M, Gordon K E, Ferris D P. Locomotor adaptation to a powered ankle-foot orthosis depends on control method. Journal of Neuroeng Rehabil. 2007 Dec. 21; 4:48.
5. Gordon, K E, Sawicki G S, Ferris, D P. Mechanical performance of artificial pneumatic muscles to power an ankle-foot orthosis. Journal of Biomechanics 39: 1832-1841. 2006

What is claimed is:

1. Footwear comprising:

a footwear body configured to receive a user's foot;

a rotatable collar yoke associated with a first portion of the footwear body and configured to rotate in a sagittal plane of a user relative to a sole of the footwear body when worn;

a yoke extension attached to the collar yoke, wherein the yoke extension is configured to engage with a portion of the user's leg; and a connector configured to selectively connect the yoke extension to a second portion of the footwear body to transmit a force from the yoke extension to the footwear body to apply sagittal plane pivotal forces in the footwear body relative to the collar yoke.

2. The footwear of claim 1, further comprising a supplemental power element connected in series with the connector, wherein the supplemental power element is configured to apply tension to the connector when the connector is connected to the footwear body.

3. The footwear of claim 1, further comprising an elastic member connected in series with the connector, wherein the elastic member is configured to apply tension to the connector when the connector is connected to the footwear body.

4. The footwear of claim 3, further comprising a tension adjuster connected to the connector, wherein the tension adjuster is configured to adjust a tension applied to the connector.

5. The footwear of claim 4, wherein the tension adjuster is configured to adjust the tension by adjusting a length of the connector between the yoke extension and the second portion of the footwear body.

6. The footwear of claim 3, wherein the elastic member comprises at least one of the following materials: rubber, silicone, thermoplastic, and/or urethane.

7. The footwear of claim 3, wherein the elastic member includes at least one selected from the group of a round cord, a flat cord, an elastic sheet material, a spring, and elastomeric component.

8. The footwear of claim 1, wherein the yoke extension is selectively attachable to the collar yoke.

9. The footwear of claim 1, wherein the yoke extension extends towards the user's knee from the collar yoke when the yoke extension is attached to the collar yoke and the footwear is worn by the user.

10. The footwear of claim 1, wherein the collar yoke is attached to an upper portion of the footwear body.

11. A method of supplementing a user's gait, the method comprising:

applying force to a yoke extension with a portion of a user's leg, wherein the yoke extension is attached to a rotatable collar yoke associated with a first portion of a footwear body;

transmitting a force from the yoke extension to a second portion of the footwear body using a connector that selectively connects the yoke extension to the second portion of the footwear body to apply sagittal plane pivotal forces to the footwear body; and rotating the collar yoke in a sagittal plane of the user relative to a sole of the footwear body in response to the transmitted force.

12. The method of claim 11, further comprising connecting the connector to the second portion of the footwear body.

13. The method of claim 12, further comprising disconnecting the connector from the second portion of the footwear body.

14. The method of claim 11, wherein the collar yoke is attached to an upper portion of the footwear body.

15. The method of claim 11, further comprising attaching the yoke extension to the collar yoke and/or the footwear body.

16. The method of claim 15, further comprising removing the yoke extension.

17. The method of claim 11, further comprising applying tension to the connector with a supplemental power element.

18. The method of claim 11, further comprising applying tension to the connector with an elastic member.

19. The method of claim 18, further comprising pretensioning the connector.

20. The method of claim 11, wherein the yoke extension extends towards the user's knee from the collar yoke when the yoke extension is attached to the collar yoke.

* * * * *